US011970814B2

(12) United States Patent
Chae et al.

(10) Patent No.: US 11,970,814 B2
(45) Date of Patent: Apr. 30, 2024

(54) GARMENT FOLDING MACHINE AND METHOD OF CONTROLLING THE SAME

(71) Applicant: LG Electronics Inc., Seoul (KR)

(72) Inventors: Kyosoon Chae, Seoul (KR); Keunjoo Kim, Seoul (KR); Sunghoon Ahn, Seoul (KR); Choongho Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 213 days.

(21) Appl. No.: 17/468,144

(22) Filed: Sep. 7, 2021

(65) Prior Publication Data

US 2022/0074125 A1 Mar. 10, 2022

(30) Foreign Application Priority Data

Sep. 7, 2020 (KR) ..... 10-2020-0113621

(51) Int. Cl.
*D06F 89/02* (2006.01)
*B65B 63/04* (2006.01)

(52) U.S. Cl.
CPC ..... *D06F 89/02* (2013.01); *B65B 63/045* (2013.01)

(58) Field of Classification Search
CPC ..... A41H 43/025; A41H 43/0257; B65H 63/045; D06F 89/00; D06F 89/02; D06F 89/023
See application file for complete search history.

(56) References Cited

U.S. PATENT DOCUMENTS 3,361,424 A * 1/1968 Kamberg ..... D06F 89/00 493/418
2004/0226198 A1 11/2004 Borucki
2019/0309465 A1 10/2019 Rozov

FOREIGN PATENT DOCUMENTS

KR 20130109901 10/2013
KR 20200028826 3/2020
KR 20200042936 4/2020

OTHER PUBLICATIONS

International Search Report in International Appln. No. PCT/KR2021/012164, dated Dec. 27, 2021, 6 pages (with English translation).

* cited by examiner

*Primary Examiner* — F Griffin Hall
(74) *Attorney, Agent, or Firm* — Fish & Richardson P.C.

(57) ABSTRACT

A garment folding machine includes: a frame unit defining an external framework of the garment folding machine, a loading unit configured to receive a garment, a folding unit configured to convey and fold the received garment, and an unloading unit configured to collect the garment from the folding unit. The folding unit comprises a plurality of folding layers that are spaced apart from each other in a vertical direction, where each of the plurality of folding layers includes a conveyor configured to convey the garment, and a conveyor motor configured to provide driving power to the conveyor. A first conveyor motor is configured to, based on the garment being positioned over two or more adjacent conveyors of the plurality of folding layers, operate at a first rotational speed that is different from a second rotational speed of a second conveyor motor disposed above the first conveyor motor.

22 Claims, 28 Drawing Sheets

GARMENT FOLDING MACHINE AND METHOD OF CONTROLLING THE SAME

CROSS-REFERENCE TO RELATED APPLICATION

This application claims the benefit of priority to Korean Application No. 10-2020-0113621, filed on Sep. 7, 2020, the disclosure of which is incorporated by reference in its entirety.

TECHNICAL FIELD

The present disclosure relates to a garment folding machine and a method of controlling the same, and more particularly, a garment folding machine and a method of controlling the same that are capable of removing wrinkles of a garment formed during a process of conveying and folding the garment.

BACKGROUND

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. For example, when the garments are folded by unskilled persons, the shapes and the sizes of the folded garments are not uniform causing a problem in that additional labor is required to fold the garments for the purpose of displaying or storing the garments.

Therefore, there is a gradually increasing need for an automatic folding machine capable of quickly folding a garment without variation.

A conventional garment folding machine discloses that a garment is loaded from above, folded, and then discharged while moving downward and passing through a plurality of folding layers stacked in multiple stages.

However, in the conventional garment folding machine, lower garments, which have long lengths among garments, towels, or bedclothes, are conveyed along the two or more folding layers and may be wrinkled during the conveying process.

For example, in the conventional garment folding machine, the plurality of layers is vertically disposed in a narrow horizontal area due to a spatial restriction, spaces between the layers are narrow, and many components are provided to convey the garments between the layers. For this reason, the garment is easily wrinkled during the process of conveying the garment.

The conventional garment folding apparatus also includes a plurality of layers and is configured to fold a garment having sleeves.

However, in the conventional garment folding apparatus, a user inconveniently needs to spread the sleeves of the garment and dispose the garment in an uppermost end layer, and there is a limitation in that the garment folding apparatus can fold only the garments such as shirts.

Moreover, there is a limitation in that a large space is required in a leftward-rightward direction to place the sleeves of the garment. Because a structure for horizontally folding the garment is disposed at an end in a forward-rearward direction, there is a limitation in that a large space is also required in a forward-rearward direction.

However, because the conventional garment folding apparatus has a space in which sleeves of a garment are spread in an uppermost end layer so that the sleeves are folded, there is a limitation in that a large space is required in a leftward-rightward direction. Further, because a plurality of conveyors each at least having a longer length than a garment is disposed in a forward-rearward direction to horizontally fold the garment, there is a limitation in that a large space is also required in the forward-rearward direction.

Moreover, the conventional garment folding apparatus discloses a configuration in which a conveying speed of an input conveyor is set to be higher than a conveying speed of a fitting conveyor to impart a tensile force to the garment.

However, a speed difference occurring between the conveyors disposed in a horizontal direction allows the operation of folding the garment to be accurately performed by preventing the garment from being misaligned during a process of loading the garment. However, there is a limitation in that it is impossible to prevent wrinkles caused by a sag of the garment during the process of conveying the garment between the plurality of layers.

Therefore, there is a need to provide a garment folding machine and a method of controlling the garment folding machine, which are capable of maximizing space efficiency and preventing the garment from being wrinkled and crumpled during the process of conveying the garment.

SUMMARY

The present disclosure is directed to a garment folding machine, in which a plurality of layers is vertically disposed in a narrow horizontal area, spaces between the layers are narrow, and many components are provided to convey garments between the layers, such that the garment is easily wrinkled during a process of conveying the garment. Therefore, an object of the present disclosure is to provide a garment folding machine and a method of controlling the garment folding machine, which are capable of preventing the garment from being wrinkled and crumpled during the process of conveying the garment.

Another object of the present disclosure is to provide a garment folding machine and a method of controlling the garment folding machine, which are capable of removing wrinkles and crumples already formed during a process of conveying a garment.

Still another object of the present disclosure is to provide a garment folding machine and a method of controlling the garment folding machine, which are capable of preventing a garment from being wrinkled and crumpled during a process of conveying the garment even though the garment has a long length.

According to one aspect of the subject matter described in this application, a garment folding machine includes a frame unit defining an external framework of the garment folding machine, a loading unit configured to receive a garment, a folding unit configured to convey and fold the received garment, and an unloading unit configured to collect the garment from the folding unit. The folding unit can include a plurality of folding layers that are spaced apart from each other in a vertical direction. Each of the plurality of folding layers can include a conveyor configured to convey the garment, and a conveyor motor configured to provide driving power to the conveyor. A first conveyor motor can be configured to, based on the garment being positioned over two or more adjacent conveyors of the plurality of folding layers, operate at a first rotational speed that is different from a second rotational speed of a second conveyor motor disposed above the first conveyor motor.

Implementations according to this aspect can include one or more of the following features. For example, the first rotational speed can be faster than the second rotational speed.

In some implementations, the folding unit can further include a first folding layer, and a second folding layer disposed below the first folding layer. The first folding layer can include a first conveyor configured to convey, from a front end to a rear end of the first conveyor, the garment, and a first conveyor motor configured to provide driving power to the first conveyor. The second folding layer can include a second conveyor configured to convey, from a rear end to a first end of the second conveyor, the garment that is conveyed from the first folding layer, and a second conveyor motor configured to provide driving power to the second conveyor. The second conveyor motor can be configured to, based on the garment being positioned on the first conveyor and the second conveyor, operate at a rotational speed different from a rotational speed of the first conveyor motor.

In some examples, the folding unit can further include a third folding layer disposed below the second folding layer. The third folding layer can include a third conveyor configured to convey, from a front end to a rear end of the third conveyor, the garment that is conveyed from the second folding layer, and a third conveyor motor configured to provide driving power to the third conveyor. The first conveyor motor, the second conveyor motor, and the third conveyor motor can configured to, based on the garment being positioned on the first conveyor, the second conveyor, and the third conveyor, operate at different rotational speeds.

In some implementations, the folding unit can include a first folding layer, a second folding layer disposed below the first folding layer, and a third folding layer disposed below the second folding layer. The second folding layer can include a second conveyor configured to convey, from a rear end to a front end of the second conveyor, the garment that is conveyed from the first folding layer, and a second conveyor motor configured to provide driving power to the second conveyor. The third folding layer can include a third conveyor configured to convey, from a front end to a rear end of the third conveyor, the garment that is conveyed from the second folding layer, and a third conveyor motor configured to provide driving power to the third conveyor. The third conveyor motor can be configured to, based on the garment being positioned on the second conveyor and the third conveyor, operate at a rotational speed different from a rotational speed of the second conveyor motor.

In some examples, the folding unit can further include a fourth folding layer disposed below the third folding layer. The third folding layer can further include a fourth conveyor that is disposed rearward from the third conveyor and that is configured to convey, from a front end to a rear end of the fourth conveyor, the garment conveyed from the third conveyor, and a fourth conveyor motor configured to provide driving power to the fourth conveyor. The fourth folding layer can include a fifth conveyor that is disposed below the fourth conveyor and that is configured to convey, from a rear end to a front end of the fifth conveyor, the garment conveyed from the fourth conveyor, and a fifth conveyor motor configured to provide driving power to the fifth conveyor. The fifth conveyor motor can be configured to, based on the garment being positioned on the fourth conveyor and the fifth conveyor, operate at a rotational speed different from a rotational speed of the fourth conveyor motor.

According to another aspect of the subject matter described in this application, a garment folding machine can include a frame unit defining an external framework of the garment folding machine, a loading unit configured to receive garment, a folding unit configured to convey and fold the received garment, and an unloading unit configured to collect the garment from the folding unit. The folding unit can include a plurality of folding layers that are spaced apart from each other in a vertical direction. Each of the plurality of folding layers can include a conveyor configured to convey the garment, and a conveyor motor configured to provide driving power to the conveyor. The conveyor motor can be configured to, based on a tip of the garment passing through the conveyor, change a rotational speed.

In some examples, the folding unit can further include a first folding layer, and a second folding layer disposed below the first folding layer. The first folding layer can include a first conveyor configured to convey, from a front end to a rear end of the first conveyor, the garment, and a first conveyor motor configured to provide driving power to the first conveyor. The first conveyor motor can be configured to, based on the garment entering the first conveyor, rotate at a predetermined first rotational speed, and the first conveyor motor is configured to, based on the tip of the garment passing through a rear end of the first conveyor, rotate at a predetermined second rotational speed different from the first rotational speed.

In some examples, the folding unit can further include a third folding layer disposed below the second folding layer. The second folding layer can include a second conveyor configured to convey, from a rear end to a front end of the second folding layer, the garment that is conveyed from the first folding layer. The first conveyor motor can be configured to, based on the tip of the garment passing through the front end of the second conveyor and a rear end of the garment being positioned on the first conveyor, rotate at a predetermined third rotational speed different from the first rotational speed and the second rotational speed.

In some implementations, the conveyor motor can be configured to decrease the rotational speed from a predetermined first rotational speed to a predetermined second rotational speed, and the conveyor motor can be configured to (i) rotate at a predetermined third rotational speed and (ii) rotate at the second rotational speed. In some implementations, the conveyor can be configured to gradually decrease the rotational speed from a predetermined first rotational speed to a predetermined second rotational speed.

In some examples, the conveyor motor can be configured to decrease the rotational speed from a predetermined first rotational speed to a predetermined second rotational speed, and the conveyor motor can be configured to gradually decrease the rotational speed from the second rotational speed to a predetermined third rotational speed.

According to another aspect of the subject matter described in this application, a method of controlling a garment folding machine having a plurality of folding layers configured to perform folding a garment or conveying the garment using at least one conveyor, can include a first conveying step of conveying the garment at a predetermined first conveying speed by a first conveyor provided in a first folding layer disposed at an uppermost side among the plurality of folding layers, and a second conveying step of conveying, based on a tip of the garment passing through the first conveyor and entering a second conveyor disposed below the first conveyor, the garment at a predetermined second conveying speed by the first conveyor. The first conveying speed can be different from the second conveying speed.

Implementations according to this aspect can include one or more following features. For example, in the second conveying step, the second conveyor can be configured to convey the garment at the first conveying speed.

In some implementations, the method can further include a third conveying step of conveying, based on (i) the tip of the garment passing through the second conveyor and entering a third conveyor disposed below the second conveyor and (ii) a part of the garment being positioned on the first conveyor, the garment at a predetermined third conveying speed by the first conveyor. The third conveying speed can be different from the first conveying speed and the second conveying speed. In some examples, in the third conveying step, the second conveyor can be configured to convey the garment at the second conveying speed.

In some implementations, in the third conveying step, the third conveyor can be configured to convey the garment at the first conveying speed. In some implementations, in the second conveying step, a speed of conveying the garment can be changed to a predetermined third conveying speed once or more while the first conveyor conveys the garment at the second conveying speed, and the third conveying speed can be different from the second conveying speed.

In some examples, the method can further include a conveyance ending step of halting the first conveyor based on a rear end of the garment passing through the first conveyor. In some implementations, in the second conveying step, the first conveyor can be configured to, based on vertical folding performing on the garment, stop.

According to another aspect of the subject matter described in this application, a garment folding machine can include a frame unit defining an external framework of the garment folding machine, a loading unit configured to receive a garment, a folding unit configured to convey and fold the received garment, and an unloading unit configured to collect the folded garment from the folding unit. The folding unit can include a plurality of folding layers that are spaced apart from each other in a vertical direction. Each of the plurality of folding layers can include a conveyor configured to convey the garment, and a conveyor motor configured to provide driving power to the conveyor. The garment folding machine can further include a garment detection sensor that is disposed at an end of the conveyor in a direction in which the conveyor conveys the garment and that is configured to detect whether the garment reaches the garment detection sensor. The conveyor motor can be configured to rotate at a predetermined first rotational speed, and the conveyor motor can be configured to, based on the garment detection sensor detecting a tip of the garment, rotate at a predetermined second rotational speed different from the first rotational speed.

Implementations according to this aspect can include one or more following features. For example, the folding unit can include a first folding layer, and a second folding layer disposed below the first folding layer. The first folding layer can include a first conveyor configured to convey, from a front end to a rear end of the first conveyor, the garment, a first conveyor motor configured to provide driving power to the first conveyor, and a first-conveyor-rear-end garment detection sensor that is disposed at a rear end of the first conveyor and that is configured to detect whether the garment reaches the rear end of the first conveyor. The first conveyor motor can be configured to rotate at the predetermined first rotational speed, and the first conveyor motor can be configured to, based on the first-conveyor-rear-end garment detection sensor detecting the tip of the garment, rotate at the predetermined second rotational speed different from the first rotational speed.

In some examples, the second folding layer can include a second conveyor configured to convey, from a rear end to a front end of the second conveyor, the garment that is conveyed from the first folding layer, and a second conveyor motor configured to provide driving power to the second conveyor. The second conveyor motor can be configured to, based on the first-conveyor-rear-end garment detection sensor detecting the tip of the garment, rotate at the first rotational speed.

In some implementations, the second folding layer can include a second conveyor configured to convey, from a rear end to a front end of the second conveyor, the garment, a second conveyor motor configured to provide driving power to the second conveyor, and a second-conveyor-front-end garment detection sensor that is disposed at the front end of the second conveyor and that is configured to detect whether the garment reaches the front end of the second conveyor. The first conveyor motor can be configured to, based on the second-conveyor-front-end garment detection sensor detecting the tip of the garment in a state in which the first-conveyor-rear-end garment detection sensor detects presence of the garment, rotate at a predetermined third rotational speed different from the second rotational speed.

DETAILED DESCRIPTION

Hereinafter, an exemplary garment folding machine 1 will be described with reference to FIGS. 1 to 3.

Figure 1:
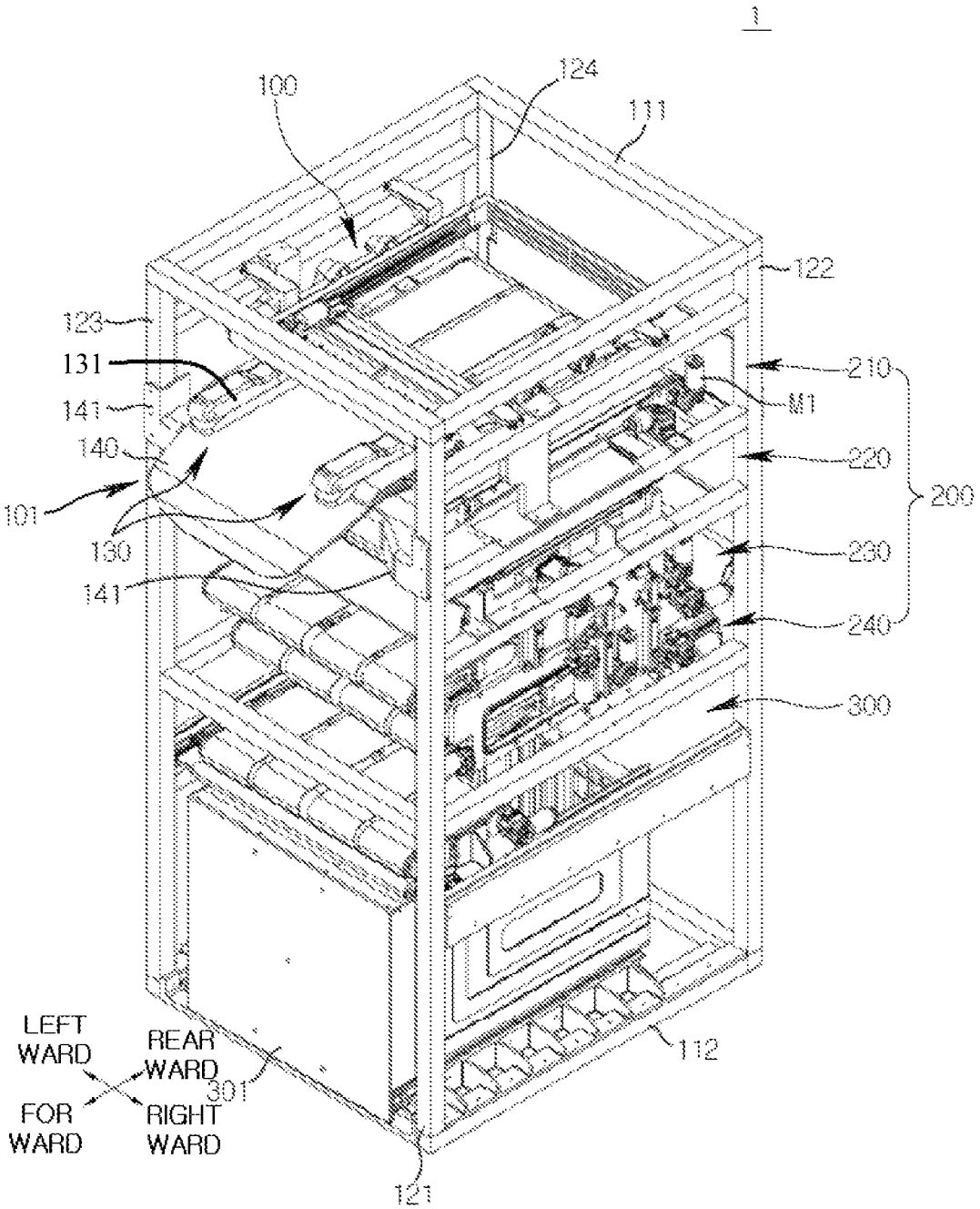
FIG. 1 is a diagram of an exemplary garment folding machine.
Figure 2:
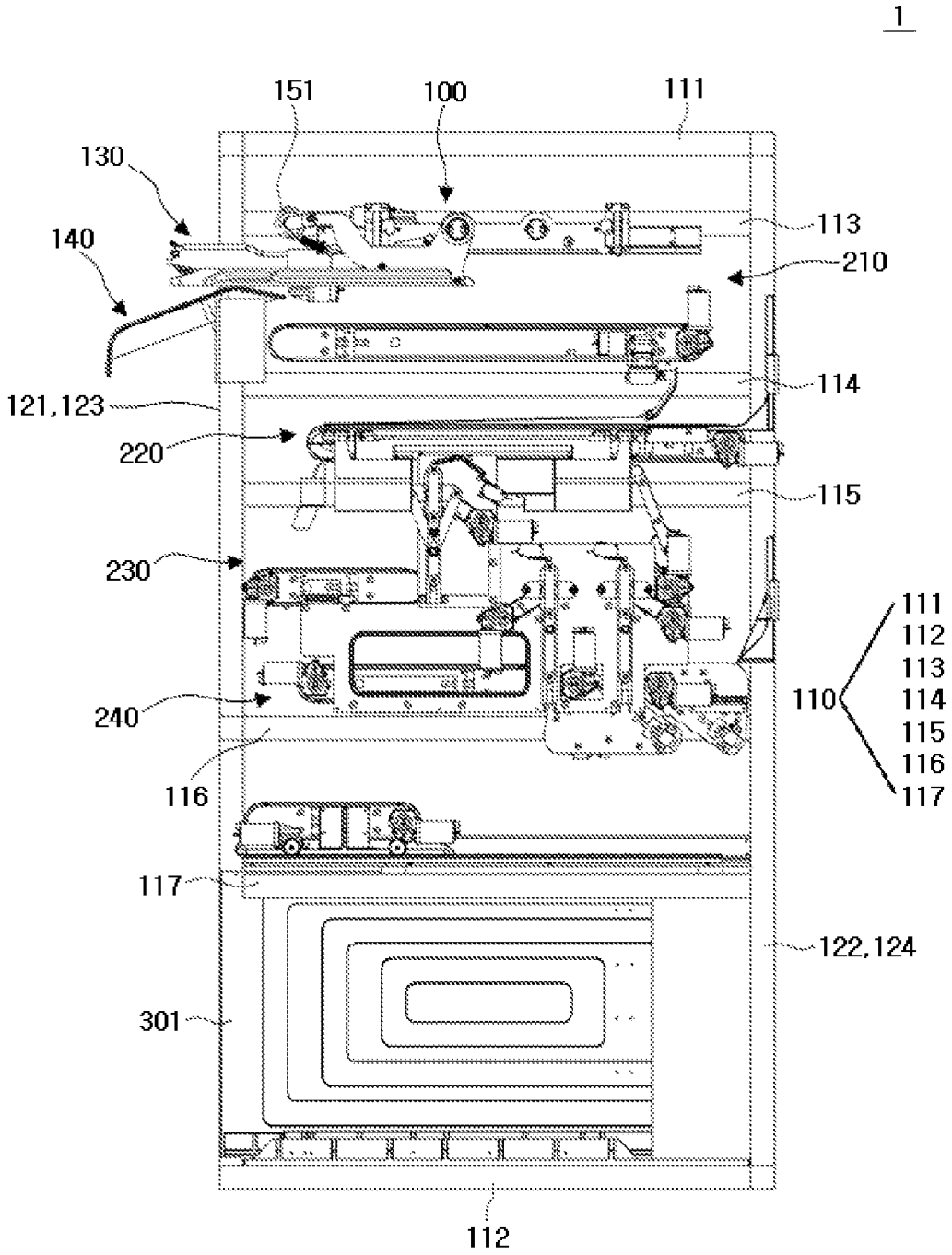
FIG. 2 is a side view of the exemplary garment folding machine in FIG. 1 illustrating a plurality of folding layers disposed as a layered structure.
Figure 3:
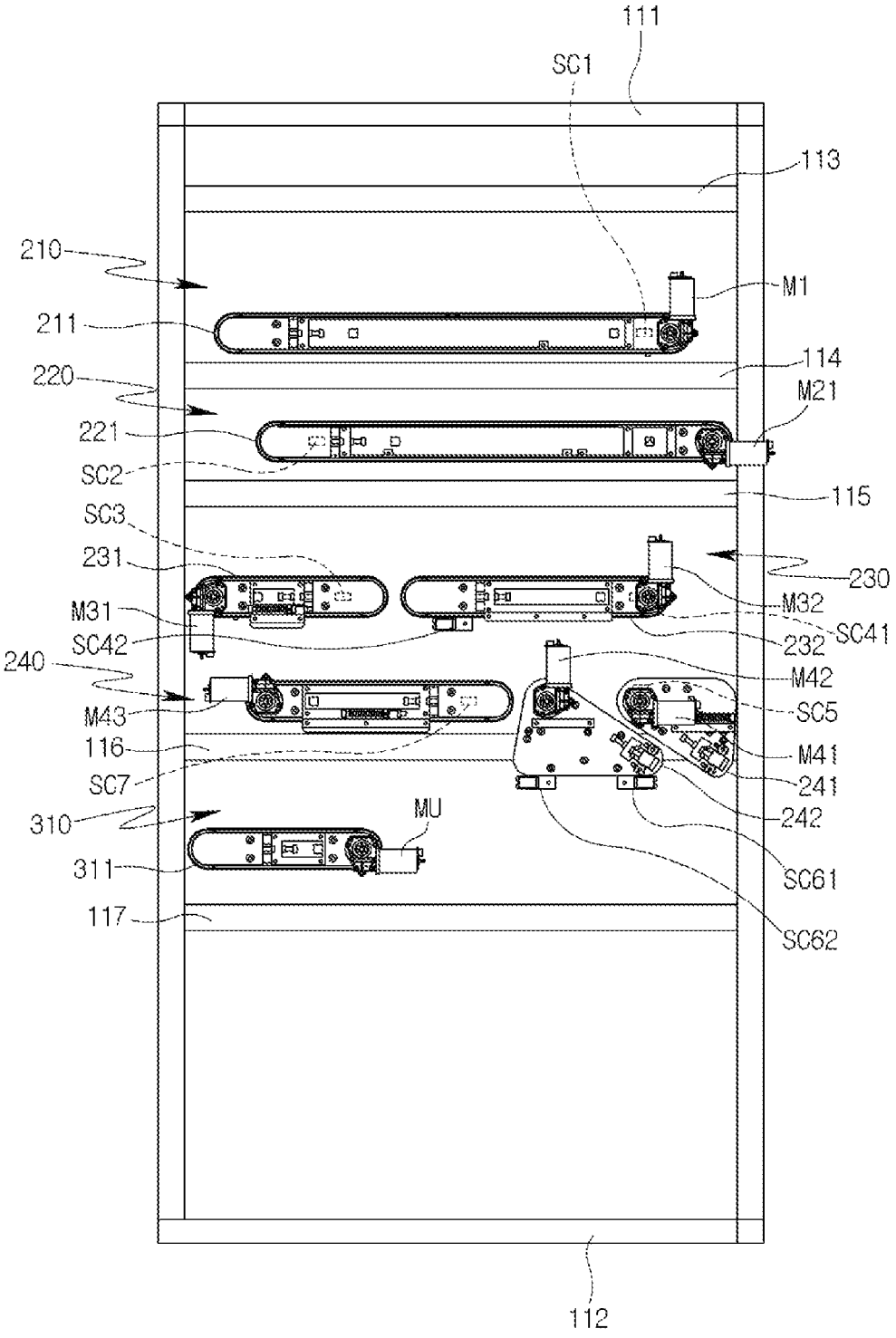
FIG. 3 is a diagram illustrating exemplary conveyor structures of individual folding layers in FIG. 2.

Referring to FIGS. 1 to 3, the exemplary garment folding machine 1 includes a frame unit 110 that serves as an external framework.

The frame unit 110 is disposed at an outer edge of the garment folding machine 1 and defines a minimum operating space in the garment folding machine 1. The frame unit 110 can stably support several members constituting the garment folding machine 1.

In some implementations, the frame unit 110 includes an upper frame 111, a lower frame 112, a plurality of horizontal frames 113, 114, 115, 116, and 117, and a plurality of vertical frames 121, 122, 123, and 124.

The upper frame 111 is horizontally disposed at an upper end of the garment folding machine 1, and an upper operating space of the garment folding machine 1 can be defined by the upper frame 111.

The lower frame 112 can be horizontally disposed at a lower end of the garment folding machine 1 and can support the garment folding machine 1 on a floor. A lower operating space of the garment folding machine 1 can be defined by the lower frame 112.

The plurality of horizontal frames 113, 114, 115, 116, and 117 can be horizontally disposed between the upper frame 111 and the lower frame 112. A loading unit 100, a folding unit 200, and an unloading unit 300, which will be described below, can be mounted and supported on the plurality of horizontal frames 113, 114, 115, 116, and 117.

A space between the two horizontal frames can be defined as an operating space for an individual folding layer.

For example, an operating space for a second folding layer 220 (see FIGS. 2 and 3) for performing vertical folding can be defined by the second horizontal frame 114 and the third horizontal frame 115.

In some implementations, the space between the two horizontal frames can also be defined as an operating space for the two folding layers.

For example, an operating space for the third folding layer 230 and the fourth folding layer 240 (see FIGS. 2 and 3) for performing horizontal folding can be defined by the third horizontal frame 115 and the fourth horizontal frame 116.

In addition, the first horizontal frame 113 disposed adjacent to the upper frame 111 can be provided to support a clip assembly 130 for holding and conveying a garment inputted into a loading part 101. The fifth horizontal frame 117 disposed adjacent to the lower frame 112 can be provided below a guide rail to support the guide rail that serves to allow an unloading conveyor 311, to be described below, to slide in a forward-rearward direction.

In some implementations, the vertical frames 121, 122, 123, and 124 include the first and third vertical frames 121 and 123 disposed at a front side from which the garment is inputted, and the second and fourth vertical frames 122 and 124 disposed to face the first and third vertical frames 121 and 123 and configured to define a rear operating space in the garment folding machine 1.

For example, based on the state in which the garment folding machine 1 is installed on the ground surface, a direction in which the garment is loaded is referred to as a forward direction, and a direction opposite to the forward direction is referred to as a rearward direction.

Figure 16:
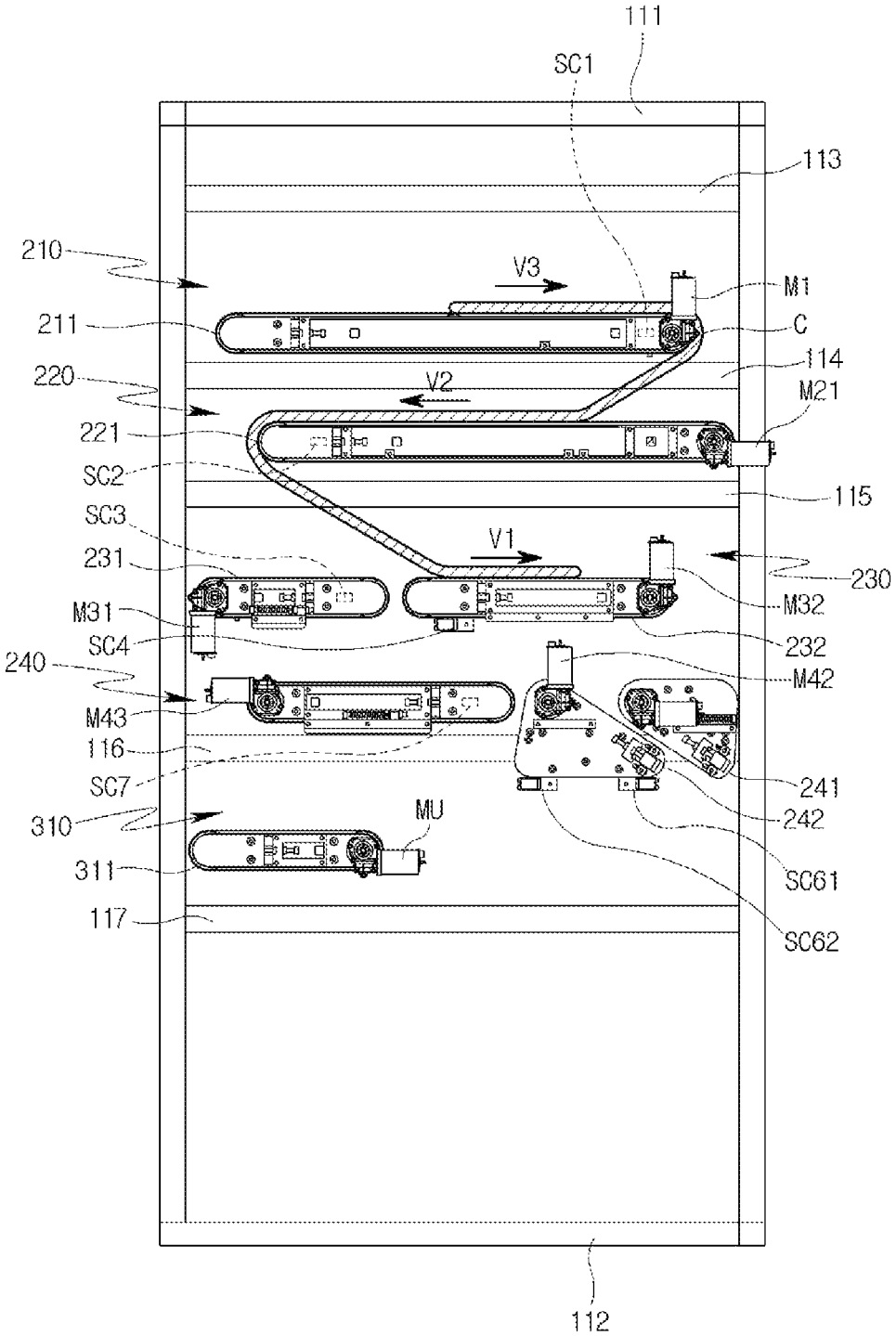
FIG. 16 is a schematic view for explaining the process of conveying the garment along the first to third folding layers.

A finishing cover can be stably attached to an outer peripheral side of the frame unit 110, and the finishing cover serves to define an external appearance of the garment folding machine 1 and protect the members disposed in the garment folding machine 1. In addition, an input unit, a display unit 600 (see FIG. 16), and an alarm unit 700 (see FIG. 16) can be provided on a front portion of the finishing cover, the input unit is configured to receive a control instruction from a user, the display unit 600 is configured to visually provide the user with information on operating states of the garment folding machine 1, and the alarm unit 700 is configured to aurally provide the user with information on the operating states of the garment folding machine 1.

Since the frame unit 110 is provided as described above, a vertical folding assembly 222 and horizontal folding assemblies 233, 244, and 245 are supported at the same time so that the functions of conveying and folding the garment are smoothly performed by respective folding layers 210, 220, 230, and 240 of the folding unit 200 to be described below, such that a required space may be saved and an overall volume of the garment folding machine 1 can be reduced.

In some implementations, the garment folding machine 1 can include the loading unit 100, the folding unit 200, and the unloading unit 300.

The loading unit 100, the folding unit 200, and the unloading unit 300 can be supported on the frame unit 110, and an operating space for the loading unit 100, an operating space for the folding unit 200, and an operating space for the unloading unit 300 can be defined by the frame unit 110.

For example, the operating space of the loading unit 100 can be defined by the upper frame 111 and the second horizontal frame 114, and the operating space of the unloading unit 300 can be defined by the fourth horizontal frame 116 and the lower frame 112.

The loading unit 100 can be configured to load the garment. The loading unit 100 can be configured to load the garment, which is inputted to the loading part 101, at a predetermined position on an upper surface of a first conveyor 211 of the first folding layer 210.

For example, the garments not only mean upper garments or lower garments manufactured using natural fibers or synthetic fibers so as to be worn by persons, but also include all products such as towels or bedclothes that may be provided by being folded to have desired sizes and thicknesses by the garment folding machine 1.

As an example, the loading unit 100 can include the clip assembly 130 (see FIGS. 1 and 2) that holds the garment inputted by the loading part 101.

FIGS. 1, 2, 4A, 4B and 4C illustrate the clip assembly 130 configured to hold the garment at two points. For convenience, the clip assembly 130 configured to hold the garment at the two points will be described.

When the garment is completely held at a first position P1 corresponding to an initial position, the clip assembly 130 can draw the garment into the garment folding machine 1 and can move the garment to a second position P2 corresponding to a loading position on the upper surface of the first conveyor 211 while holding the garment and moving rearward by a predetermined distance. When the clip assembly 130 completely moves to the second position P2, the clip assembly 130 can release the garment.

In addition, after the clip assembly 130 releases the garment, the clip assembly 130 can additionally move to a third position P3, that is, a position disposed further rearward from the second position P2. When the clip assembly 130 reaches the third position P3, the first conveyor 211 of the first folding layer 210 begins to operate.

The loading unit 100 can include a loading unit motor ML configured to generate power for moving the clip assembly 130 in the forward-rearward direction. For example, the loading unit motor ML has a pinion gear fixed to the clip assembly 130 and connected to an output shaft of the loading unit motor ML, and the pinion gear can engage with a rectilinear gear fixed to a frame 104 of the loading unit 100, such that rotational power of the loading unit motor ML can be converted into a force for rectilinear motion in the forward-rearward direction.

In some implementations, clip position detection sensors SL for specifying the first to third positions P1, P2, and P3 are provided on the frame 104 of the loading unit 100. For example, the clip position detection sensors SL can include an initial position detection sensor SL1 configured to detect whether the clip assembly 130 is positioned at the first position P1, a clip open position detection sensor SL2 configured to detect whether the clip assembly 130 is positioned at the second position P2, and a stop position detection sensor SL3 configured to detect whether the clip assembly 130 is positioned at the third position P3.

The detailed configuration in relation to the operation of the first conveyor 211 related to the movement of the clip assembly 130 will be described below with reference to FIGS. 4A to 4C.

The folding unit 200 can be configured to convey and fold the garment loaded by the loading unit 100.

For example, as illustrated in FIGS. 2 and 3, the folding unit 200 includes the four or more folding layers 210, 220, 230, and 240 so that the loaded garment is conveyed and folded to an appropriate size and shape. The four or more folding layers 210, 220, 230, and 240 are disposed to be spaced apart from one another in the upward-downward direction.

The upward-downward direction can defined based on a direction (gravitational direction) perpendicular to the ground surface in the state in which the garment folding machine 1 is installed on the ground surface.

The loaded garment is folded one or more times while being conveyed from the folding layer at the upper side to the folding layer at the lower side, and the garments, which are completely folded to appropriate sizes and shapes, are collected in a discharge unit 301.

In some implementations, the folding unit 200 can include the four folding layers 210, 220, 230, and 240.

The four folding layers 210, 220, 230, and 240 can be disposed to be spaced apart from each another in the upward/downward direction and can be configured to allow the loaded garment to be folded to an appropriate size and shape while being conveyed from the first folding layer 210 at the uppermost side to the fourth folding layer 240 at the lowermost side.

The unloading layer 310 can be disposed below the fourth folding layer 240 at the lowermost side. In some implementations, the unloading layer 310 can be further provided below the fourth folding layer 240, and the completely folded garment is dropped onto the unloading layer 310. As described above, the unloading layer 310 can be provided with the discharge unit 301 such that the completely folded garments are uniformly collected.

Each of the folding layers 210, 220, 230, and 240 includes at least one conveyor 211, 221, 231, 241, 242, or 243. The conveyors 211, 221, 231, 241, 242, and 243 can be configured to convey or horizontally fold the loaded garment.

For example, in some implementations, the first folding layer 210 includes a first conveyor 211 and a first conveyor motor M1 configured to operate the first conveyor 211.

In addition, the second folding layer 220 includes a second conveyor 221 and a second conveyor motor M21 configured to operate the second conveyor 221.

In some implementations, the third folding layer 230 can include a third conveyor 231 and a fourth conveyor 232 spaced apart from each other at a predetermined interval, and a third conveyor motor M31 and a fourth conveyor motor M32 configured to operate the third conveyor 231 and the fourth conveyor 232, respectively.

As illustrated, the third conveyor 231 can be disposed at the front side of the garment folding machine 1, the fourth conveyor 232 can be disposed at the rear side of the garment folding machine 1, and an upper surface of the third conveyor 231 and an upper surface of the fourth conveyor can be disposed approximately side by side.

In some implementations, the predetermined interval defined between the third conveyor 231 and the fourth conveyor 232 of the third folding layer 230 is a first folding gap G1 that serves to allow the garment to pass through the first folding gap G1 while being horizontally folded.

In addition, the fourth folding layer 240 can include a fifth conveyor 241, a sixth conveyor 242, and a seventh conveyor 243 disposed sequentially from the rear side to the front side of the garment folding machine 1, and a fifth conveyor motor M41, a sixth conveyor motor M42, and a seventh conveyor motor M43 configured to operate the fifth conveyor 241, the sixth conveyor 242, and the seventh conveyor 243.

Two folding gaps G2 and G3 can be defined between the fifth conveyor 241, the sixth conveyor 242, and the seventh conveyor 243 provided in the fourth folding layer 240 so that the garment can be horizontally folded or can pass through the two folding gaps G2 and G3 while being horizontally folded.

For example, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

In some implementations, the folding unit 200 is configured to perform the vertical folding function that serves to vertically fold the loaded garment.

In some implementations, the first folding layer 210 and the second folding layer 220, which are the two upper folding layers among the four folding layers constituting the folding unit 200, are configured to vertically fold the garment.

For example, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

First, the first folding layer 210 can be configured to vertically fold the garment loaded from the loading unit 100 while conveying the garment to a rear end thereof. For example, the first folding layer 210 can vertically fold a sleeve portion of an upper garment that needs to be vertically folded.

Specifically, in a state in which the sleeve portion of the upper garment is folded to a predetermined degree by a seating plate 140 (see FIG. 1) provided in the loading part 101 of the loading unit 100 and by a primary vertical folding guide 141 provided at a lower side of the seating plate 140, the garment can be loaded onto the first conveyor 211 while being pulled by the clip assembly 130 and vertically folded primarily and manually.

As described above, the loading by the loading unit 100 and the vertical folding are performed at the same time in the first folding layer 210, such that the folding process can be simplified and the size of the machine can be reduced.

In some implementations, the second folding layer 220 can be provided with a vertical folding assembly 222 in order to vertically fold the garment C conveyed from the first folding layer 210.

The vertical folding assembly 222 can be configured as an active assembly having a mechanism that actively and vertically folds the garment C by receiving a force from a vertical folding motor M22 (see FIG. 6) which is a driving source.

For example, the vertical folding assembly 222 can include vertical folding plates 2221 (see FIG. 6) configured such that a position thereof is changed by the force from the vertical folding motor M22.

The pair of vertical folding plates 2221 having approximately the same shape can be provided, and the second conveyor 221 can be disposed between the pair of vertical folding plates 2221.

The vertical folding plates 2221 can be on standby on the same plane as an upper surface of the second conveyor at the initial position. In order to vertically fold the garment delivered from the first conveyor 211 and deployed on the second conveyor 221 and the vertical folding plates 2221, the pair of vertical folding plates 2221 can lift up two opposite portions of the garment and move the two opposite portions of the garment toward the inside of the garment, thereby vertically folding the garment.

The vertical folding assembly 222 can further include plate position sensors configured to detect an initial position and a vertical folding completion position of the vertical folding plates 2221.

For example, the vertical folding assembly 222 including the pair of vertical folding plates 2221 to perform the active vertical folding will be described below, but the present disclosure is not limited thereto.

The unloading unit 300 can be provided to collect and discharge the folded garment.

The unloading unit 300 can be configured such that the completely folded garment is conveyed from the unloading layer 310 (see FIG. 3) by the unloading conveyor 311 and collected in the discharge unit 301. Specifically, the unloading unit 300 can be configured such that the completely folded garment is conveyed by the unloading conveyor 311 and collected in the discharge unit 301 between the horizontal frame 116 and the lower frame 112.

In some implementations, the garment dropped by the folding assembly is placed on the unloading conveyor 311. Thereafter, the unloading conveyor 311 can move in the forward/rearward direction, and at the same time, an unloading plate can move in the upward/downward direction, such that the completely folded garments are uniformly collected in an internal space of the discharge unit 301.

In some implementations, the present disclosure can accurately detect and determine the lumping of the garment C during the process of conveying or folding the garment C.

Hereinafter, a process of detecting and determining the lumping of the garment C, which may occur during the process of conveying or folding the garment C in the respective folding layers of the loading unit 100 and the folding unit 200, will be described.

Figure 4A:
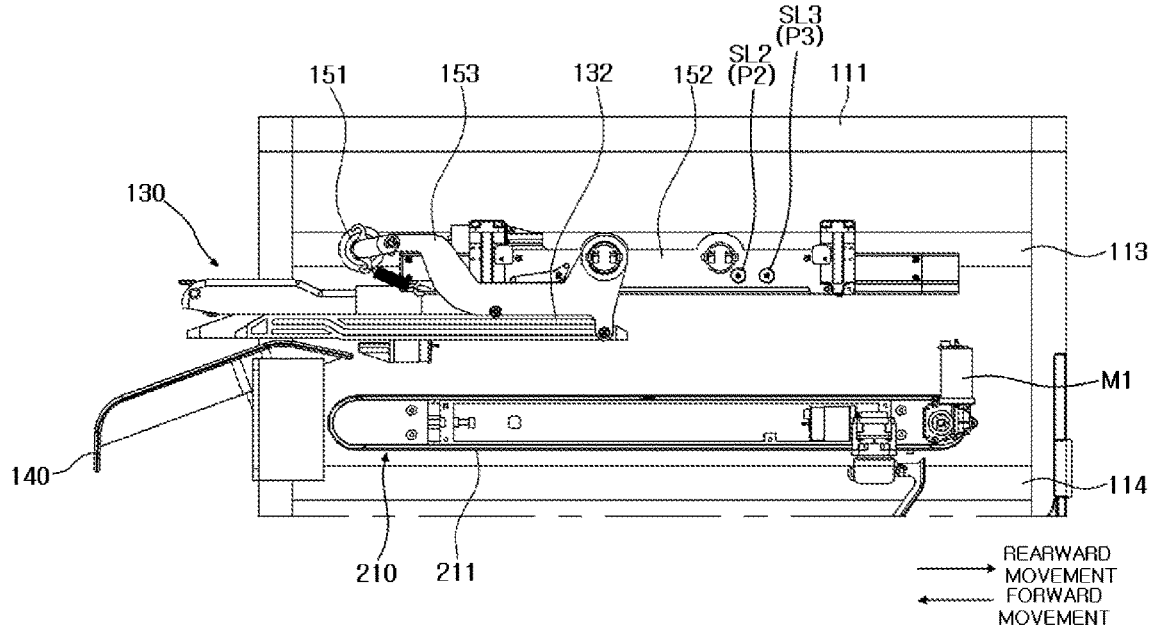
FIGS. 4A, 4B, and 4C are partial enlarged views for explaining an operation of a loading unit among the components illustrated in FIG. 2.
Figure 4B:
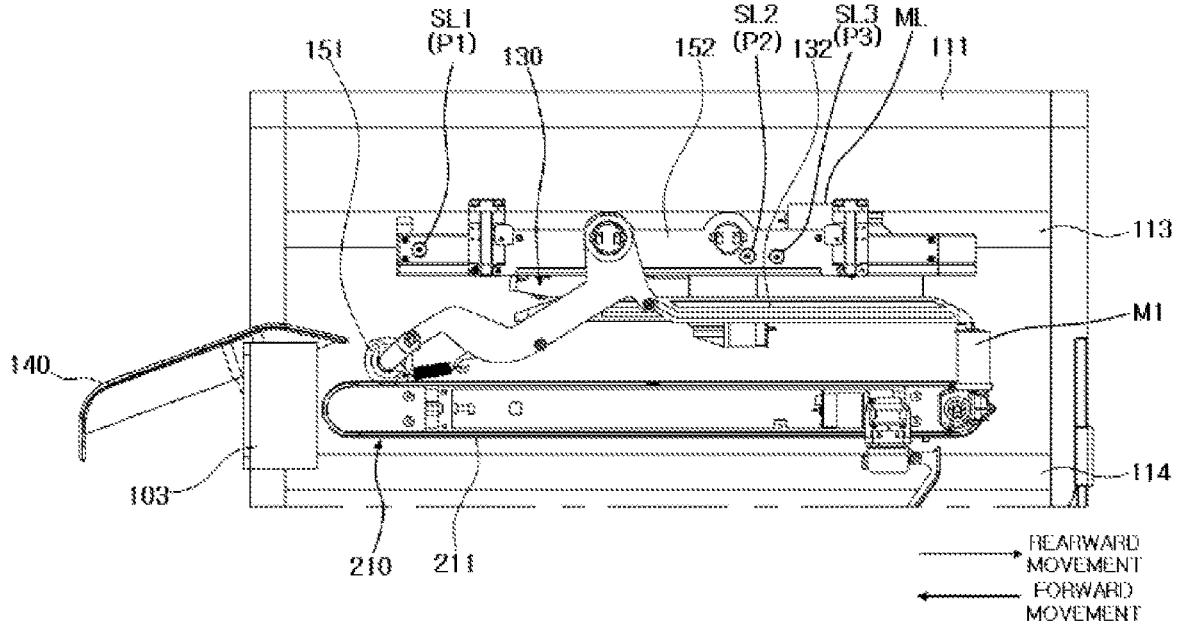
Figure 4C:
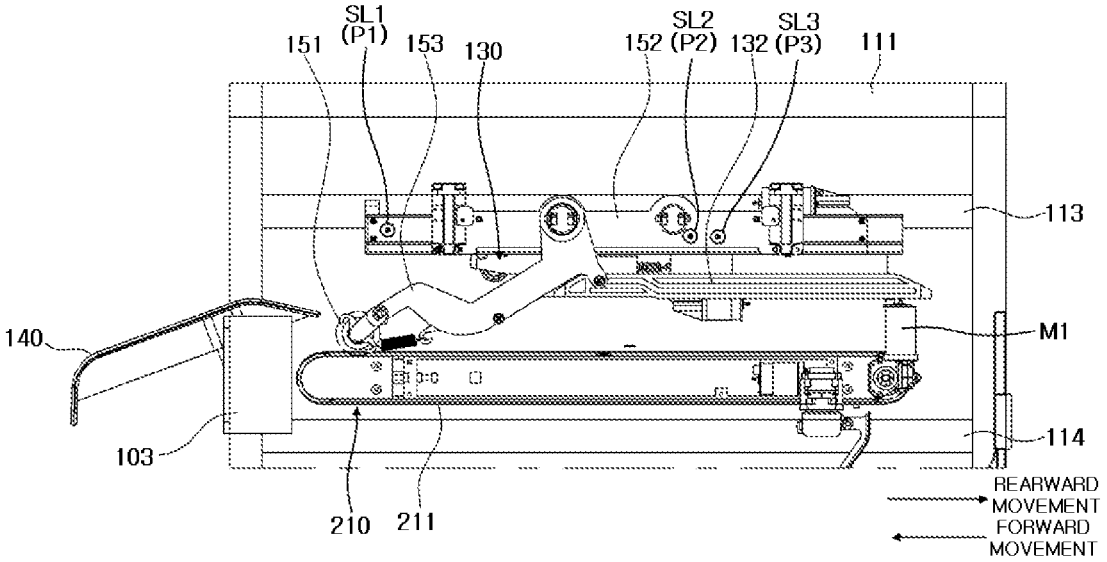
Figure 6:
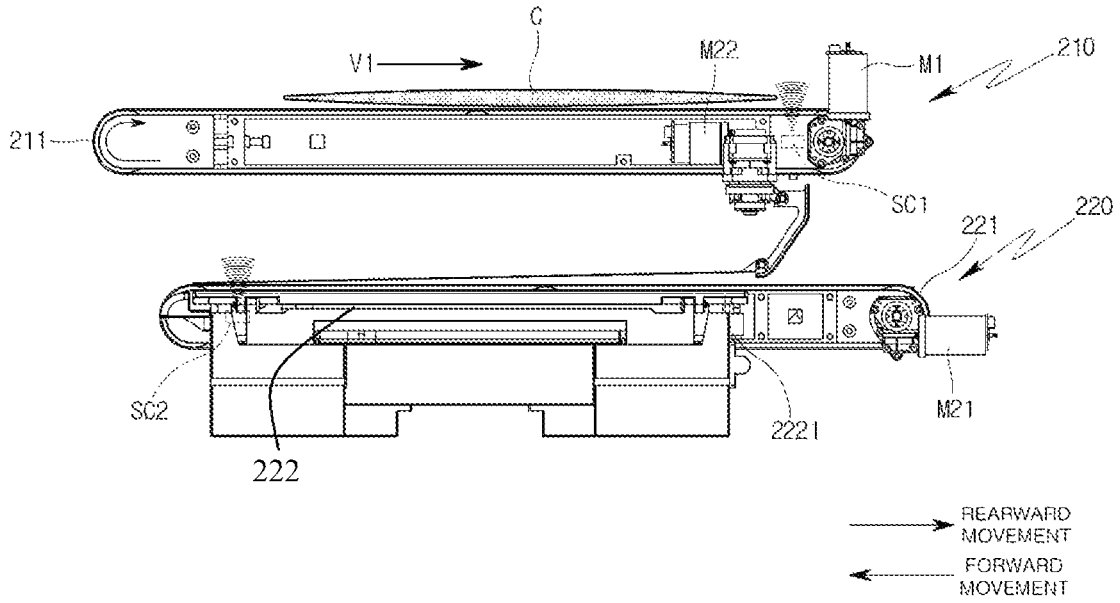
FIGS. 6, 7, and 8 are schematic views for explaining a process of conveying a garment from the first folding layer to a second folding layer after the garment is completely loaded by the loading unit.

FIGS. 4A to 4C are partially enlarged views for explaining of an operation of the loading unit 100 among the components illustrated in FIG. 2, and FIG. 6 is a schematic view for explaining a process of conveying the garment C by the first conveyor 211 in the first folding layer 210 after the garment C is completely loaded by the loading unit 100.

First, referring to FIGS. 4A to 4C, in a preparation procedure for loading the garment C through the loading part 101, the garment C can be held by a clip part 131 of the clip assembly 130 which is on standby at a first stop position.

A holding force of the clip part 131 can be generated by an electromagnetic driving member. Any means well known in the art, such as an electric motor or a solenoid, can be applied as the electromagnetic driving member.

The clip part 131 can be provided with a clip part sensor that automatically detects whether the garment C, which is an object to be held, reaches a holding position in the clip part 131. Therefore, when the clip part sensor detects that the garment C has reached the holding position, the electromagnetic driving member operates, and the clip part 131 is closed, such that the garment C can be automatically held.

In some implementations, a user may operate the electromagnetic driving member by loading the garment C to the holding position in the clip part 131 and then manipulating an input means such as an operation start button, or a touch screen.

When the process of holding the garment C is completed by closing the clip part 131 with the above-mentioned various methods, the operation of the loading unit motor ML can be initiated, and the clip assembly 130 can be moved to a second stop position disposed rearward from the first stop position and then stopped.

In some implementations, the loading unit motor ML is configured to be moved together with the clip assembly 130. For example, the loading unit motor ML is connected to a retraction member 132 of the clip assembly 130, and a pinion gear is provided on an output shaft of the loading unit motor ML.

In addition, a rack gear is mounted on a rail frame 152 fixed to the first horizontal frame 113, and the pinion gear meshes with the rack gear. Therefore, when the operation is initiated as the current is supplied to the unloading motor, the pinion gear rotates, such that the loading unit motor ML and the retraction member 132 rectilinearly move in a longitudinal direction of the rack gear.

However, the above-mentioned method of converting the motion using the pinion gear and the rack gear is provided for illustration only, and any means may be applied without limitation as long as this means may convert the rotational motion of the loading unit motor ML into the rectilinear reciprocating motions of the retraction member 132 and the clip part 131. Hereinafter, the motion conversion method using the pinion gear and the rack gear will be described below, for example.

FIG. 4B illustrates a state in which the clip assembly 130 has reached the second stop position. The second stop position is a position at which the clip part 131 is opened and the garment C is released. A clip open position detection sensor can be provided on the rail frame 152 and can detect whether the retraction member 132 and the clip part 131 have reached the second stop position.

When the clip open position detection sensor detects that the retraction member 132 and the clip part 131 have reached the second stop position, the supply of current to the loading unit motor ML can be cut off, and the clip part 131 is opened, such that the garment moved by the clip part 131 can be seated at the loading position on the first conveyor 211.

As illustrated in FIG. 4B, a conveying roller 151, which is provided as a means for supporting the garment C at the loading position, can be moved downward while being rotated counterclockwise by a roller link 153 at the same time when the retraction member 132 and the clip part 131 reach the second stop position and the clip part 131 is opened.

When the clip part 131 reaches the second stop position and the clip part 131 is opened, the garment C having a relatively long length has a portion that does not pass through the loading part 101, and the garment C deviates from the loading position by a weight of the garment C that does not pass through the loading part 101.

Therefore, the conveying roller 151 presses the garment C against the upper surface of the first conveyor 211 at the same time when the clip part 131 is opened, and as a result, it is possible to effectively prevent the garment C from deviating from the loading position.

In some implementations, in a case in which the garment C being conveyed as described above is an object, such as an upper garment, to be subjected to the primary vertical folding, the primary vertical folding can be performed, at the same time when the garment C is moved by the clip part 131, by the operations of the seating plate 140 and the primary vertical folding guide 141.

In some implementations, after the clip part 131 is opened, the current is supplied to the loading unit motor ML, such that the clip part 131 and the retraction member 132 are additionally retracted to a third stop position.

Like the clip open position detection sensor, a rear end position detection sensor SL3 can be provided on the rail frame 152 and can detect whether the retraction member 132 and the clip part 131 have reached the third stop position.

When the rear end position detection sensor SL3 detects that the retraction member 132 and the clip part 131 have reached the third stop position, the loading unit motor ML can be stopped, and at the same time, and the current can be supplied to the first conveyor motor M1, such that the operation of the first conveyor 211 is initiated.

In some implementations, after it is determined that the garment C is completely conveyed from the first conveyor 211 to the second conveyor 221, the loading unit motor ML can be controlled so that the retraction member 132 and the clip part 131 are moved to the first stop position so as not to interfere with the conveyance of the garment C by the first conveyor 211.

The initial position detection sensor SL1 is provided on the rail frame 152 and detects whether the retraction member 132 and the clip part 131 are returned to the first stop position.

The same type of sensor can be applied to the initial position detection sensor SL1, the clip open position detection sensor, and the rear end position detection sensor SL3. For example, the sensor may be a Hall sensor that detects a change in magnetic field generated during the process of moving the retraction member 132 and the clip part 131. However, the present disclosure is not limited thereto, and any means well known in the art may be applied without limitation as long as this means may detect the position of the retraction member 132 or the clip part 131 or detect whether the retraction member 132 or the clip part 131 has reached the position.

As described above, when the retraction member 132 and the clip part 131 reach the third stop position and the first conveyor motor M1 operates rearward, the conveyance of the garment C by the first conveyor 211 is initiated.

Figure 5:
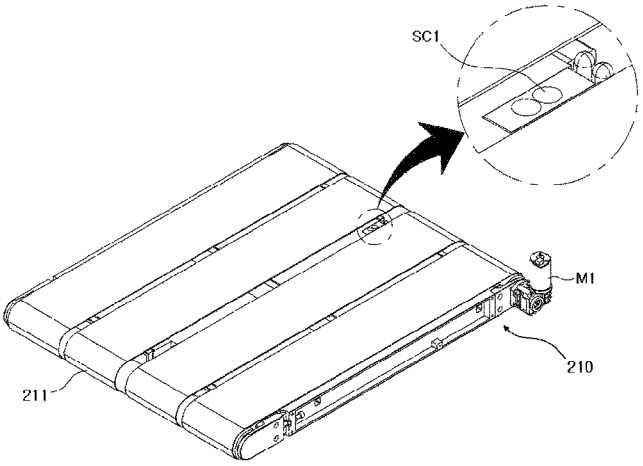
FIG. 5 is a perspective view of an exemplary garment detection sensor provided in a first folding layer among the components illustrated in FIG. 2.

As illustrated in FIG. 5, the first-conveyor-rear-end garment detection sensor SC1 can be provided at the rear end of the first conveyor 211 and can detect whether the garment C, which begins to be conveyed, reaches the rear end of the first conveyor 211.

For example, the first-conveyor-rear-end garment detection sensor SC1 is disposed in the first conveyor 211 and configured to detect whether the garment C reaches the first conveyor or whether the garment C passes through the first conveyor through a gap between a plurality of first conveyor belts which are separated from each other.

The first-conveyor-rear-end garment detection sensor SC1 can be configured to detect whether the garment C is present in an effective detection range. The first-conveyor-rear-end garment detection sensor SC1 can be a digital sensor that outputs an ON-signal when the garment C is present in the effective detection range, and outputs an OFF-signal when the garment C is not present in the effective detection range. In some implementations, a contactless IR (infrared ray) sensor can be applied, for example, but the present disclosure is not limited thereto.

Garment detection sensors, which perform the same function in the same way as the first-conveyor-rear-end garment detection sensor SC1, can be provided at a front end of the second conveyor 221, a rear end of the third conveyor 231, a rear end and a lower side of the fourth conveyor 232, a front end of the fifth conveyor 241, a rear end of the seventh conveyor 243, and a rear lower side and a front lower side of the sixth conveyor 242, respectively.

Hereinafter, for convenience, the IR sensor applied as the garment detection sensor will be described.

FIG. 6 illustrates a state in which the first conveyor motor M1 operates rearward and the first conveyor 211 conveys the garment C.

As illustrated in FIG. 6, when the garment C is conveyed by the movement of the first conveyor 211, a first-conveyor-rear-end garment detection sensor SC1 can detect whether a tip of the garment C reaches a rear end of the first conveyor 211.

When the first-conveyor-rear-end garment detection sensor SC1 detects that the tip of the garment C has reached the rear end of the first conveyor 211, the second conveyor motor M21 can operate forward at the same time to deliver the garment C to the second folding layer 220.

For example, in order to prevent the garment C from being wrinkled, a conveying speed of the second conveyor 221 can be higher than a conveying speed of the first conveyor 211. A difference in conveying speed between the first conveyor 211 and the second conveyor 221 will be described below in detail.

However, in a case in which the tip of the garment C does not reach the rear end of the first conveyor, that is, in a case in which the tip of the garment C does not reach the rear end of the first conveyor 211 or a motor current value supplied to the first conveyor motor M1 is excessively high (the first conveyor motor M1 is overloaded) even though a predetermined delay time elapses after the rearward operation of the first conveyor motor M1 is initiated, it may be determined by the first-conveyor-rear-end garment detection sensor SC1 that the lumping of the garment C has occurred.

For example, it may be determined that the lumping of the garment C has occurred in the first folding layer 210 when a first delay time T1 is equal to or larger than a predetermined first critical delay time Tth1 or a first motor current value A1 supplied to the first conveyor motor M1 is equal to or larger than a predetermined first critical motor current value Ath1 after the rearward operation of the first conveyor motor M1 is initiated in a state in which it is determined, based on the output signal from the first-conveyor-rear-end garment detection sensor SC1, that the tip of the garment C does not reach the rear end of the first conveyor 211 which is a target position.

As described above, when it is determined that the lumping of the garment C has occurred in the first folding layer 210, the supply of power to the first conveyor motor M1 is cut off to prevent an overload of the first conveyor motor M1 and prevent damage to the garment C and the components.

In some implementations, the first critical delay time Tth1 is a numerical value that can be adjusted depending on a size of the first conveyor 211, a linear velocity of the conveyor, and a size of the garment C which is an object to be conveyed. For example, because a maximum length of the garment C applicable to the garment folding machine 1 according to the present disclosure is about 3 m, the first critical delay time Tth1 can be set to about 10 seconds when the linear velocity of the first conveyor 211 is 30 cm/s.

In addition, the first critical motor current value Ath1 can vary depending on the output of the first conveyor motor M1 and can be set to about 2 A, for example.

In some implementations, when it is determined that the lumping of the garment C has occurred in the first folding layer 210 as described above, an alarm including first error information indicating that the lumping of the garment C has occurred in the first folding layer 210 is generated and transferred to the user through the display unit and the alarm unit.

Therefore, the user may accurately recognize a portion where the lumping of the garment C has occurred, and the user may take an immediate action for eliminating the garment lumping.

Figure 7:
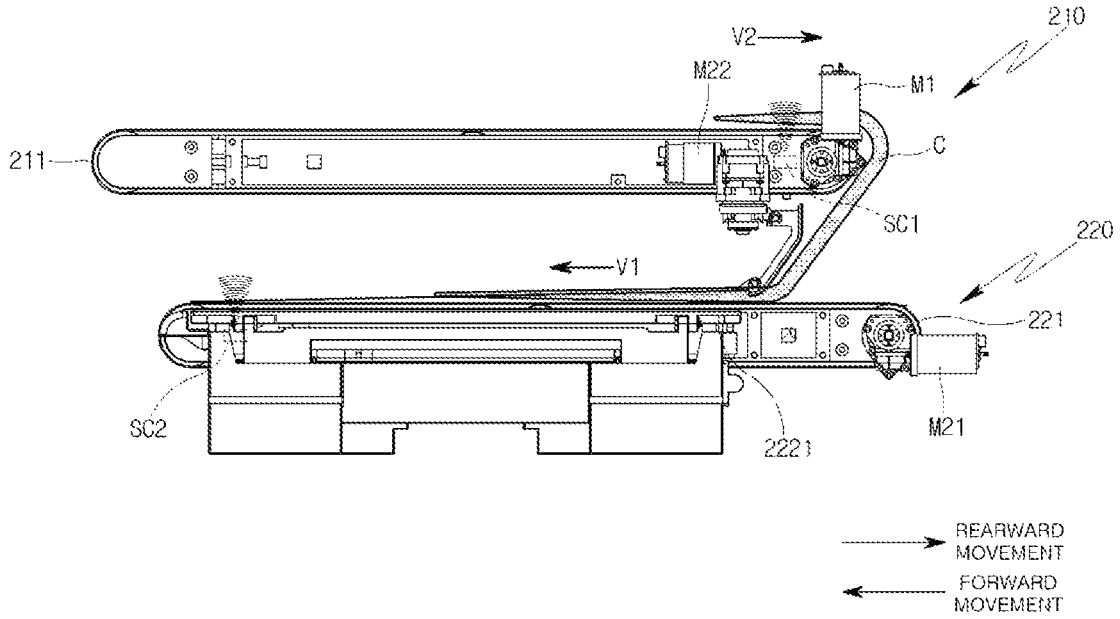
Figure 8:
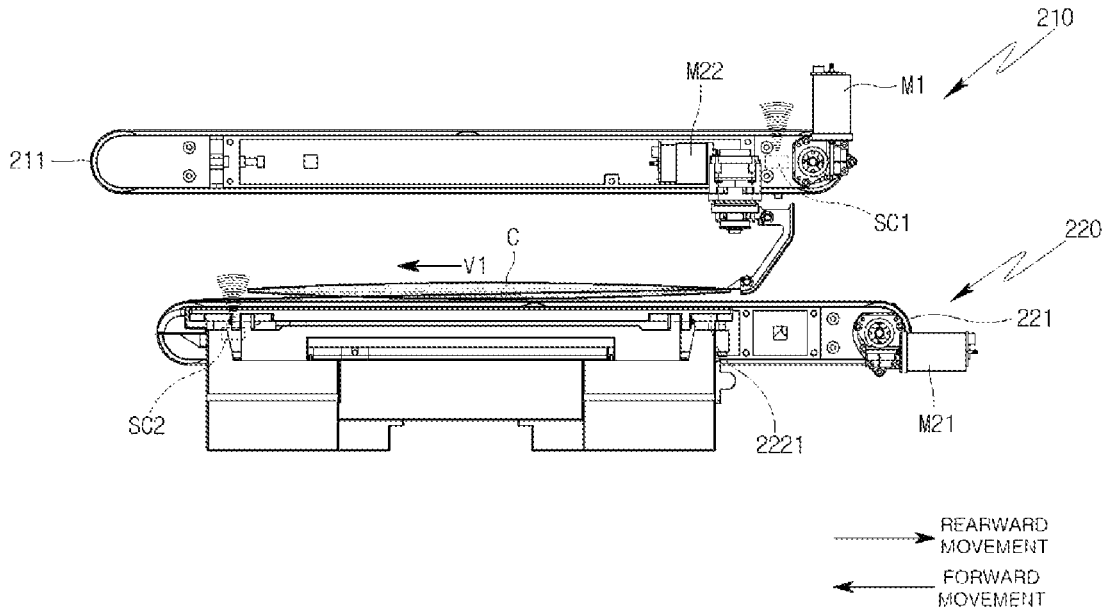

FIGS. 7 and 8 illustrate the process of delivering the garment C from the rear end of the first conveyor 211 to the rear end of the second conveyor 221 when it is determined that the tip of the garment C has reached the first-conveyor-rear-end garment detection sensor SC1.

The garment lumping determination criterion applied to the first folding layer 210 can also be similarly applied to the second conveyor 221 in the second folding layer 220.

As described above, when the first-conveyor-rear-end garment detection sensor SC1 detects that the garment C has successfully reached the rear end of the first conveyor 211, the forward operation of the second conveyor motor M21 can be initiated, such that the second conveyor 221 operates in a direction in which the garment C is moved forward.

In some implementations, a front end of the second conveyor 221 is a target position at which whether the garment C is successfully conveyed from the first conveyor 211 to the second conveyor 221 is determined. To this end, the second conveyor 221 is provided with a second-conveyor-front-end garment detection sensor SC2 that detects whether the tip of the garment C has reached the corresponding target position. Like the first-conveyor-rear-end garment detection sensor SC1, the second-conveyor-front-end garment detection sensor SC2 can be an IR sensor.

The second-conveyor-front-end garment detection sensor SC2 can detect whether the tip of the garment C has reached the front end of the second conveyor in the second folding layer 220. In the case in which whether the garment C reaches the front end of the second conveyor is not detected by the second-conveyor-front-end garment detection sensor SC2, it can be determined that the lumping of the garment C has occurred when the tip of the garment C does not reach the front end of the second conveyor 221 or the motor current value supplied to the second conveyor motor M21 is excessively large even though a predetermined delay time elapses after the forward operation of the second conveyor motor M21 is initiated.

For example, it may be determined that the lumping of the garment C has occurred on the second conveyor 221 in the second folding layer 220 when a second delay time T2 is equal to or larger than a predetermined second critical delay time Tth2 or a second motor current value A2 supplied to the second conveyor motor M21 is equal to or larger than a predetermined second critical motor current value Ath2 after the forward operation of the second conveyor motor M21 is initiated in a state in which it is determined, based on the output signal from the second-conveyor-front-end garment detection sensor SC2, that the tip of the garment C does not reach the front end of the second conveyor 221 which is a target position.

As described above, when it is determined that the lumping of the garment C has occurred on the second conveyor 221, the supply of power to the first conveyor motor M1 and the second conveyor motor M21 is cut off to prevent overloads of the first conveyor motor M1 and the second conveyor motor M21 and prevent damage to the garment C and the components.

In some implementations, like the first critical delay time Tth1, the second critical delay time Tth2 can be set to about 10 seconds because the garment C is not horizontally folded and the length of the garment C is maintained constantly.

In addition, like the first critical motor current value Ath1, the second critical motor current value Ath2 may be set to about 2 A when the second conveyor motor M21 has the same output as the first conveyor motor M1. The second critical motor current value Ath2 may be set to be different from the first critical motor current value Ath1 when the second conveyor motor M21 is a motor having an output different from the output of the first conveyor motor M1.

In addition, when it is determined that the lumping of the garment C has occurred in the second folding layer 220 as described above, an alarm including second error information indicating that the lumping of the garment C has occurred in the second folding layer 220 is generated and transferred to the user through the display unit and the alarm unit.

In some implementations, when the second-conveyor-front-end garment detection sensor SC2 detects that the garment C has successfully reached the front end of the second conveyor 221, the next process is determined depending on whether the garment C needs to be subjected to the vertical folding.

If the garment C is set in advance as an object such as an upper garment to be subjected to the vertical folding, the second conveyor motor M21 is stopped immediately when the tip of the garment C reaches the front end of the second conveyor 221, and the vertical folding assembly 222 operates to perform the vertical folding on the garment C.

For example, the current is supplied to the vertical folding motor M22, and the vertical folding motor M22 operates.

The pair of vertical folding plates 2221 is moved, by the operation of the vertical folding motor M22, from the standby position toward a center of the garment C by a movement amount corresponding to a vertical folding width set in advance to the garment C to be vertically folded.

When the vertical folding is completely performed on the garment C by the movement of the vertical folding plate 2221, the vertical folding motor M22 can operate in a reverse direction to return the vertical folding plates 2221 to the standby position.

Next, when it is determined that the vertical folding plates 2221 has been returned to the standby position, the second conveyor motor M21 operates forward to convey the garment C to the third folding layer 230, and at the same time, the third conveyor motor M31 of the third folding layer 230 for receiving the garment C operates rearward.

In some implementations, if the garment C is not set in advance as an object such as an upper garment to be subjected to the vertical folding, the process of vertically folding the garment C is omitted, the second conveyor motor M21 continuously operates forward without being stopped, and the third conveyor motor M31 of the third folding layer 230 for receiving the garment C operates rearward.

Figure 9:
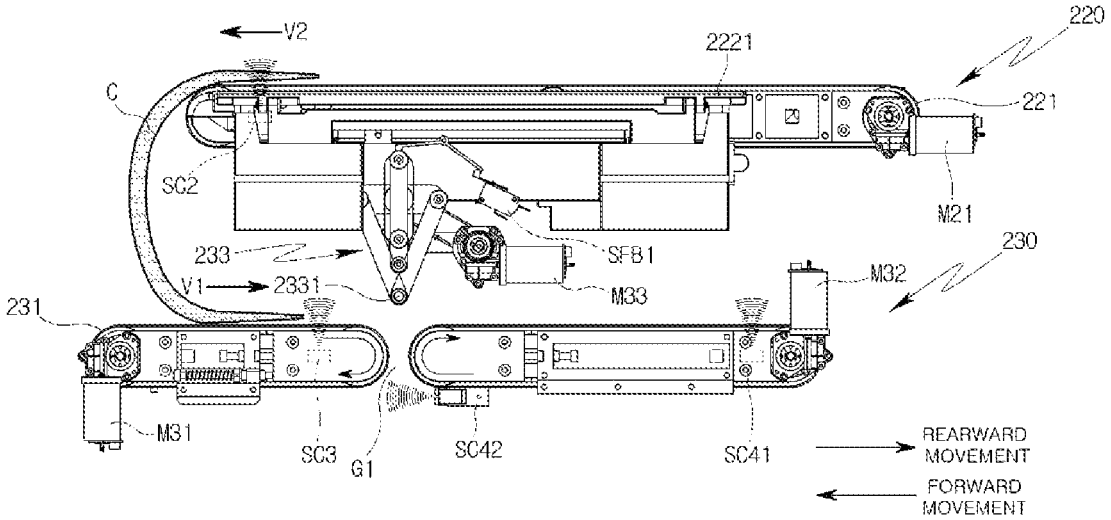
FIGS. 9, 10, and 11 are schematic views for explaining a process of conveying the garment from the second folding layer to a third folding layer and a process of performing horizontal folding in the third folding layer.
Figure 10:
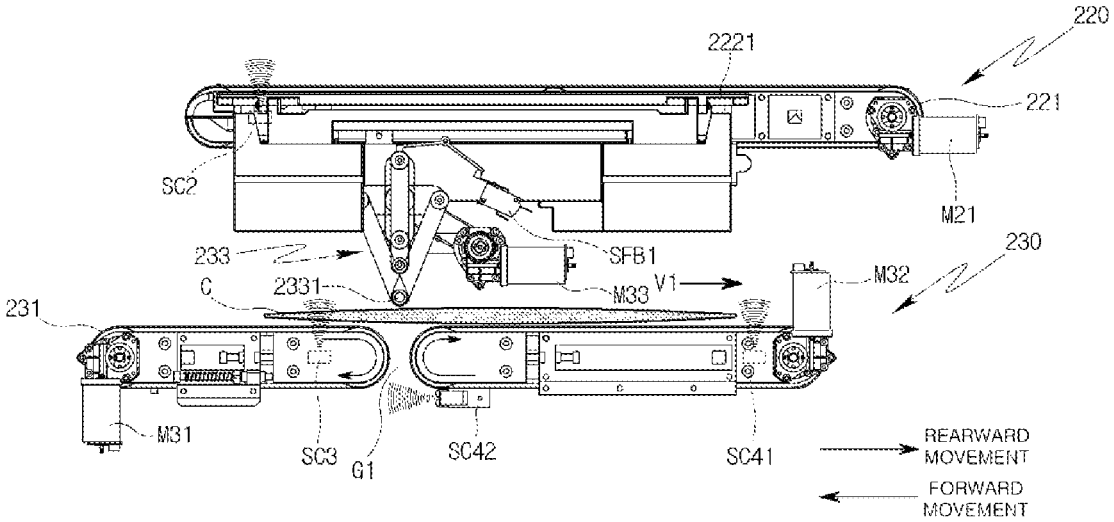
Figure 11:
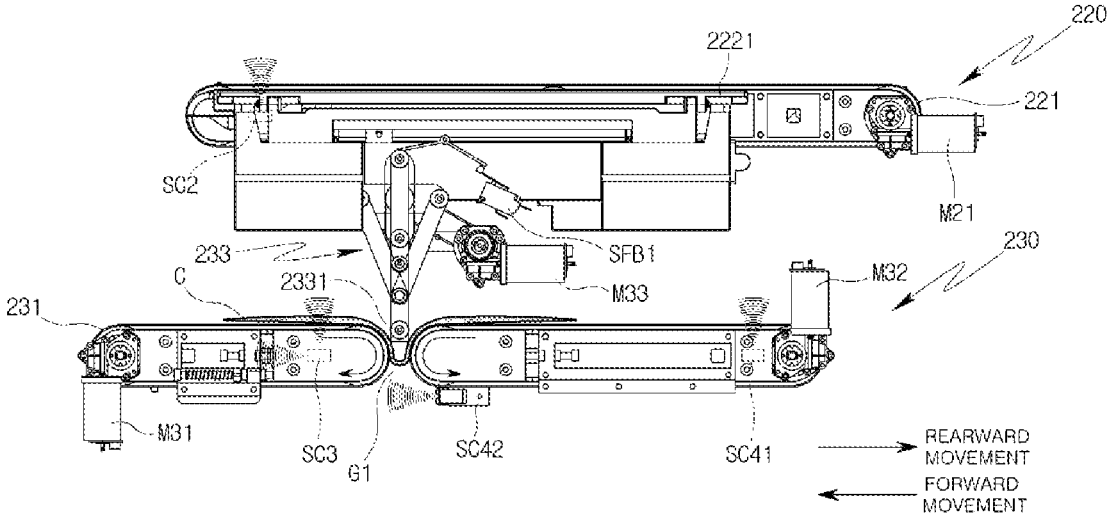
Figure 12:
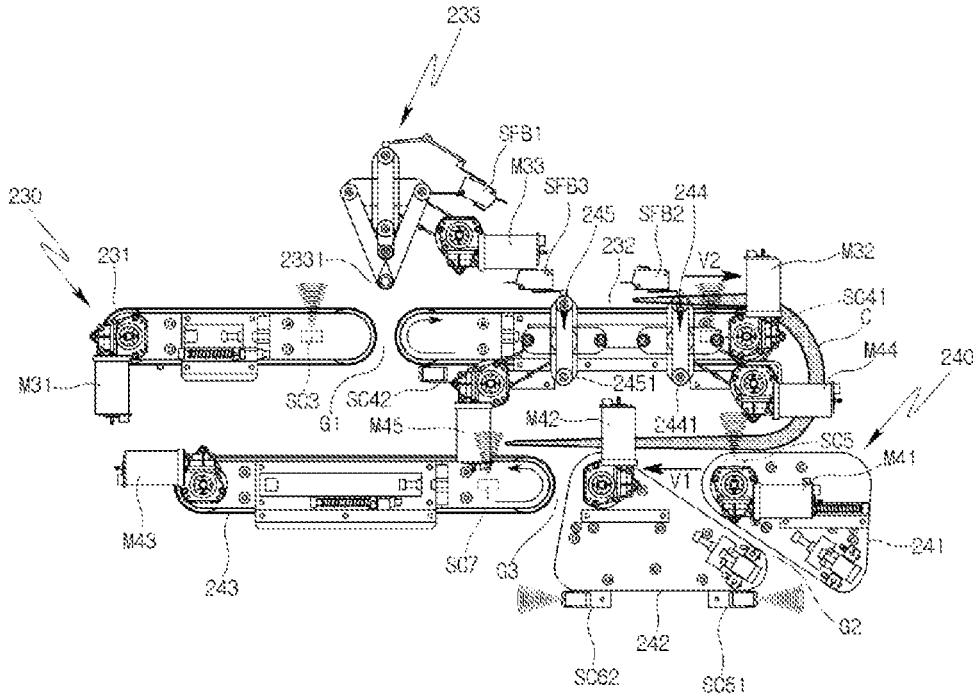
FIGS. 12, 13, 14, and 15 are schematic views for explaining a process of conveying the garment from the third folding layer to a fourth folding layer and a process of performing horizontal folding in the fourth folding layer.

FIGS. 9 to 11 illustrate a process of delivering the garment C from the front end of the second conveyor 221 to the third folding layer 230 and a process of performing ½ horizontal folding on the delivered garment C.

The garment lumping determination criterion, which is applied to the first folding layer 210 and the second folding layer 220, can also be similarly applied to the process of delivering the garment C to the third folding layer 230 and the ½ horizontal folding process.

A front end of the third conveyor 231 disposed at an upper side of the third folding layer 230 is a target position at which whether the garment C is successfully conveyed from the second conveyor 221 in the second folding layer 220 to the third folding layer 230 is determined.

To this end, a third-conveyor-rear-end garment detection sensor SC3 can be provided on the third conveyor 231 and can detect whether the tip of the garment C has reached the corresponding target position. Like the above-mentioned garment detection sensors, the third-conveyor-rear-end garment detection sensor SC3 can be an IR sensor.

The third-conveyor-rear-end garment detection sensor SC3 detects that the tip of the garment C has reached the rear end of the third conveyor in the third folding layer 230. In the case in which whether the garment C reaches the rear end of the third conveyor is not detected by the third-conveyor-rear-end garment detection sensor SC3, it can be determined that the lumping of the garment C has occurred when the tip of the garment C does not reach the rear end of the third conveyor 231 or the motor current value supplied to the third conveyor motor M31 is excessively large even though a predetermined delay time elapses after the rearward operation of the third conveyor motor M31 is initiated.

For example, it may be determined that the lumping of the garment C has occurred on the third conveyor 231 in the third folding layer 230 when a third delay time T3 is equal to or larger than a predetermined third critical delay time Tth3 or a third motor current value A3 supplied to the third conveyor motor M31 is equal to or larger than a predetermined third critical motor current value Ath3 after the rearward operation of the third conveyor motor M31 is initiated in a state in which it is determined, based on the output signal from the third-conveyor-rear-end garment detection sensor SC3, that the tip of the garment C does not reach the rear end of the third conveyor 231 which is a target position.

As described above, when it is determined that the lumping of the garment C has occurred on the third conveyor 231, the supply of power to the third conveyor motor M31 can be cut off to prevent an overload of the third conveyor motor M31 and prevent damage to the garment C and the components.

In some implementations, like the first critical delay time Tth1 and the second critical delay time Tth2, the third critical delay time Tth3 may be set to about 10 seconds because the garment C is not horizontally folded and the length of the garment C is maintained constantly.

In addition, like the first critical motor current value Ath1 and the second critical motor current value Ath2, the third critical motor current value Ath3 may be set to about 2 A when the third conveyor motor M31 has the same output as the first conveyor motor M1 and the second conveyor motor M21. The third critical motor current value Ath3 may be set to be different from the first critical motor current value Ath1 and the second critical motor current value Ath2 when the third conveyor motor M31 is a motor having an output different from the output of the first conveyor motor M1 and the output of the second conveyor motor M21.

In addition, when it is determined that the lumping of the garment C has occurred on the third conveyor 231 in the third folding layer 230 as described above, an alarm including third error information indicating that the lumping of the garment C has occurred in the third conveyor 231 is generated and transferred to the user through the display unit and the alarm unit.

In some implementations, when the third-conveyor-rear-end garment detection sensor SC3 detects that the garment C has successfully reached the rear end of the third conveyor 231, the next process is determined depending on whether the garment C needs to be subjected to the ½ horizontal folding.

If the garment C is not set in advance as an object to be subjected to the ½ horizontal folding, the fourth conveyor motor M32 is immediately operated rearward to deliver the garment C to the fourth folding layer 240 via the rear end of the fourth conveyor 232. The process to be performed after the garment C is delivered to the fourth folding layer 240 without being subjected to the ½ horizontal folding process will be described below with reference to FIGS. 12 to 15.

If the garment C is set in advance as an object to be subjected to the ½ horizontal folding, the fourth conveyor motor M32 can be operated rearward immediately when the tip of the garment C reaches the front end of the third conveyor 231.

Thereafter, when the third-conveyor-rear-end garment detection sensor SC3 detects that the rear end of the garment C has passed through the rear end of the third conveyor 231, the third conveyor motor M31 and the fourth conveyor motor M32 are stopped, and a garment passage time Tc from a point in time at which the tip of the garment C reaches the rear end of the third conveyor 231 to a point in time at which the rear end of the garment C passes through the rear end of the third conveyor 231 is calculated by a timer 440.

Next, in order to prepare the ½ horizontal folding, the third conveyor motor M31 and the fourth conveyor motor M32 are operated forward for the time Tc/2 half the calculated garment passage time Tc, such that a ½ portion of the garment C is disposed in the longitudinal direction above a first folding gap G1 defined between the third conveyor 231 and the fourth conveyor 232.

When the preparation of the ½ horizontal folding for the garment C is completed, the first horizontal folding assembly 233 disposed above the third conveyor 231 and the fourth conveyor 232 can be operated.

For example, the first horizontal folding assembly 233 can operate in such a way as to push the ½ portion of the garment C at least partially into the first folding gap G1 using a first folding bar 2331 that reciprocates in the upward/downward direction. The first horizontal folding assembly 233 can include a first-folding-bar driving motor M33 configured to operate the first folding bar 2331, a crank member configured to convert a rotational motion of the first-folding-bar driving motor M33 into a rectilinear reciprocating motion, and a first-folding-bar position sensor SFB1 configured to directly or indirectly detect a position of the second folding bar 2441.

For example, the first horizontal folding assembly 233 can include the first folding bar 2331, the first-folding-bar driving motor M33, and the crank member will be described, but the present disclosure is not limited thereto.

In some implementations, a second horizontal folding assembly 244 and a third horizontal folding assembly 245, which will be described below, have the same structure and operate in the same manner as the first horizontal folding assembly 233.

As illustrated in FIG. 11, when the first-folding-bar driving motor M33 operates, the first folding bar 2331 rectilinearly moves downward from an initial position toward the first folding gap G1, pushes the ½ portion of the garment C at least partially into the first folding gap G1, and then returns back to the initial position by the operation of the crank member.

The first folding bar position sensor SFB1 detects whether the first folding bar 2331 begins to move from the initial position and then returns back to the initial position. FIG. 11 illustrates that the first folding bar position sensor SFB1 is provided in the form of a micro switch, but the present disclosure is not limited thereto. Any means well known in the art may be applied without limitation as long as this means may detect the position of the first folding bar 2331. For convenience, the first folding bar position sensor SFB1 provided in the form of a micro switch will be described below, and both a second folding bar position sensor SFB2 and a third folding bar position sensor SFB3 will be described below with reference to the embodiment in which the micro switch is applied.

When the first folding bar position sensor SFB1 detects that the operation of the first folding bar 2331 is completed, the third conveyor motor M31 operates rearward and the fourth conveyor motor M32 operates forward so that the garment C can pass through the first folding gap G1 while being subjected to the ½ horizontal folding.

In some implementations, because there is a likelihood that the garment lumping occurs while the garment C passes through the first folding gap G1, the garment lumping determination criterion can be similarly applied.

For example, a lower side of a third folding gap G3 is a target position at which whether the garment successfully passes through the first folding gap G1 and is conveyed to the fourth folding layer 240 is determined. To this end, a fourth-conveyor-lower-part garment detection sensor SC4 can be provided at the lower side of the fourth conveyor 232 and disposed at a position adjacent to the first folding gap G1.

Like the garment detection sensors, the fourth-conveyor-lower-part garment detection sensor SC4 can be an IR sensor. However, since the fourth-conveyor-lower-part garment detection sensor SC42 performs a function of detecting whether the garment C passes through the first folding gap G1, the fourth-conveyor-lower-part garment detection sensor SC4 can be disposed at a position exposed from the fourth conveyor 232, unlike the garment detection sensors.

The fourth-conveyor-lower-part garment detection sensor SC42 can detect whether the rear end of the garment C passes through the first folding gap G1 after the tip of the garment C reaches the first folding gap G1. It may be determined that the lumping of the garment C has occurred when the passage of the garment C is not detected in a case in which the rear end of the garment C does not pass through the first folding gap G1 or a motor current value supplied to the third conveyor motor M31 or the fourth conveyor 232 is excessively large even though a predetermined delay time elapses after the rearward operation of the third conveyor motor M31 and the forward operation of the fourth conveyor motor M32 are initiated.

For example, it may be determined that the lumping of the garment C has occurred in the first folding gap G1 in the third folding layer 230 when a fourth delay time T4 is equal to or larger than a predetermined fourth critical delay time Tth4 or a fourth motor current value A4 supplied to the third conveyor motor M31 and the fourth conveyor motor M32 is equal to or larger than a predetermined fourth critical motor current value Ath4 after the rearward operation of the third conveyor motor M31 and the forward operation of the fourth conveyor motor M32 are initiated in a state in which it is determined, based on the output signal from the fourth-conveyor-lower-part garment detection sensor SC42, that the rear end of the garment C does not pass through the lower side of the first folding gap G1 and the lower side of the fourth conveyor 232, which are target positions.

As described above, when it is determined that the lumping of the garment C has occurred in the first folding gap G1, the supply of power to the third conveyor motor M31 and the fourth conveyor motor M32 is cut off to prevent overloads of the third conveyor motor M31 and the fourth conveyor motor M32 and prevent damage to the garment C and the components.

In some implementations, the fourth critical delay time Tth4 may be smaller than the third critical delay time Tth3, and particularly set to about 5 seconds which is half the third critical delay time Tth3 because the garment C is subjected to the ½ horizontal folding.

In addition, like the first critical motor current value Ath1 and the second critical motor current value Ath2, the fourth critical motor current value Ath4 may be set to about 2 A when the third conveyor motor M31 and the fourth conveyor motor M32 have the same output as the first conveyor motor M1 and the second conveyor motor M21. The fourth critical motor current value Ath4 may be set to be different from the first critical motor current value Ath1 and the second critical motor current value Ath2 when the third conveyor motor M31 and the fourth conveyor motor M32 are motors having outputs different from the outputs of the first conveyor motor M1 and the second conveyor motor M21.

In addition, when it is determined that the lumping of the garment C has occurred in the first folding gap G1 as described above, an alarm including fourth error information indicating that the lumping of the garment C has occurred in the first folding gap G1 is generated and transferred to the user through the display unit and the alarm unit.

In some implementations, when the fourth-conveyor-lower-part garment detection sensor SC42 detects that the rear end of the garment C successfully passes through the first folding gap G1 after the tip of the garment C reaches the first folding gap G1, the third conveyor motor M31 and the fourth conveyor motor M32 can be stopped, and the conveying and folding processes in the third folding layer 230 can be ended.

FIGS. 12 to 15 illustrate a process of delivering the garment to the fourth folding layer 240 and a process of performing ⅓ horizontal folding in the fourth folding layer 240 without performing the ½ horizontal folding process in the third folding layer 230.

In both a case in which the ½ horizontal folding is performed in the third folding layer 230 and a case in which the ½ horizontal folding is not performed in the third folding layer 230, the ½ horizontal folding may be performed in the same or similar manner as that in the third folding layer 230 or the ⅓ horizontal folding may be performed twice on the garment C delivered to the fourth folding layer 240.

Therefore, the process of performing the ½ horizontal folding and the process of performing the ⅓ horizontal folding twice on the garment C that has not be subjected to the ½ horizontal folding in the third folding layer 230 will be described below with reference to FIGS. 12 to 15, and descriptions of other repetitive processes will be omitted.

The garment lumping determination criterion, which is applied to the first to third folding layers 210, 220, and 230, may be similarly applied to the process of delivering the garment C from the third folding layer 230 to the fourth folding layer 240 and the ⅓ horizontal folding process.

The garment C conveyed from the rear end of the fourth conveyor 232 in the third folding layer 230 is delivered first to the fifth conveyor 241 disposed at a rearmost side among the plurality of conveyors in the fourth folding layer 240, and delivered to the seventh conveyor 243 disposed to be spaced apart from the sixth conveyor 242 while defining a third folding gap G3, via the sixth conveyor 242 disposed to be spaced apart from the fifth conveyor 241 while defining a second folding gap G2.

Therefore, a rear end of the seventh conveyor 243 disposed at a front side of the fourth folding layer 240 is a target position at which whether the garment C is successfully conveyed to the fourth folding layer 240 is determined.

To this end, a seventh-conveyor-rear-end garment detection sensor SC7 is provided on the seventh conveyor 243 and detects whether the tip of the garment C has reached the corresponding target position. Like the above-mentioned garment detection sensors, the seventh-conveyor-rear-end garment detection sensor SC7 can be an IR sensor.

The seventh-conveyor-rear-end garment detection sensor SC7 can detect whether the tip of the garment C has reached the rear end of the seventh conveyor in the fourth folding layer 240. In the case in which whether the garment C reaches the rear end of the seventh conveyor is not detected by the seventh-conveyor-rear-end garment detection sensor SC7, it may be determined that the lumping of the garment C has occurred when the tip of the garment C does not reach the rear end of the seventh conveyor 243 or the motor current value supplied to the fifth conveyor motor M41, the sixth conveyor motor M42, and the seventh conveyor motor M43 is excessively large even though a predetermined delay time elapses after the forward operations of the fifth conveyor motor M41, the sixth conveyor motor M42, and the seventh conveyor motor M43 are initiated to convey the garment C.

For example, it may be determined that the lumping of the garment C has occurred in the fourth folding layer 240 when a fifth delay time T5 is equal to or larger than a predetermined fifth critical delay time Tth5 or a fifth motor current value A5 applied to the fifth conveyor motor M41, the sixth conveyor motor M42, and the seventh conveyor motor M43 is equal to or larger than a predetermined fifth critical motor current value Ath5 after the forward operations of the fifth conveyor motor M41, the sixth conveyor motor M42, and the seventh conveyor motor M43 are initiated in a state in which it is determined, based on the output signal from the seventh-conveyor-rear-end garment detection sensor SC7, that the tip of the garment C does not reach the rear end of the seventh conveyor 243 which is a target position.

As described above, when it is determined that the lumping of the garment C has occurred in the fourth folding layer 240, the supply of power to the fifth conveyor motor M41, the sixth conveyor motor M42, and the seventh conveyor motor M43 is cut off to prevent overloads of the fifth conveyor motor M41, the sixth conveyor motor M42, and the seventh conveyor motor M43 and prevent damage to the garment C and the components.

In some implementations, like the first critical delay time Tth1 and the second critical delay time Tth2, the fifth critical delay time Tth5 may be set to about 10 seconds because the garment C is not horizontally folded and the length of the garment C is maintained constantly.

In addition, like the first to fourth critical motor current values Ath1, Ath2, Ath3, and Ath4, the fifth critical motor current value Ath5 may be set to about 2 A when the fifth conveyor motor M41, the sixth conveyor motor M42, and the seventh conveyor motor M43 have the same output as the first to fourth conveyor motors M1, M21, M31, and M41. The fifth critical motor current value Ath5 may be set to be different from the first to fourth critical motor current values Ath1, Ath2, Ath3, and Ath4 when the fifth conveyor motor M41, the sixth conveyor motor M42, and the seventh conveyor motor M43 are motors having the output different from the output of the first to fourth conveyor motors M1, M21, M31, and M41.

In addition, when it is determined that the lumping of the garment C has occurred in the fourth folding layer 240 as described above, an alarm including fifth error information indicating that the lumping of the garment C has occurred in the fourth folding layer 240 is generated and transferred to the user through the display unit and the alarm unit.

In some implementations, when it is determined, based on the output signal from the seventh-conveyor-rear-end garment detection sensor SC7, that the tip of the garment C has reached the rear end of the seventh conveyor 243 which is a target position, the fifth conveyor motor M41, the sixth conveyor motor M42, and the seventh conveyor motor M43 can be additionally operated until the rear end of the garment C reaches the rear end of the seventh conveyor 243.

Thereafter, when the seventh-conveyor-rear-end garment detection sensor SC7 detects that the rear end of the garment C has passed through the rear end of the seventh conveyor 243, the fifth conveyor motor M41, the sixth conveyor motor M42, and the seventh conveyor motor M43 are stopped, and the garment passage time Tc from the point in time at which the tip of the garment C reaches the rear end of the seventh conveyor 243 to the point in time at which the rear end of the garment C passes through the rear end of the seventh conveyor 243 is calculated by the timer 440.

When the passage time Tc is calculated, the next process is determined depending on whether the garment C is subjected to the ½ horizontal folding or the ⅓ horizontal folding.

First, when the garment C is subjected to the ½ horizontal folding, the ½ horizontal folding process is performed using the third folding gap G3 provided between the sixth conveyor 242 and the seventh conveyor 243.

For example, in order to prepare the ½ horizontal folding, the fifth conveyor motor M41, the sixth conveyor motor M42, and the seventh conveyor motor M43 are operated rearward for the time Tc/2 half the calculated garment passage time Tc, such that the ½ portion of the garment C is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 can be stopped.

When the preparation of the ½ horizontal folding for the garment C is completed, the third horizontal folding assembly 245 disposed above the sixth conveyor 242 and the seventh conveyor 243 can be operated.

As described above, the third horizontal folding assembly 245 has the same structure and operates in the same manner as the first horizontal folding assembly 233.

Figure 13:
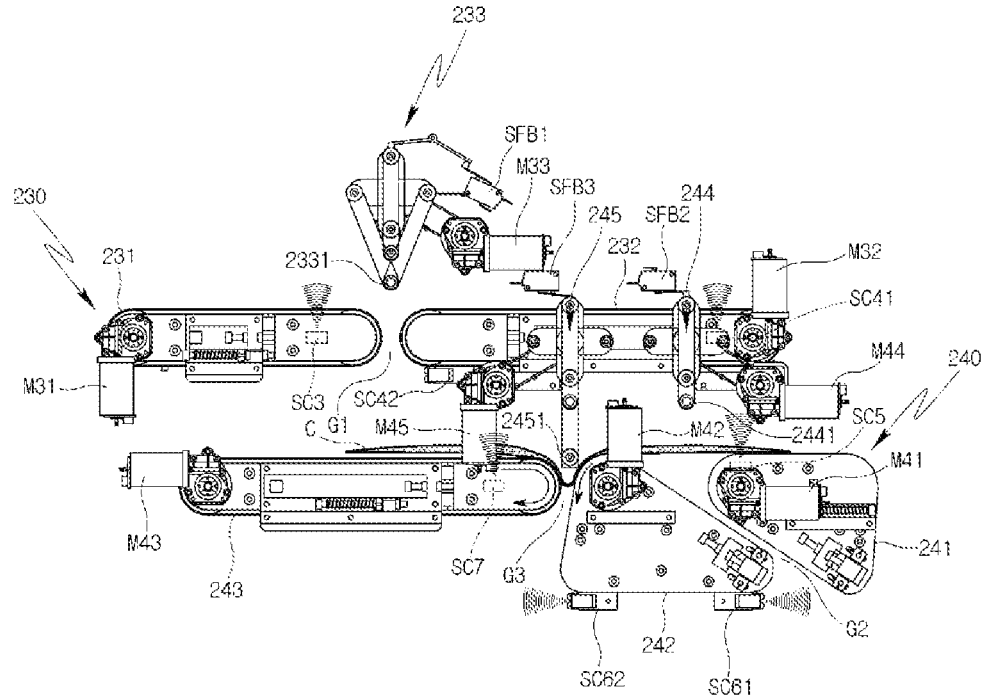

For example, as illustrated in FIG. 13, when a third folding bar driving motor M45 operates, a third folding bar 2451 rectilinearly can move downward from an initial position toward the third folding gap G3, pushes the ½ portion of the garment C at least partially into the third folding gap G3, and then returns back to the initial position by the operation of a crank member.

A third folding bar position sensor SFB3, which is a micro switch, can detect whether the third folding bar 2451 begins to move from the initial position and returns back to the initial position.

When the third folding bar position sensor SFB3 detects that the operation of the third folding bar 2451 is completed, the seventh conveyor motor M43 operates rearward and the fifth conveyor motor M41 and the sixth conveyor motor M42 operate forward so that the garment C can pass through the third folding gap G3 while being subjected to the ½ horizontal folding. The garment C on which the ½ horizontal folding is completely performed can be delivered to the unloading layer 310 disposed below the third folding gap G3.

In some implementations, because there is a likelihood that the garment lumping occurs while the garment C passes through the third folding gap G3, the garment lumping determination criterion may be similarly applied.

For example, the lower side of the third folding gap G3 is a target position at which whether the garment successfully passes through the third folding gap G3 and is conveyed to the unloading layer 310. To this end, a sixth-conveyor-front-lower-part garment detection sensor SC62 is provided at a front lower side of the sixth conveyor 242 and disposed at a position adjacent to the third folding gap G3.

Like the garment detection sensors, the sixth-conveyor-front-lower-part garment detection sensor SC62 can be an IR sensor. However, since the sixth-conveyor-front-lower-part garment detection sensor SC62 performs a function of detecting whether the garment C passes through the third folding gap G3, the sixth-conveyor-front-lower-part garment detection sensor SC62 is disposed at a position exposed from the sixth conveyor 242, like the fourth-conveyor-lower-part garment detection sensor SC42.

The sixth-conveyor-front-lower-part garment detection sensor SC62 can detect whether the rear end of the garment C passes through the third folding gap G3 after the tip of the garment C reaches the third folding gap G3. It may be determined that the lumping of the garment C has occurred when the passage of the garment C is not detected in a case in which the rear end of the garment C does not pass through the third folding gap G3 or a motor current value supplied to the fifth to seventh conveyors motor M41, M42, and M43 is excessively large even though a predetermined delay time elapses after the seventh conveyor motor M43 operates rearward and the fifth conveyor motor M41 and the sixth conveyor motor M42 operate forward.

For example, it may be determined that the lumping of the garment C has occurred in the third folding gap G3 in the fourth folding layer 240 when a sixth delay time T6 is equal to or larger than a predetermined sixth critical delay time Tth6 or a sixth motor current value A6 supplied to the fifth to seventh conveyor motors M41, M42, and M43 is equal to or larger than a predetermined sixth critical motor current value Ath6 after the rearward operation of the seventh conveyor motor M43 and the forward operations of the fifth conveyor motor M41 and the sixth conveyor motor M42 are initiated in a state in which it is determined, based on the output signal of the sixth-conveyor-front-lower-part garment detection sensor SC62, that the rear end of the garment C does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 can be cut off to prevent overloads of the fifth to seventh conveyor motors M41, M42, and M43 and prevent damage to the garment C and the components.

In some implementations, the sixth critical delay time Tth6 may be smaller than the fifth critical delay time Tth5, and particularly set to about 5 seconds which is half the fifth critical delay time Tth5 because the garment C is subjected to the ½ horizontal folding.

In addition, like the above-mentioned critical motor current values, the sixth critical motor current value Ath6 may be set to about 2 A when the fifth to seventh conveyor motors M41, M42, and M43 have the same output as the other conveyor motors. The sixth critical motor current value Ath6 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including sixth error information indicating that the lumping of the garment C has occurred in the first folding layer 210 is generated and transferred to the user through the display unit and the alarm unit.

In some implementations, when the sixth-conveyor-front-lower-part garment detection sensor SC62 detects that the rear end of the garment C successfully passes through the third folding gap G3 after the tip of the garment C reaches the third folding gap G3, the fifth to seventh conveyor motors M41, M42, and M43 can be stopped, and the conveying and folding processes in the fourth folding layer 240 can be ended.

Next, when the garment C is subjected to the ⅓ horizontal folding, primary ⅓ horizontal folding is performed using the second folding gap G2 provided between the fifth conveyor 241 and the sixth conveyor 242, and secondary ⅓ horizontal folding process is performed using the third folding gap G3 provided between the sixth conveyor 242 and the seventh conveyor 243.

For example, in order to prepare the primary ⅓ horizontal folding, the fifth conveyor motor M41, the sixth conveyor motor M42, and the seventh conveyor motor M43 are operated rearward for the time (Tc*⅔) which is ⅔ of the garment passage time Tc, such that a ⅔ portion of the garment C is disposed in the longitudinal direction above the second folding gap G2 provided between the fifth conveyor 241 and the sixth conveyor 242, and the fifth conveyor motor M41, the sixth conveyor motor M42, and the seventh conveyor motor M43 are stopped.

When the preparation of the primary ⅓ horizontal folding for the garment C is completed, a second horizontal folding assembly 244 disposed above the fifth conveyor 241 and the sixth conveyor 242 can be operated.

As described above, the second horizontal folding assembly 244 has the same structure and operates in the same manner as the first horizontal folding assembly 233.

Figure 14:
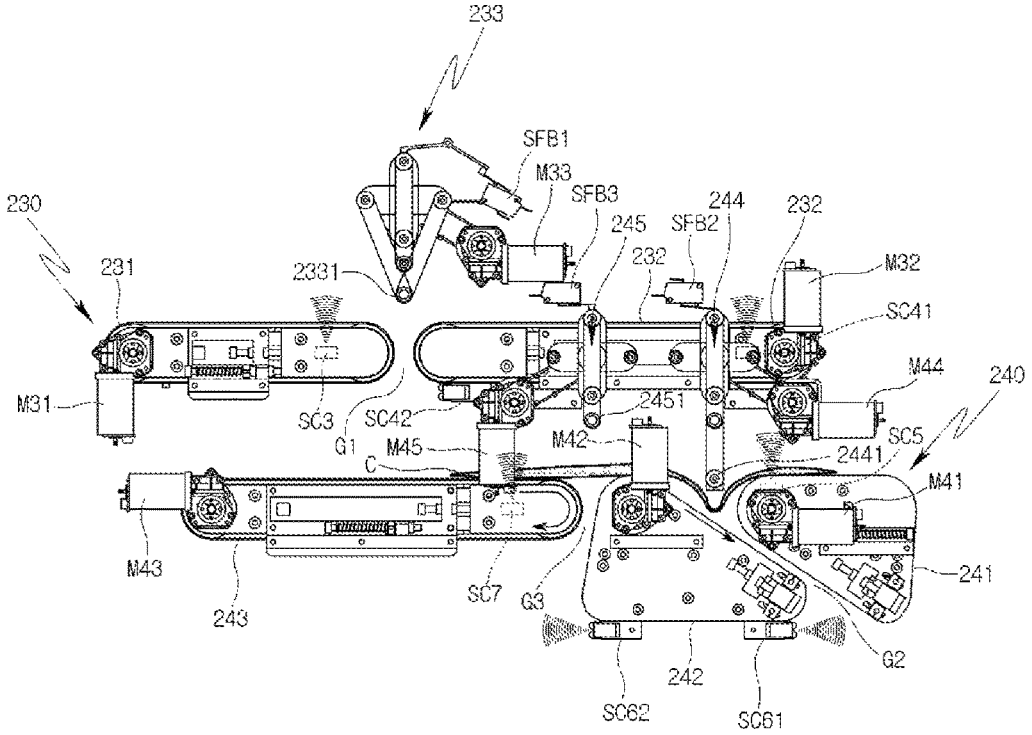
Figure 15:
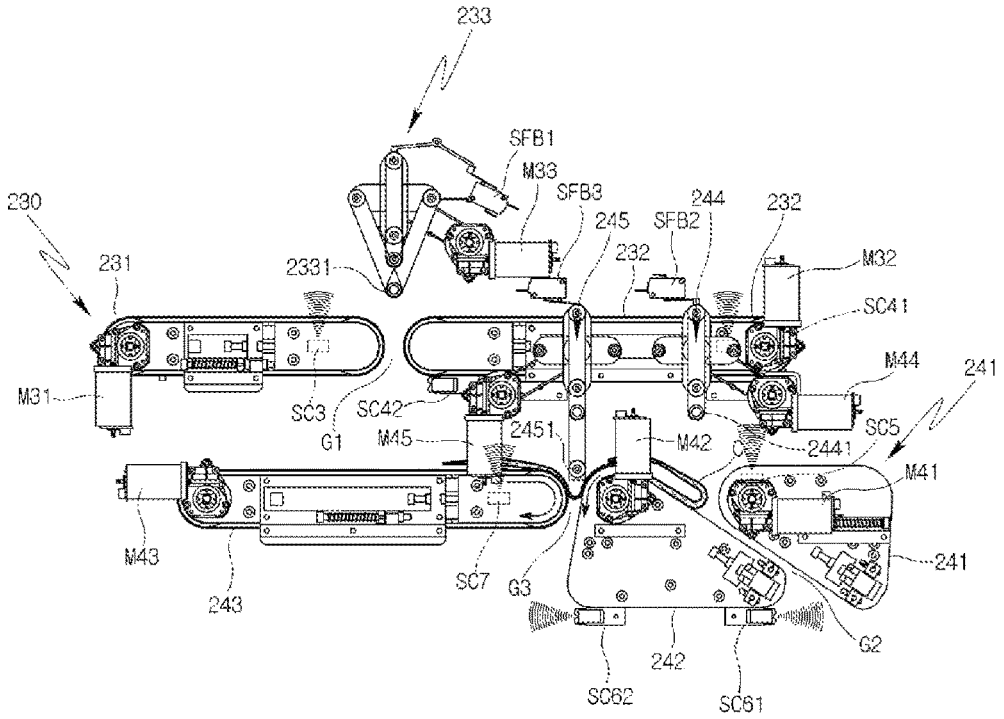

For example, as illustrated in FIG. 14, when a second folding bar driving motor M44 operates, a second folding bar 2441 rectilinearly moves downward from an initial position toward the second folding gap G2, pushes the ⅔ portion of the garment C at least partially into the second folding gap G2, and then returns back to the initial position by the operation of a crank member.

A second folding bar position sensor SFB2, which is a micro switch, can detect whether the second folding bar 2441 begins to move from the initial position and returns back to the initial position.

When the second folding bar position sensor SFB2 detects that the operation of the second folding bar 2441 is completed, the fifth conveyor motor M41 operates forward and the sixth conveyor motor M42 and the seventh conveyor motor M43 operate rearward so that the garment C is subjected to the primary ⅓ horizontal folding.

In some implementations, whether the primary ⅓ horizontal folding process is successfully performed is determined based on whether the tip of the garment C, which has been subjected to the ⅓ horizontal folding through the second folding gap G2, reaches the rear lower side of the sixth conveyor 242.

To this end, a sixth-conveyor-rear-lower-part garment detection sensor SC61 is provided at a rear lower side of the sixth conveyor 242.

Like the garment detection sensors, the sixth-conveyor-rear-lower-part garment detection sensor SC61 can be an IR sensor. However, since the sixth-conveyor-rear-lower-part garment detection sensor SC61 performs a function of detecting whether the garment C reaches the lower side of the second folding gap G2, the sixth-conveyor-rear-lower-part garment detection sensor SC61 is disposed at a position exposed from the sixth conveyor 242, like the fourth-conveyor-front-lower-part garment detection sensor SC62.

The sixth-conveyor-rear-lower-part garment detection sensor SC61 detects that the tip of the garment C reaches the lower side of the second folding gap G2. It may be determined that the lumping of the garment C has occurred when whether the garment C reaches the lower side of the second folding gap G2 is not detected in a case in which the tip of the garment C does not reach the lower side of the second folding gap G2 or a motor current value supplied to the fifth to seventh conveyor motors M41, M42, and M43 is excessively large even though a predetermined delay time elapses after the fifth conveyor motor M41 operates forward and the sixth conveyor motor M42 and the seventh conveyor motor M43 operate rearward.

For example, it may be determined that the lumping of the garment C has occurred in the second folding gap G2 in the fourth folding layer 240 when a seventh delay time T7 is equal to or larger than a predetermined seventh critical delay time Tth7 or a seventh motor current value A7 supplied to the fifth to seventh conveyor motors M41, M42, and M43 is equal to or larger than a predetermined seventh critical motor current value Ath7 after the forward operation of the fifth conveyor motor M41 and the rearward operations of the sixth conveyor motor M42 and the seventh conveyor motor M43 are initiated in a state in which it is determined, based on the output signal from the sixth-conveyor-rear-lower-part garment detection sensor SC61, that the tip of the garment C does not reach the lower side of the second folding gap G2 and the lower side of the sixth conveyor 242 which are target positions.

As described above, when it is determined that the lumping of the garment C has occurred in the second folding gap G2, the supply of power to the fifth to seventh conveyor motors M41, M42, and M43 is cut off to prevent overloads of the fifth to seventh conveyor motors M41, M42, and M43 and prevent damage to the garment C and the components.

In some implementations, the seventh critical delay time Tth7 may be smaller than the fifth critical delay time Tth5, and particularly set to about 7 seconds which is ⅔ of the fifth critical delay time Tth5 because the garment C is subjected to the primary ⅓ horizontal folding.

In addition, like the above-mentioned critical motor current values, the seventh critical motor current value Ath7 may be set to about 2 A when the fifth to seventh conveyor motors M41, M42, and M43 have the same output as the other conveyor motors. The seventh critical motor current value Ath7 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the second folding gap G2 as described above, an alarm including seventh error information indicating that the lumping of the garment C has occurred in the second folding gap G2 is generated and transferred to the user through the display unit and the alarm unit.

In some implementations, when a seventh-conveyor-rear-lower-part garment detection sensor detects that the tip of the garment C has reached the seventh conveyor, the fifth conveyor motor M41 can be operated rearward and the sixth conveyor motor M42 and the seventh conveyor motor M43 can be operated forward for the time (Tc*⅔) which is ⅓ of the garment passage time Tc in order to prepare the secondary ⅓ horizontal folding process, such that a ⅓ portion of the garment C before the primary horizontal folding process is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 can be stopped.

When the preparation of the secondary ⅓ horizontal folding for the garment C is completed, the third horizontal folding assembly 245 disposed above the sixth conveyor 242 and the seventh conveyor 243 can be operated.

The secondary horizontal folding process using the third horizontal folding assembly 245 and the third folding gap G3 may be performed in the same manner as the ½ horizontal folding process using the third horizontal folding assembly 245 and the third folding gap G3, and a detailed description thereof will be omitted.

In addition, the process of determining whether the lumping of the garment C occurs in the third folding gap G3 may be similarly performed in the secondary ⅓ horizontal folding process.

For example, it may be determined that the lumping of the garment C has occurred in the third folding gap G3 in the fourth folding layer 240 when an eighth delay time T8 is equal to or larger than a predetermined eighth critical delay time Tth8 or an eighth motor current value A8 supplied to the fifth to seventh conveyor motors M41, M42, and M43 is equal to or larger than a predetermined eighth critical motor current value Ath8 after the seventh conveyor motor M43 operates rearward and the fifth conveyor motor M41 and the sixth conveyor motor M42 operate forward in a state in which it is determined, based on the output signal from the sixth-conveyor-rear-lower-part garment detection sensor SC61, that the rear end of the garment C on which the secondary ⅓ horizontal folding is completely performed does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 is cut off to prevent overloads of the fifth to seventh conveyor motors M41, M42, and M43 and prevent damage to the garment C and the components.

In some implementations, the eighth critical delay time Tth8 may be smaller than the fifth critical delay time Tth5, and particularly set to 3 seconds to 4 seconds which is ⅓ of the fifth critical delay time Tth5 because the garment C is subjected to the secondary ⅓ horizontal folding.

In addition, like the above-mentioned critical motor current values, the eighth critical motor current value Ath8 may be set to about 2 A when the fifth to seventh conveyor motors M41, M42, and M43 have the same output as the other conveyor motors. The eighth critical motor current value Ath8 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including eighth error information indicating that the lumping of the garment C has occurred in the third folding gap G3 is generated and transferred to the user through the display unit and the alarm unit.

Figure 17A:
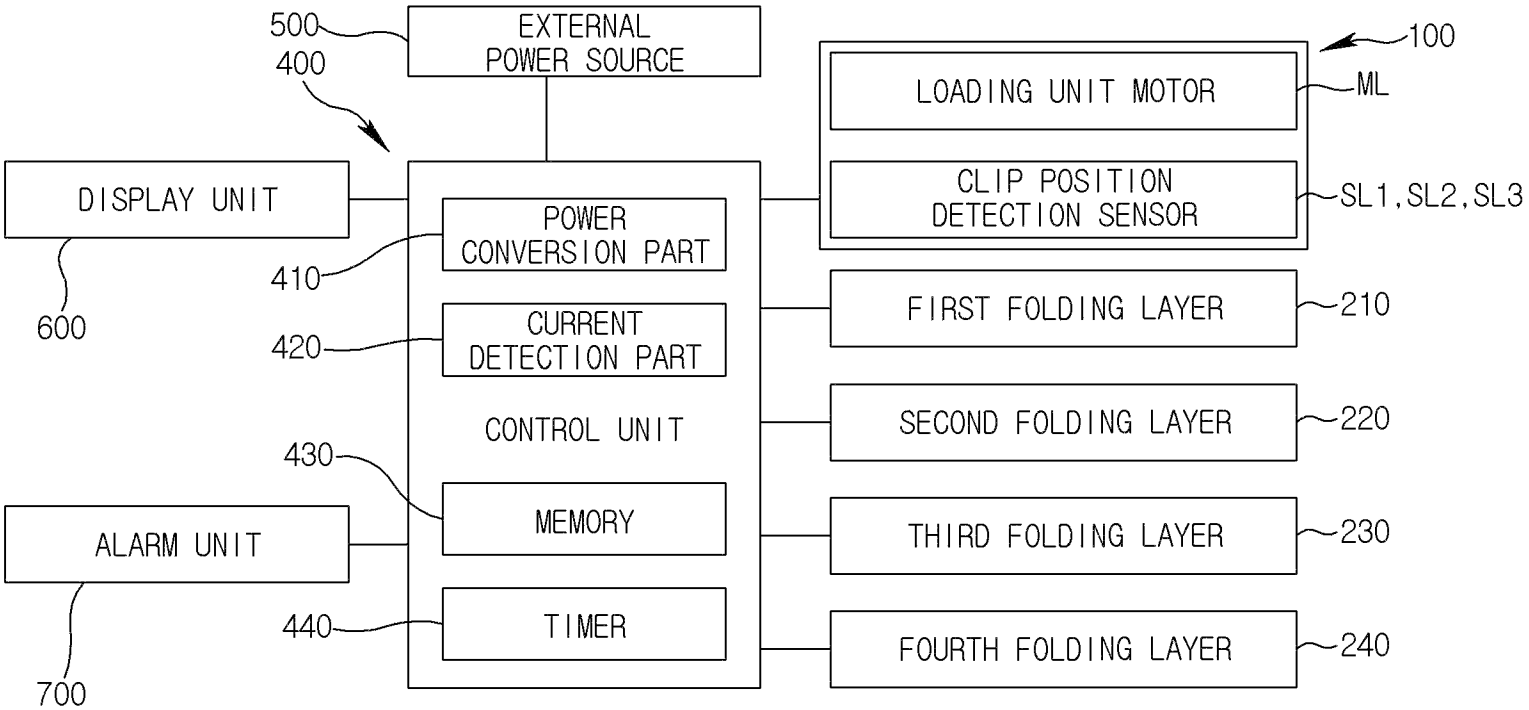
FIGS. 17A and 17B are block diagrams for explaining a configuration for controlling the exemplary garment folding machine.
Figure 17B:
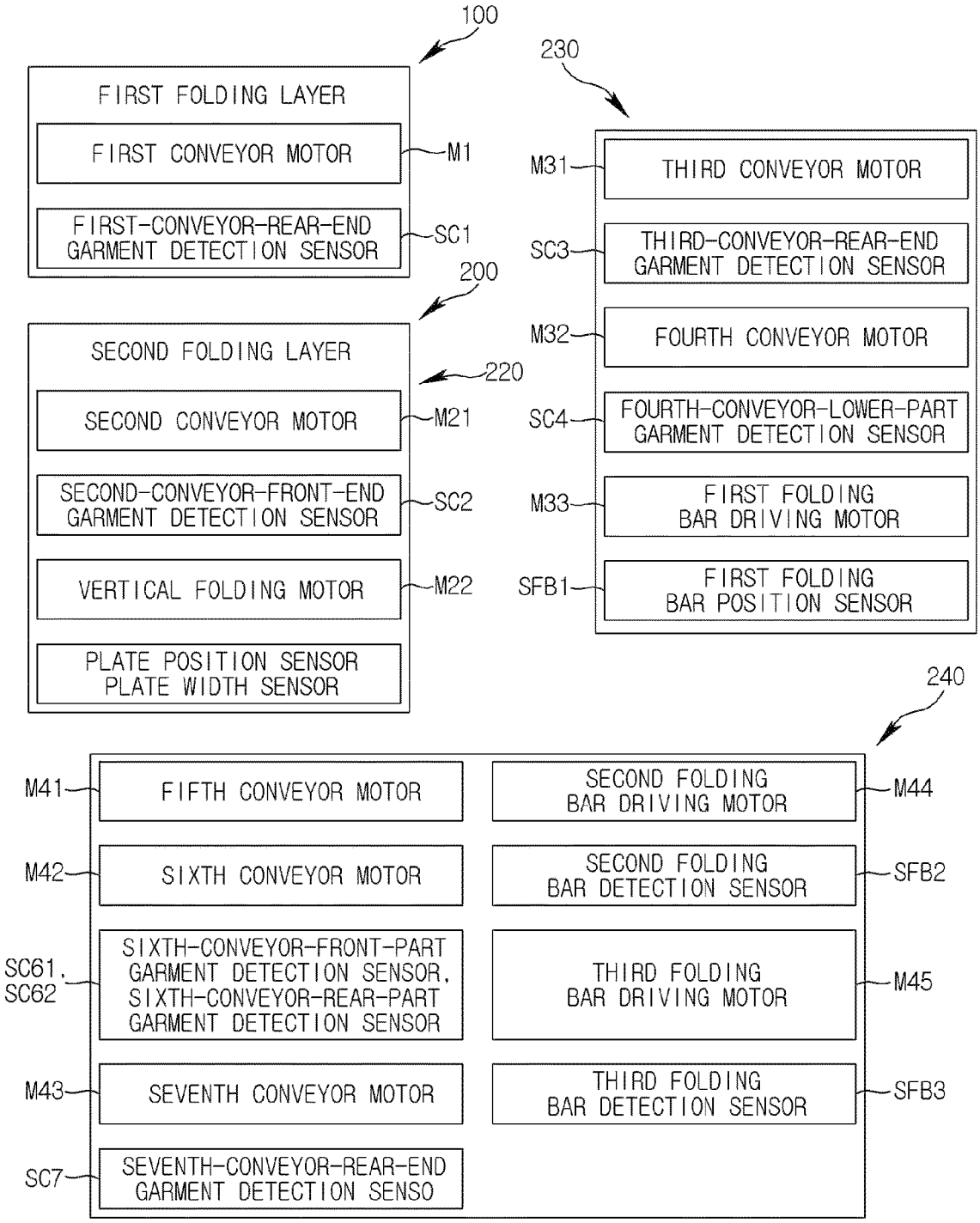
Figure 18:
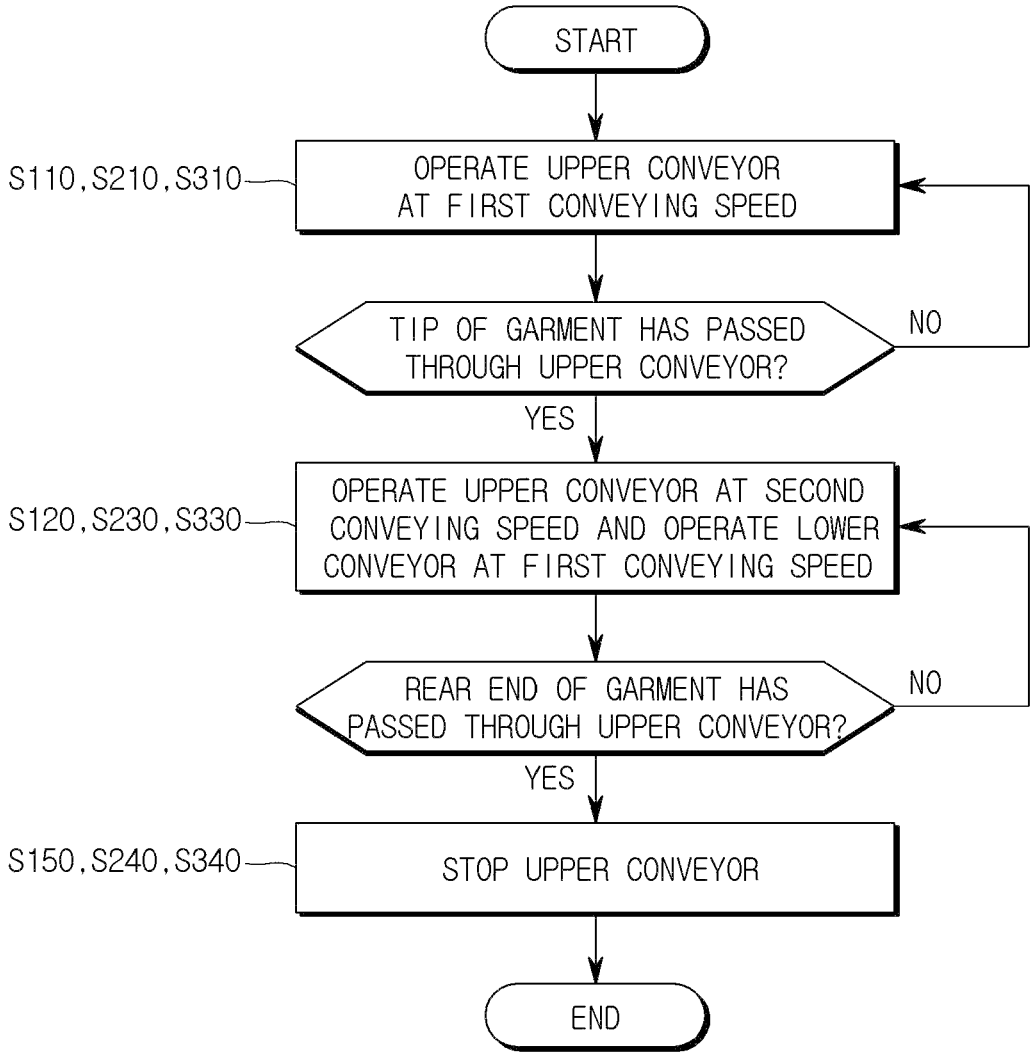
FIGS. 18, 19, 20A, and 20B are flowcharts for explaining a method of controlling the exemplary garment folding machine.
Figure 19:
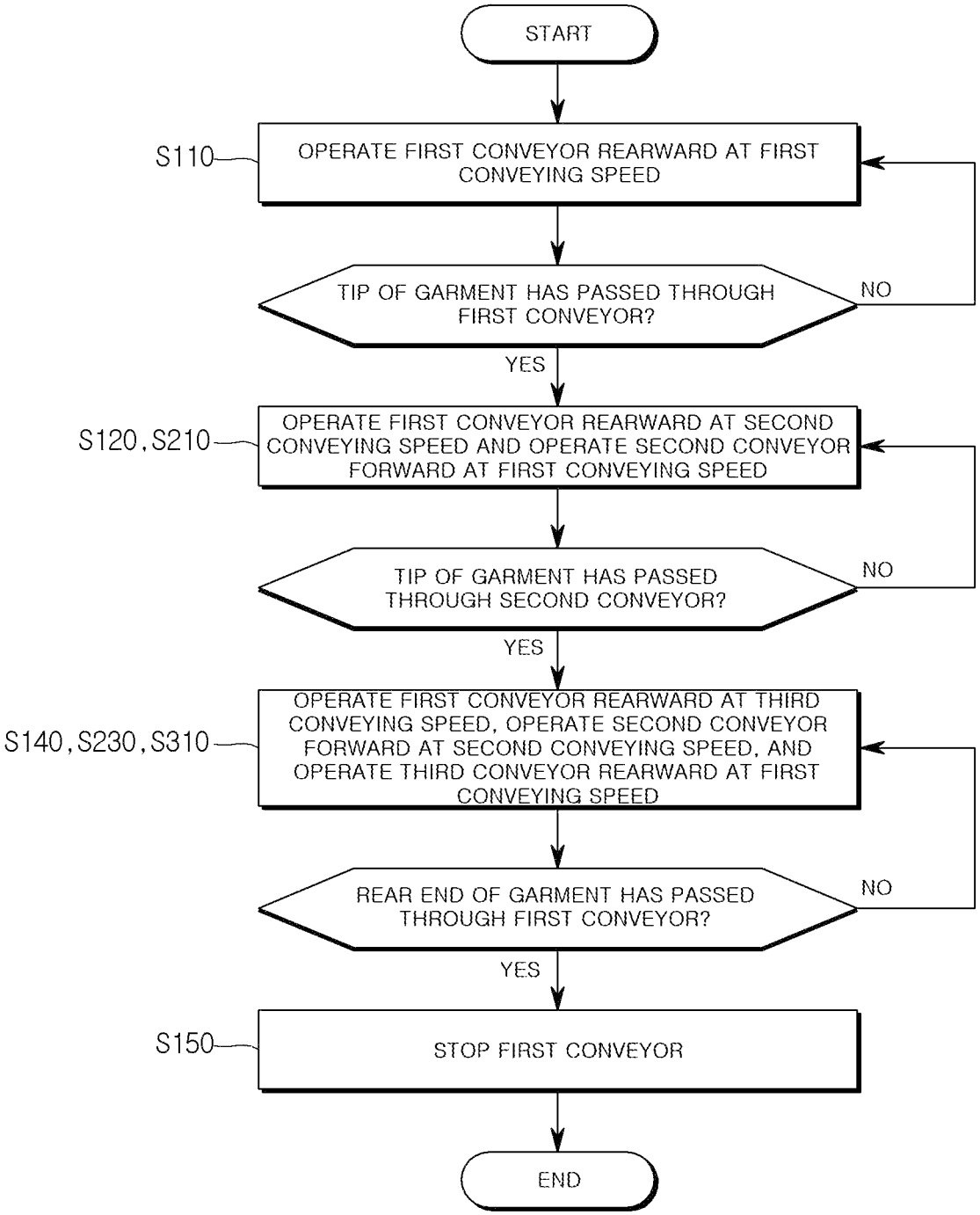
Figure 20A:
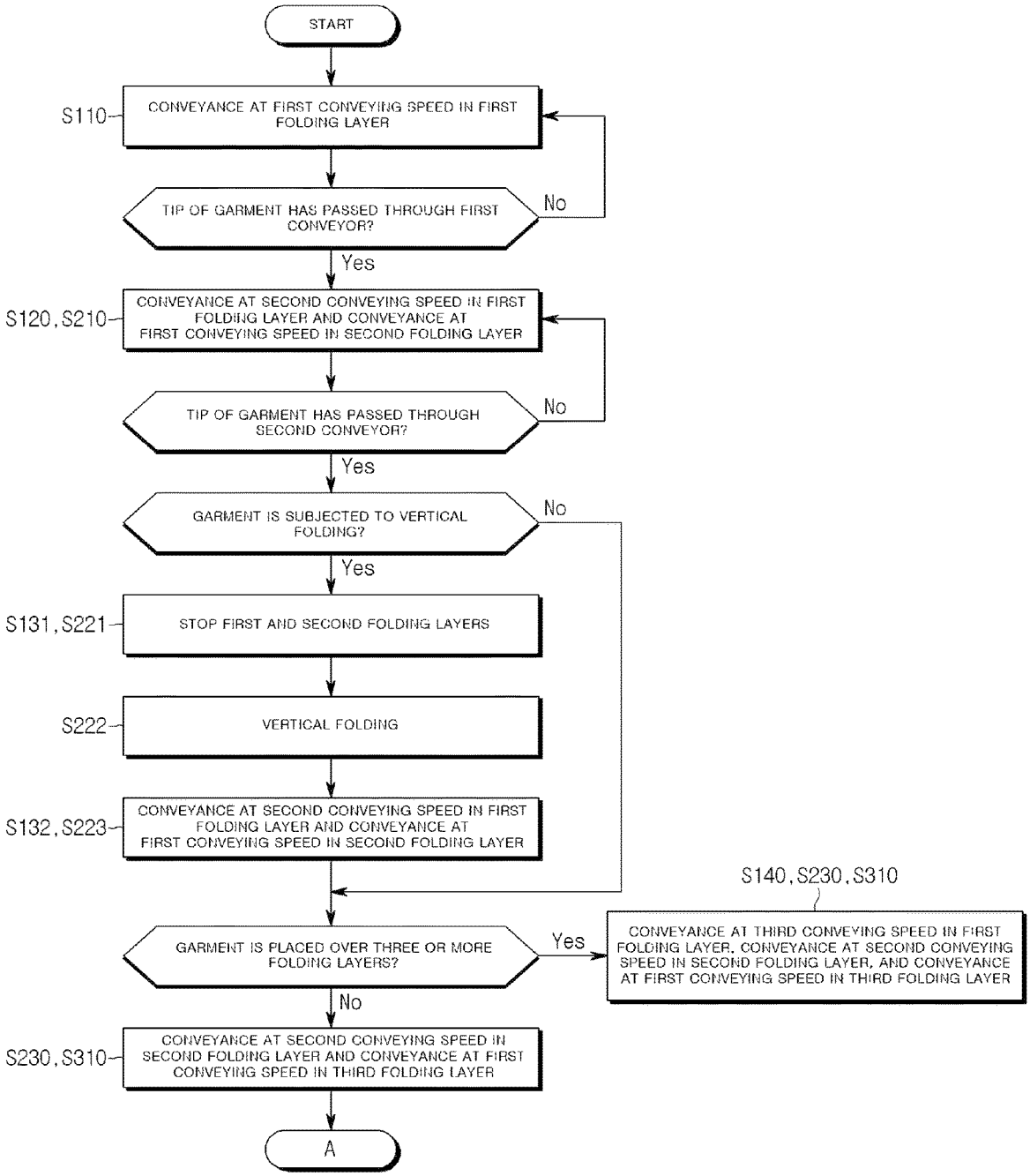
Figure 20B:
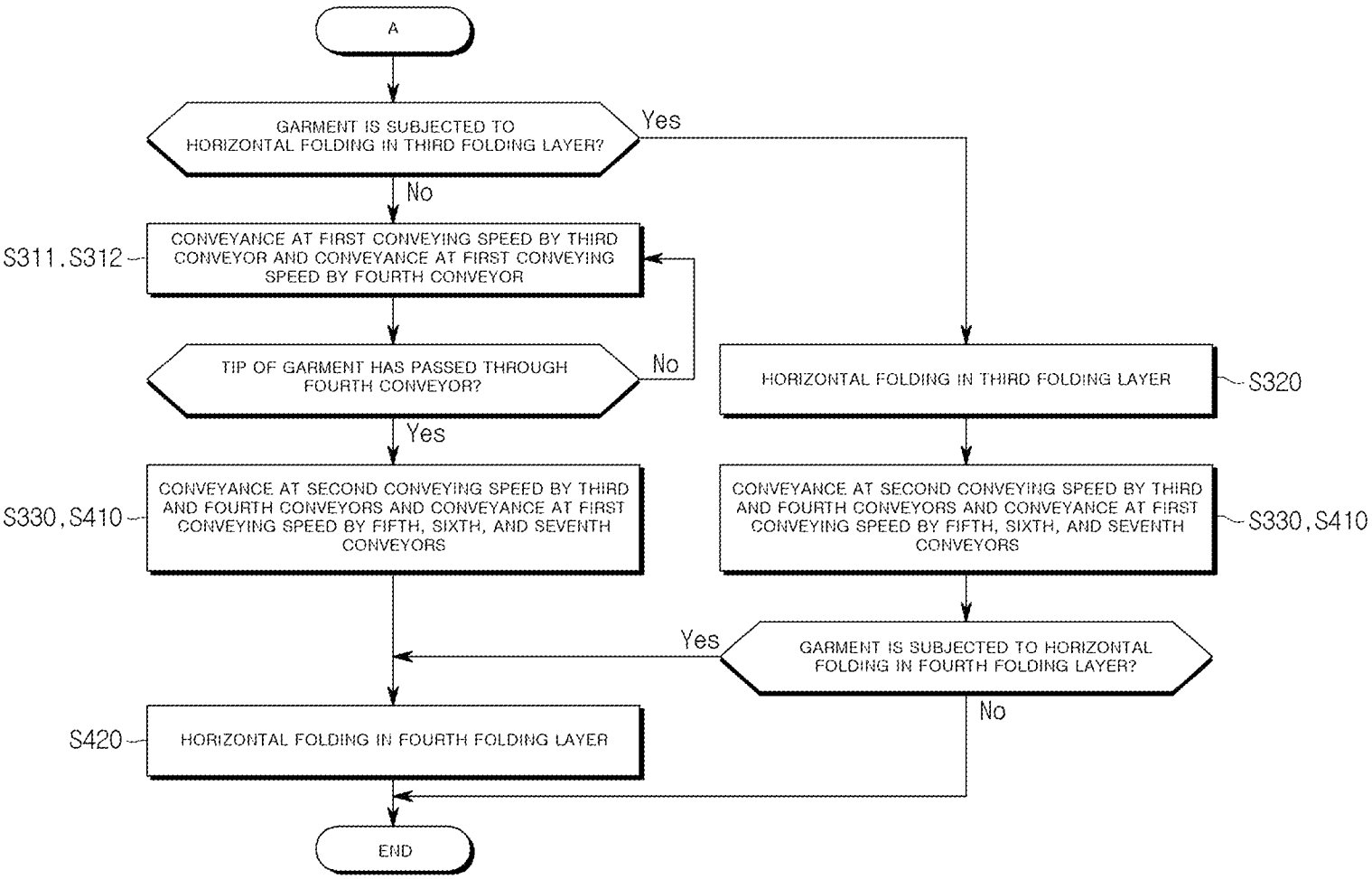

FIGS. 17A and 17B are block diagrams for explaining a configuration for controlling the exemplary garment folding machine.

Referring to FIGS. 17A and 17B, the garment folding machine can further include a control unit 400 configured to control the loading unit 100, the folding unit 200, and the unloading unit 300.

The control unit 400 is provided to control an operation of the garment folding machine 1 based on a user's instruction applied through an input unit. The control unit 400 can include a printed circuit board and elements mounted on the printed circuit board. When the user selects types of garments or folding courses through the input unit and then inputs a control instruction for the operation, the control unit 400 can control the operation of the garment folding machine 1 based on a preset algorithm.

The control unit 400 can be electrically connected to the loading unit 100, the first folding layer 210, the second folding layer 220, the third folding layer 230, and the fourth folding layer 240 and can be configured to generate a control signal for controlling the loading unit 100, the first folding layer 210, the second folding layer 220, the third folding layer 230, and the fourth folding layer 240. In some implementations, the control unit 400 can also be electrically connected to the unloading layer 310 and can control the unloading layer 310 so that the garment C, which is completely folded vertically or horizontally, is automatically accommodated in the discharge unit. A general configuration well known in the art may be applied in respect to the step of controlling the unloading layer 310, a specific description thereof will be omitted.

In some implementations, the control unit 400 can be electrically connected to the input unit to receive a user's control instruction, and electrically connected to the display unit 600 and the alarm unit 700 to provide the display unit 600 and the alarm unit 700 with the information on the operating state of the garment folding machine 1, thereby transmitting the corresponding information to the user.

In addition, the control unit 400 can control a power conversion part 410 and a current detection part 420, the power conversion part 410 can convert power inputted from the external power source 500 and can supply the power to the loading unit 100, first to fourth folding layers 210, 220, 230, and 240, and the unloading layer 310, and the current detection part 420 can detect the electric current supplied from the power conversion part 410 to the loading unit 100, the first to fourth folding layers 210, 220, 230, and 240, and the unloading layer 310.

In addition, the control unit 400 can further include a memory 430 configured to store information inputted in advance or inputted through the input unit, and the timer 440 capable of measuring the passage time of the garment C.

In some implementations, the control unit 400 can be electrically connected to the loading unit 100, the folding unit 200, and the unloading unit 300 so as to transmit or receive signals therebetween. For example, the control unit 400 can be electrically connected to the components of the loading unit 100, the first folding layer 210, the second folding layer 220, the third folding layer 230, and the fourth folding layer 240 so as to transmit or receive signals therebetween.

For example, the control unit 400 can be electrically connected to the conveyor motors M1, M21, M22, M31, M41, M42, and M43 and the garment detection sensor SC1, SC2, SC3, SC41, SC42, SC5, SC61, SC62, and SC7 of the folding unit 200 so as to transmit or receive signals therebetween. As a result, the control unit 400 can receive detection signals in relation to the presence of the garment C from the garment detection sensors SC1, SC2, SC3, SC41, SC42, SC5, SC61, SC62, and SC7 and transmit drive control signals to the conveyor motors M1, M21, M22, M31, M41, M42, and M43.

In addition, the control unit 400 can be electrically connected to the vertical folding motor M22, the folding bar driving motors M33, M44, and M45, and the folding bar position sensor SFB1, SFB2, and SFB3 of the folding unit 200 so as to transmit or receive signals therebetween. As a result, the control unit 400 can receive signals in relation to positions of the folding bars from the folding bar position sensors SFB1, SFB2, and SFB3 and transmit drive control signals to the vertical folding motor M22 and the folding bar driving motors M33, M44, and M45.

In some implementations, the control unit 400 can determine whether the garment C reaches the target position, whether the garment C passes through the target position, and whether the lumping of the garment C occurs. Further, the control unit 400 can control the operations of the respective conveyor motors M1, M21, M22, M31, M41, M42, and M43 to generate differences in rotational speeds between the conveyors or change rotation directions of the respective conveyors. Therefore, the control unit 400 can move the garment C forward or rearward and perform the vertical folding or the horizontal folding on the garment C.

A specific control operation of the control unit 400 will be described below.

In some implementations, during the use of the garment folding machine, lower garments, which have long lengths among the garments C, towels, or bedclothes are conveyed along the two or more folding layers and may be wrinkled during the conveying process.

For example, the plurality of layers is vertically disposed in a narrow horizontal area due to a spatial restriction, spaces between the layers are narrow, and many components are provided to convey the garments between the layers. For this reason, the garment C is easily wrinkled during the process of conveying the garment C.

To solve the problem, the control unit 400 can perform control to prevent the garment from being wrinkled and crumpled and remove wrinkles and crumples already formed during the process of conveying the garment. This configuration will be specifically described below.

FIGS. 18 to 20B are flowcharts for explaining a method of controlling the garment folding machine, and FIGS. 21A to 21F are graphs for explaining patterns for changing conveying speeds of conveyors in the method of controlling the garment folding machine.

The method of controlling the garment folding machine will be described below with reference to FIGS. 17A to 21F.

The method of controlling the garment folding machine includes a first folding layer conveying step S100, a second folding layer conveying step S200, a third folding layer conveying step S300, and a fourth folding layer conveying step S400.

Further, the first folding layer conveying step S100, the second folding layer conveying step S200, the third folding layer conveying step S300, and the fourth folding layer conveying step S400 include first conveying speed conveying steps S110, S210, S310, and S410, respectively, and the first folding layer conveying step S100, the second folding layer conveying step S200, and the third folding layer conveying step S300 include second conveying speed conveying steps S120, S230, and S330, respectively.

In the first folding layer conveying step S100, the control unit 400 can convey the garment C at a predetermined conveying speed when the garment C enters the first folding layer 210, and the control unit 400 can decrease the conveying speed for the garment in the first folding layer 210 when the tip of the garment C passes through the first folding layer 210 and enters the second folding layer 220.

In the first conveying speed conveying step S110 in the first folding layer conveying step S100, the first conveyor 211 provided in the first folding layer 210 can convey the garment C at a predetermined first conveying speed V1.

Specifically, in the first conveying speed conveying step S110, the control unit 400 can rotate the first conveyor motor M1 at a predetermined first rotational speed W1 when the garment C enters the first conveyor 211. For example, when the clip assembly 130 reaches the third position P3, the control unit 400 can determine that the tip of the garment C enters the first conveyor 211. In this case, the control unit 400 can operate the first conveyor motor M1 with a duty ratio of 100%, and the rotational speed of the first conveyor motor M1 may be 110 rpm or more and 130 rpm or less. For example, the first rotational speed W1 may be 110 rpm or more and 130 rpm or less.

Therefore, the first conveyor 211 can convey the garment C from the front end to the rear end of the first conveyor 211 by means of the driving power provided by the first conveyor motor M1. In some implementations, the first conveyor 211 can convey the garment C at the first conveying speed V1.

In the second conveying speed conveying step S120 of the first folding layer conveying step S100, when the tip of the garment C passes through the first conveyor 211 and enters the second conveyor 221 disposed below the first conveyor 211, the first conveyor 211 can convey the garment C at a predetermined second conveying speed V2 decreased from the first conveying speed V1. In some implementations, the second conveying speed V2 may be lower than the first conveying speed V1.

Specifically, in the second conveying speed conveying step S120, when the tip of the garment C has passed through the first-conveyor-rear-end garment detection sensor SC1, the control unit 400 can determine that the tip of the garment C has passed through the first conveyor 211 and entered the second conveyor 221. In some implementations, a part of the garment C, which includes the tip of the garment C, can be positioned on the second conveyor 221, and the remaining part of the garment C, which includes the rear end of the garment C, can be positioned on the first conveyor 211. Further, the control unit 400 can decrease the conveying speed of the first conveyor 211 for conveying the garment.

For example, when the tip of the garment C passes through the first-conveyor-rear-end garment detection sensor SC1 and enters the second conveyor 221, the control unit 400 can rotate the first conveyor motor M1 at a predetermined second rotational speed W2. By way of further example, the control unit 400 can operate the first conveyor motor M1 with a duty ratio of 50%, and the rotational speed of the first conveyor motor M1 may be 90 rpm or more and 105 rpm or less. That is, the second rotational speed W2 may be 90 rpm or more and 105 rpm or less.

In some implementations, when the tip of the garment C passes through the rear end of the first conveyor 211, the control unit 400 can decrease the rotational speed of the first conveyor motor M1 from the first rotational speed W1 to the second rotational speed W2. For example, the second rotational speed W2 is lower than the first rotational speed W1.

In some implementations, the second conveying speed conveying step S120 of the first folding layer conveying step S100 can be performed simultaneously with the first conveying speed conveying step S210 of the second folding layer conveying step S200 which will be described below.

In some implementations, in the second conveying speed conveying step S120, the control unit 400 can decrease the conveying speed of the first conveyor 211 for conveying the garment to a speed lower than the first conveying speed V1 and change the conveying speed in accordance with a pattern inputted in advance.

Figure 21A:
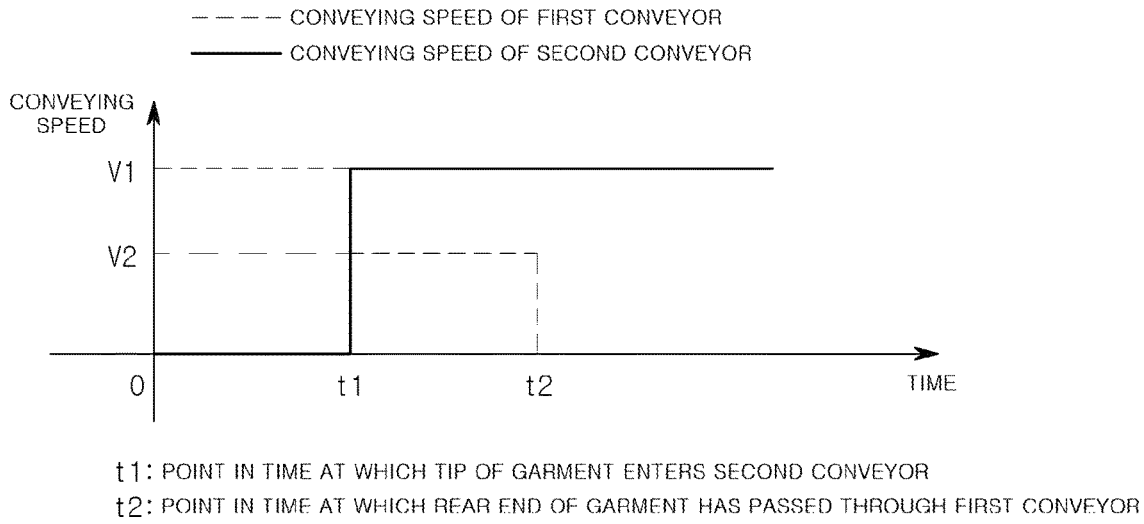
FIGS. 21A to 21F are graphs for explaining patterns for changing conveying speeds of conveyors in the method of controlling the exemplary garment folding machine.
Figure 21B:
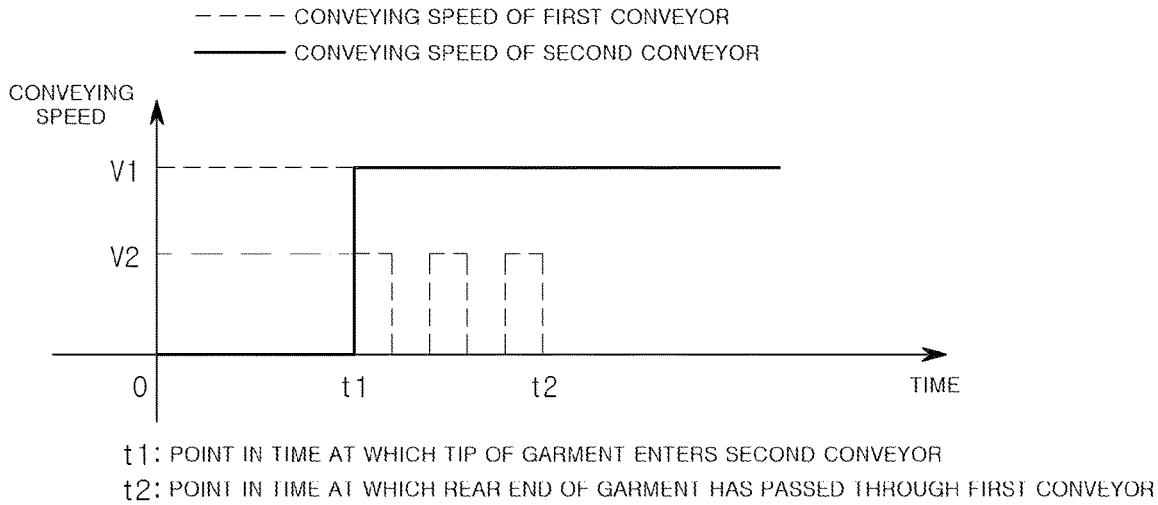

Specifically, the control unit 400 can repeatedly change the conveying speed of the first conveyor 211. For example, the control unit 400 can control the first conveyor 211 to convey the garment C at the second conveying speed V2 and stop the first conveyor 211 once or more while conveying the garment C at the second conveying speed V2 (FIG. 21B). For example, the control unit 400 can rotate the first conveyor motor M1 at the second rotational speed W2, stop the rotation of the first conveyor motor M1 for a predetermined time, and then rotate the first conveyor motor M1 at the second rotational speed W2. The control unit 400 may repeat this process multiple times.

Figure 21C:
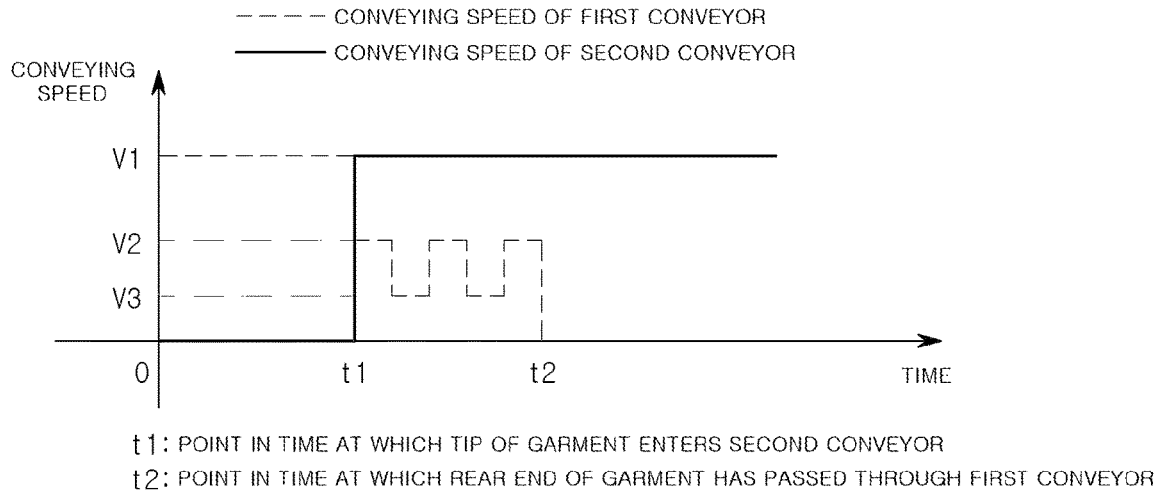

In some implementations, the control unit 400 can rotate the first conveyor motor M1 at the second rotational speed W2, operate the first conveyor motor M1 at a predetermined third rotational speed W3 for a predetermined time, and then rotate the first conveyor motor M1 at the second rotational speed W2 (FIG. 21C). The control unit 400 may repeat this process multiple times.

In some implementations, this configuration periodically pulls the garment C. Therefore, the wrinkles and crumples already formed on the garment C may be removed.

Alternatively, the control unit 400 may gradually decrease the conveying speed of the first conveyor 211 for conveying the garment C.

Figure 21D:
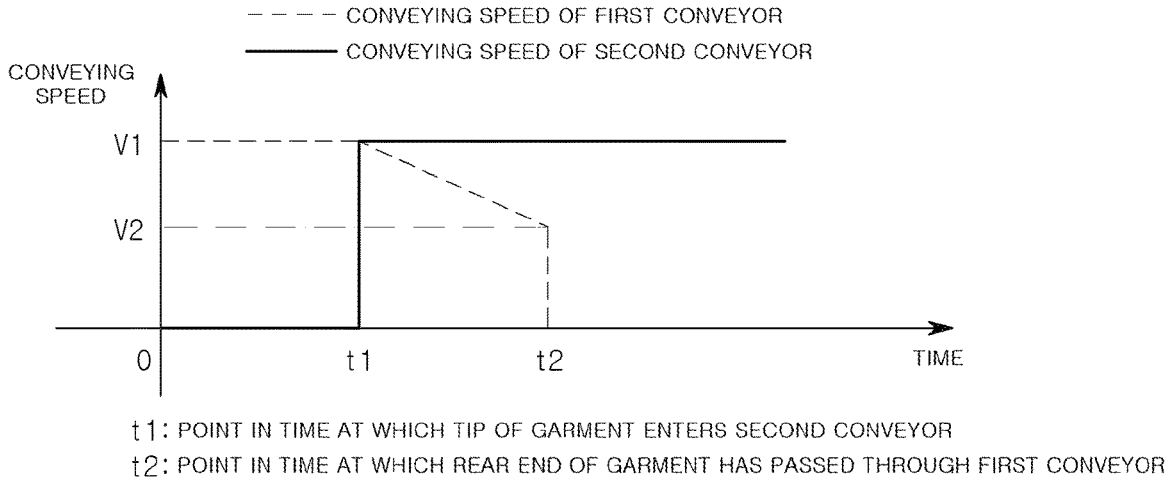

For example, the control unit 400 can gradually decrease the conveying speed of the first conveyor 211 for conveying the garment C from the first conveying speed V1 to the second conveying speed V2. For example, the control unit 400 can decelerate the first conveyor motor M1 with uniform acceleration from the first rotational speed W1 to the second rotational speed W2 (FIG. 21D).

Figure 21E:
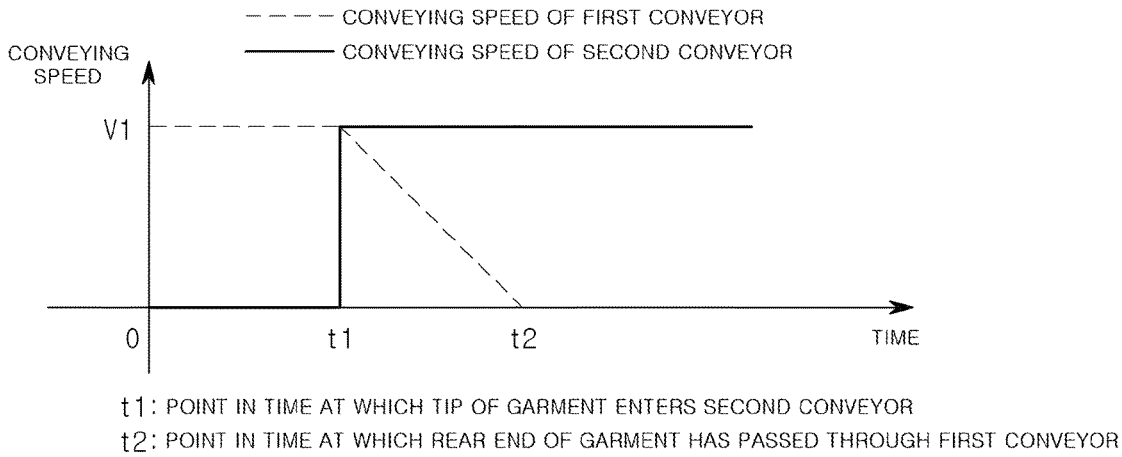

As another example, the control unit 400 can gradually decrease the conveying speed of the first conveyor 211 for conveying the garment C from the first conveying speed V1 until the first conveyor 211 stops (FIG. 21E). For example, the control unit 400 can decrease the rotational speed of the first conveyor motor M1 from the first rotational speed W1 to 0 rpm with uniform acceleration.

Figure 21F:
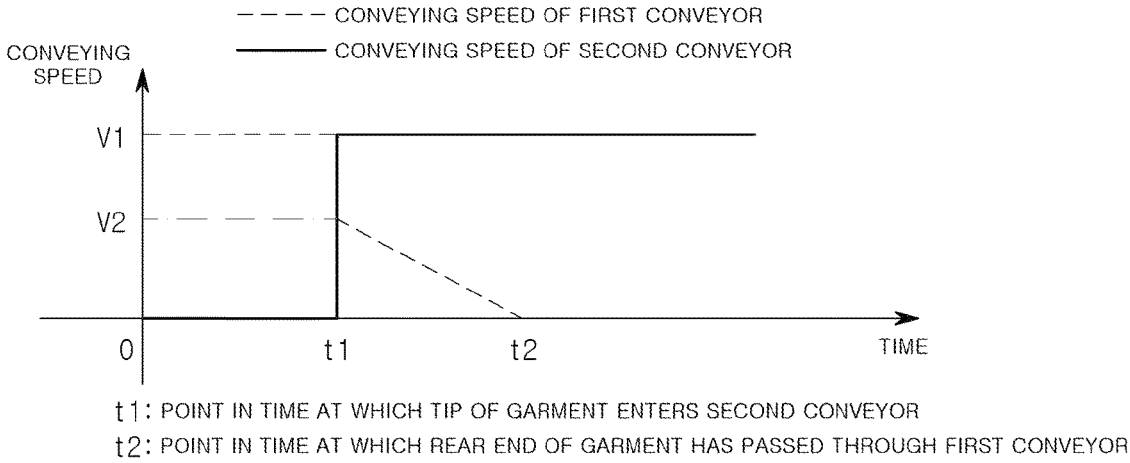
Figure 22:
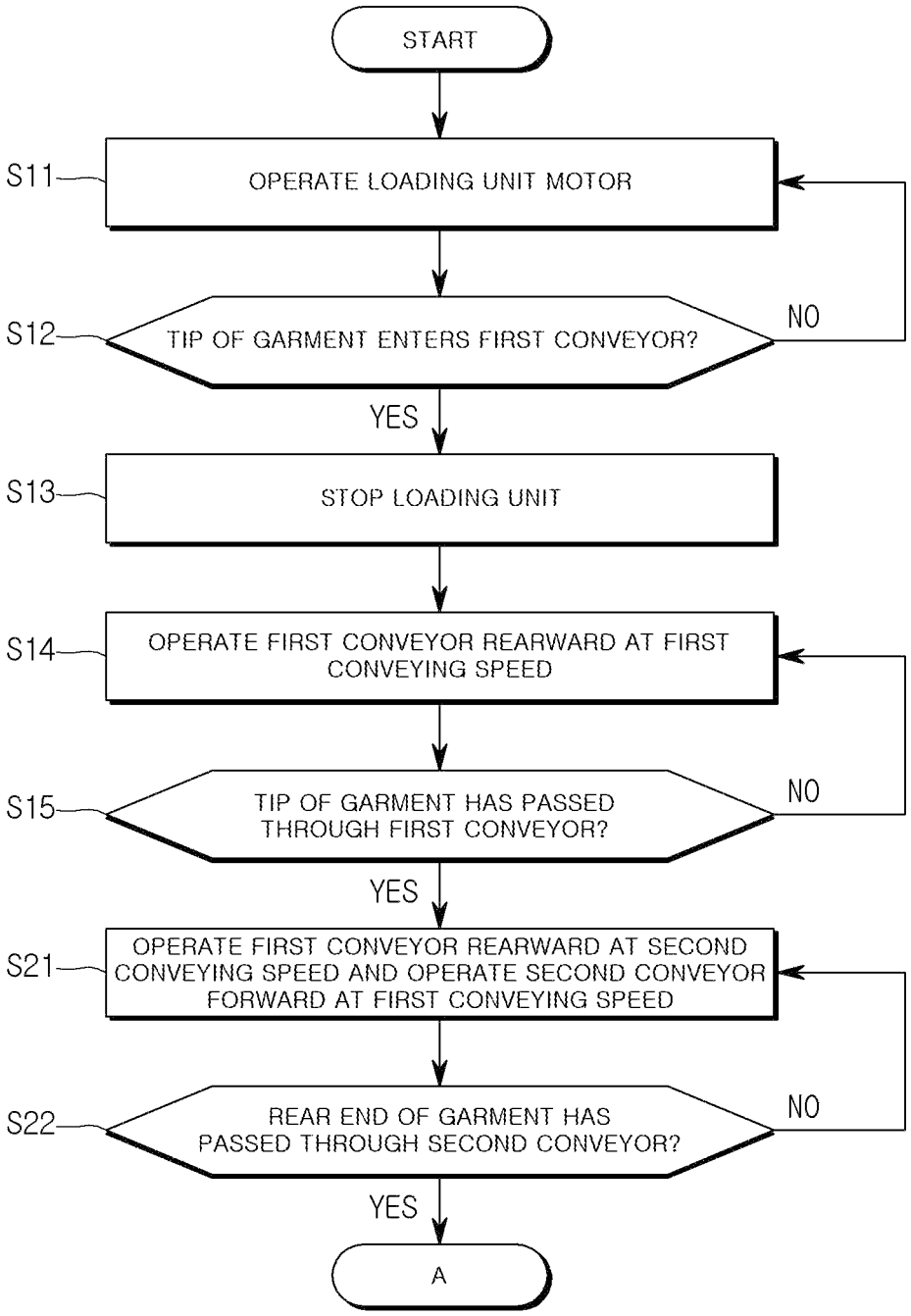
FIGS. 22 to 29 are flowcharts for explaining a process of folding a garment by applying the method of controlling the exemplary garment folding machine.
Figure 23:
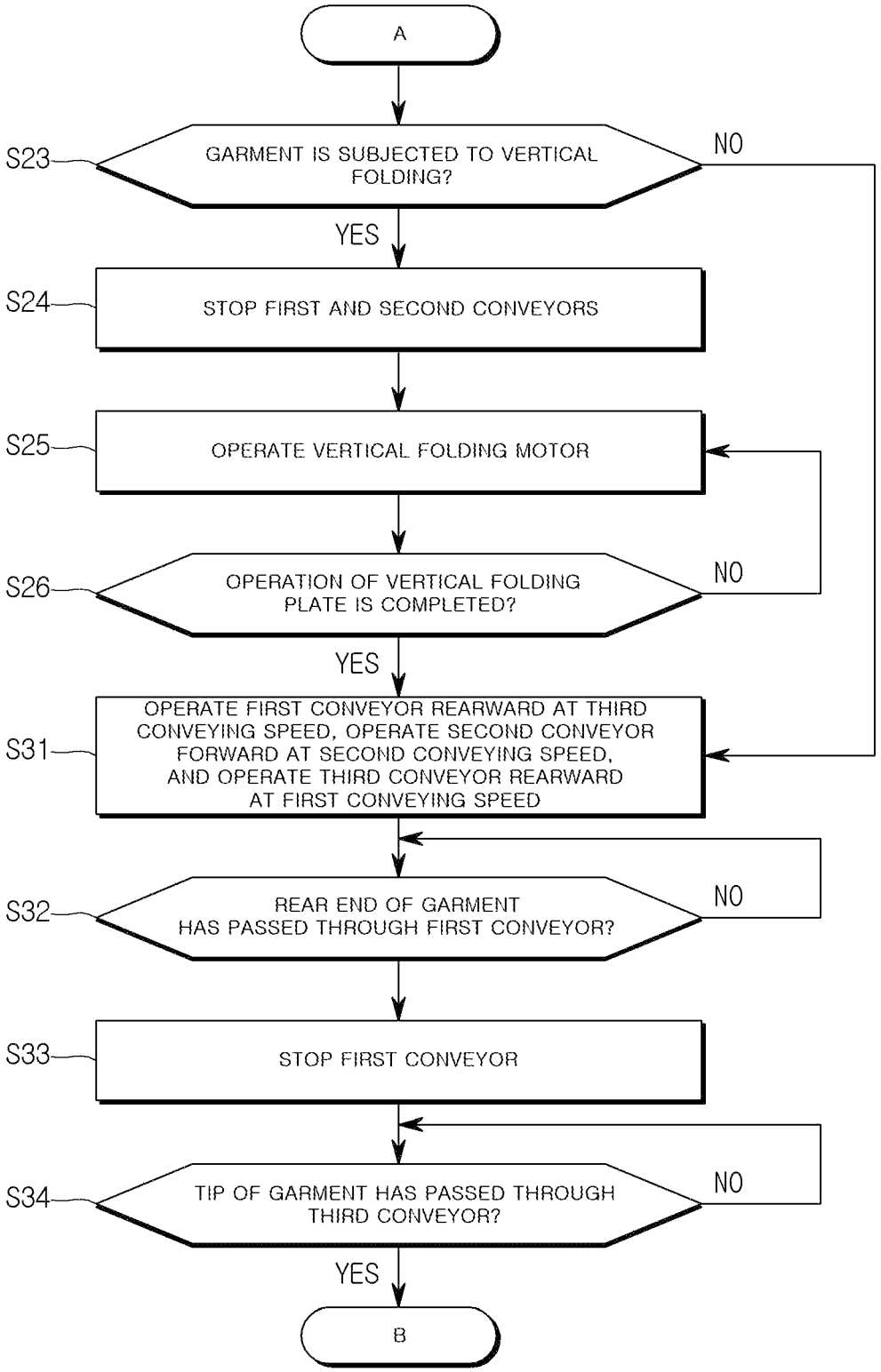
Figure 24:
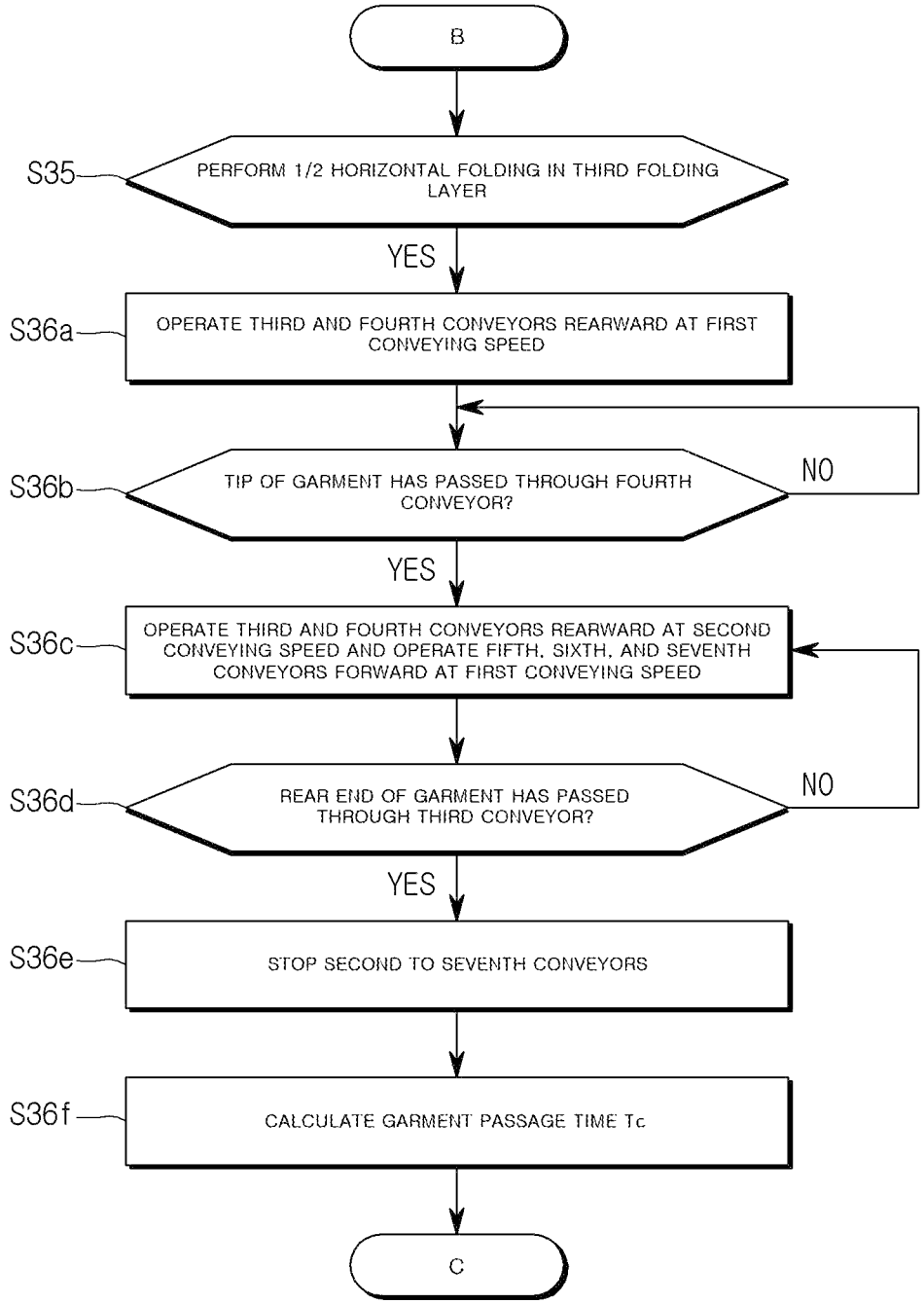
Figure 25:
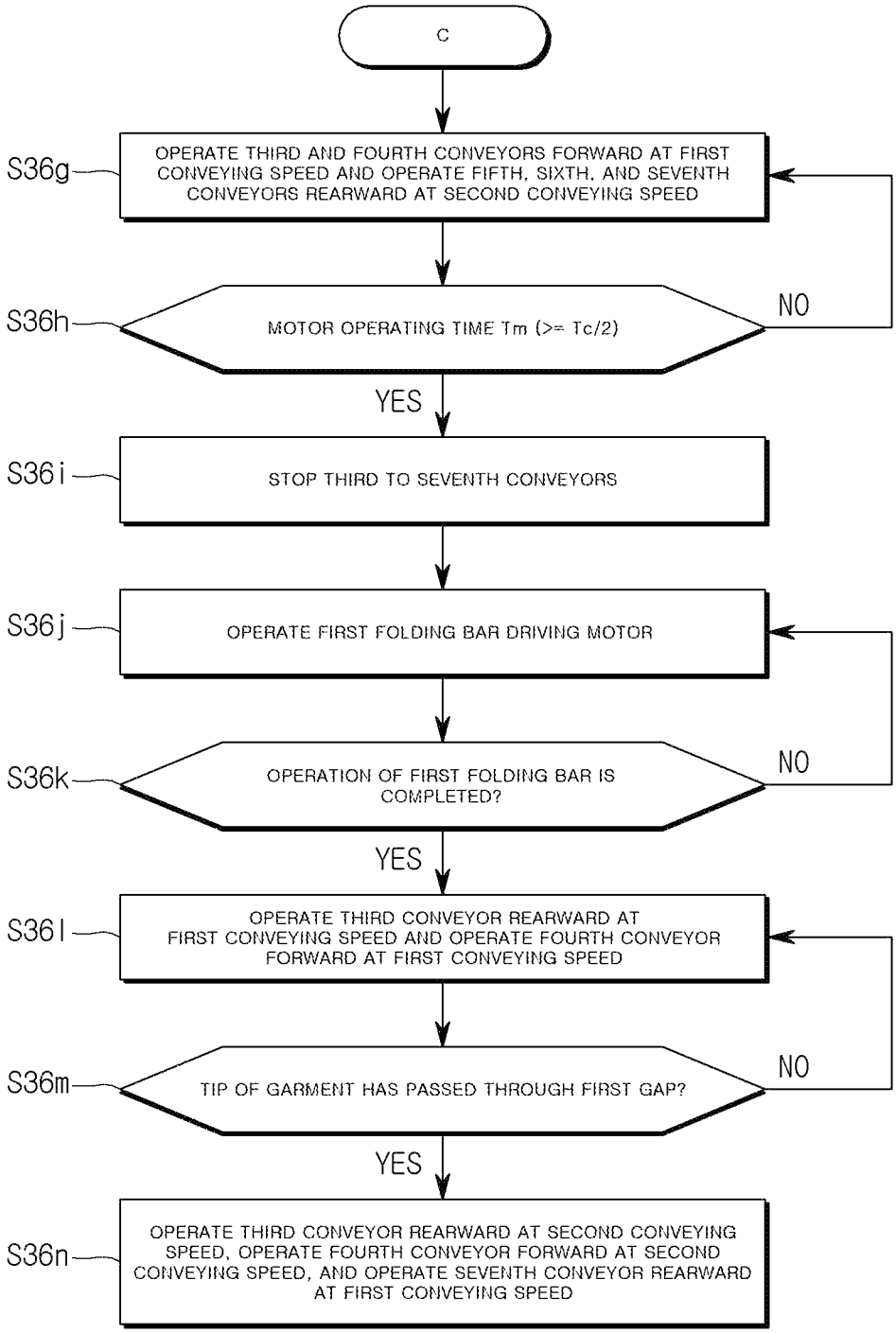
Figure 26:
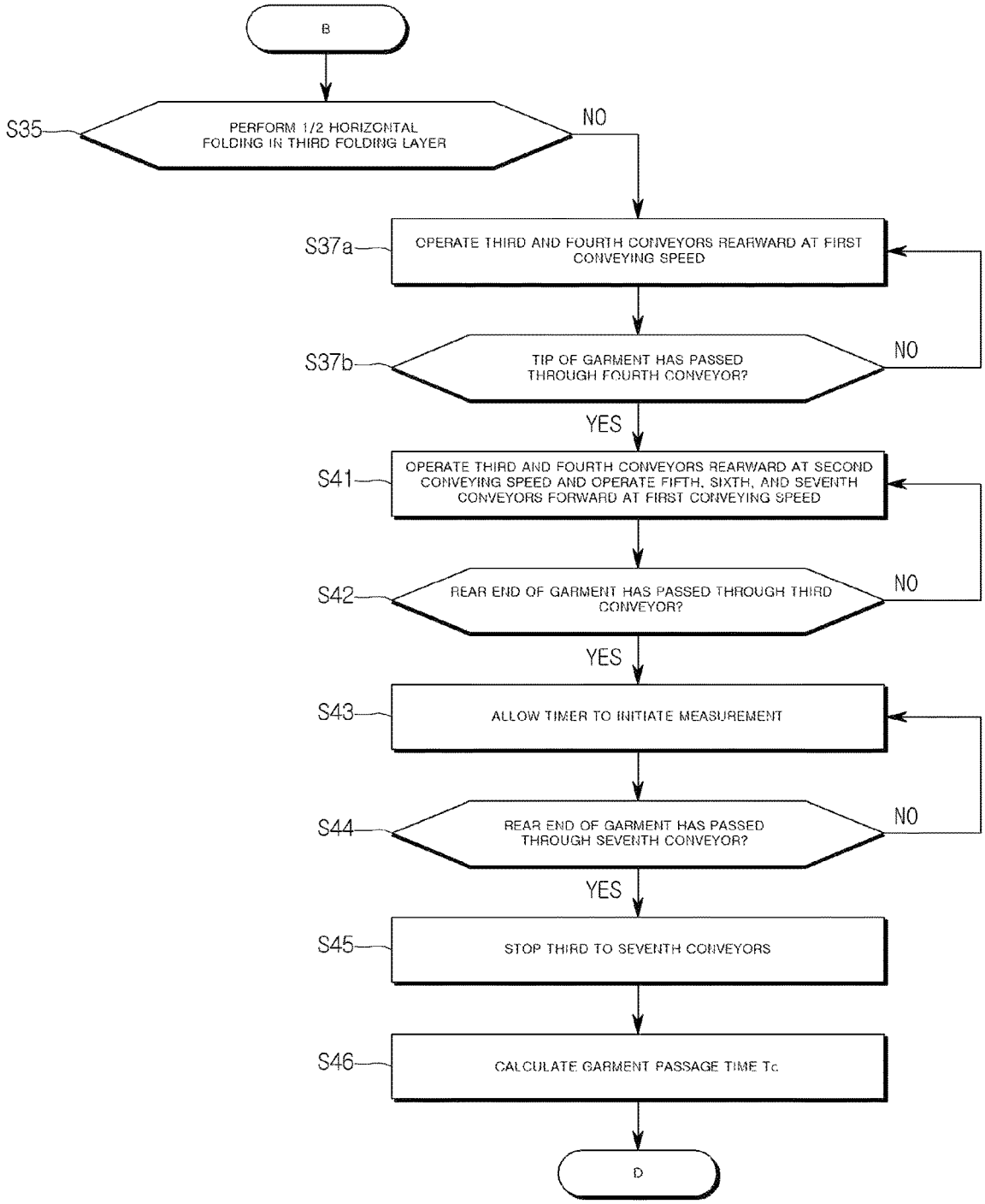
Figure 27:
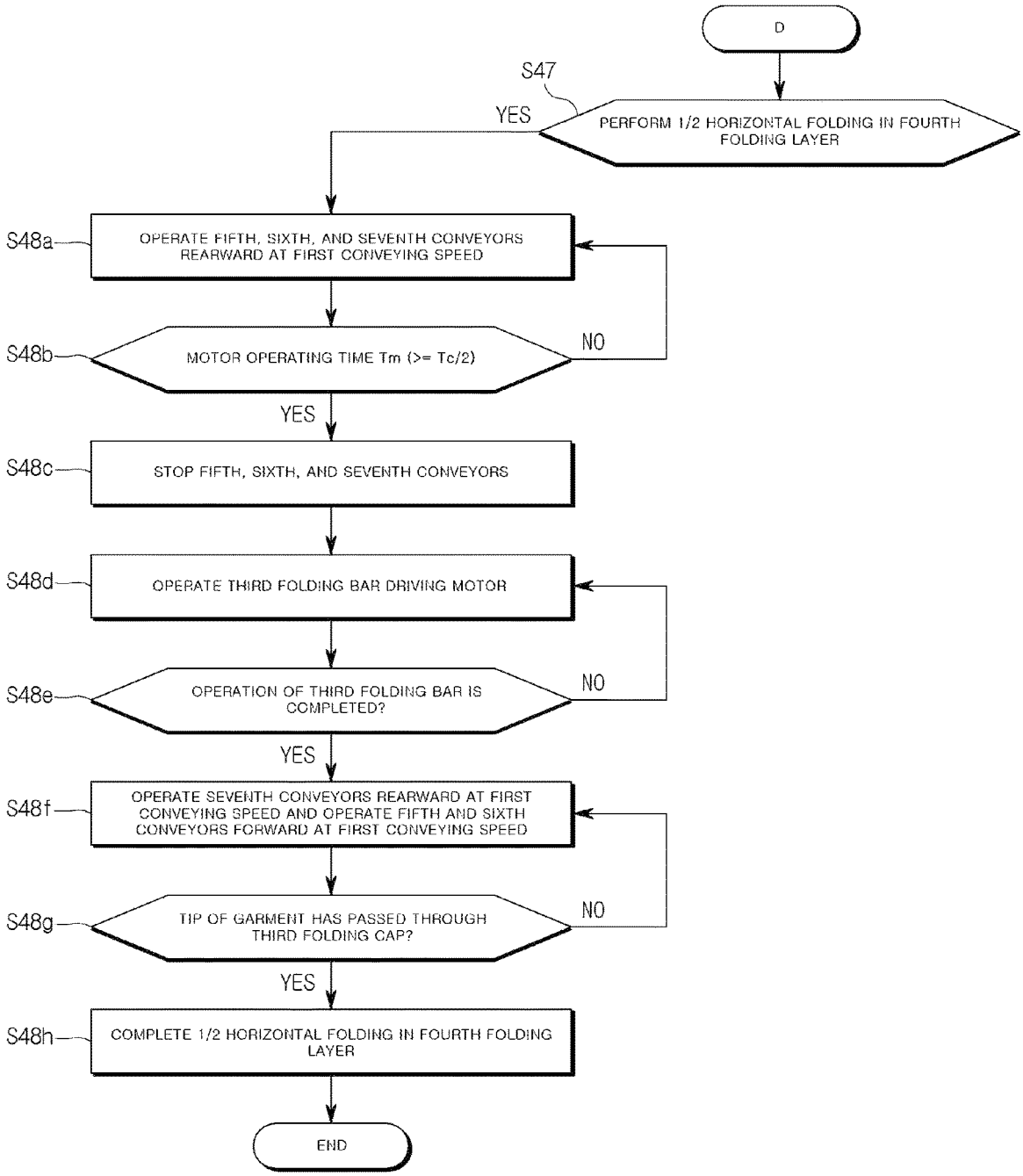
Figure 28:
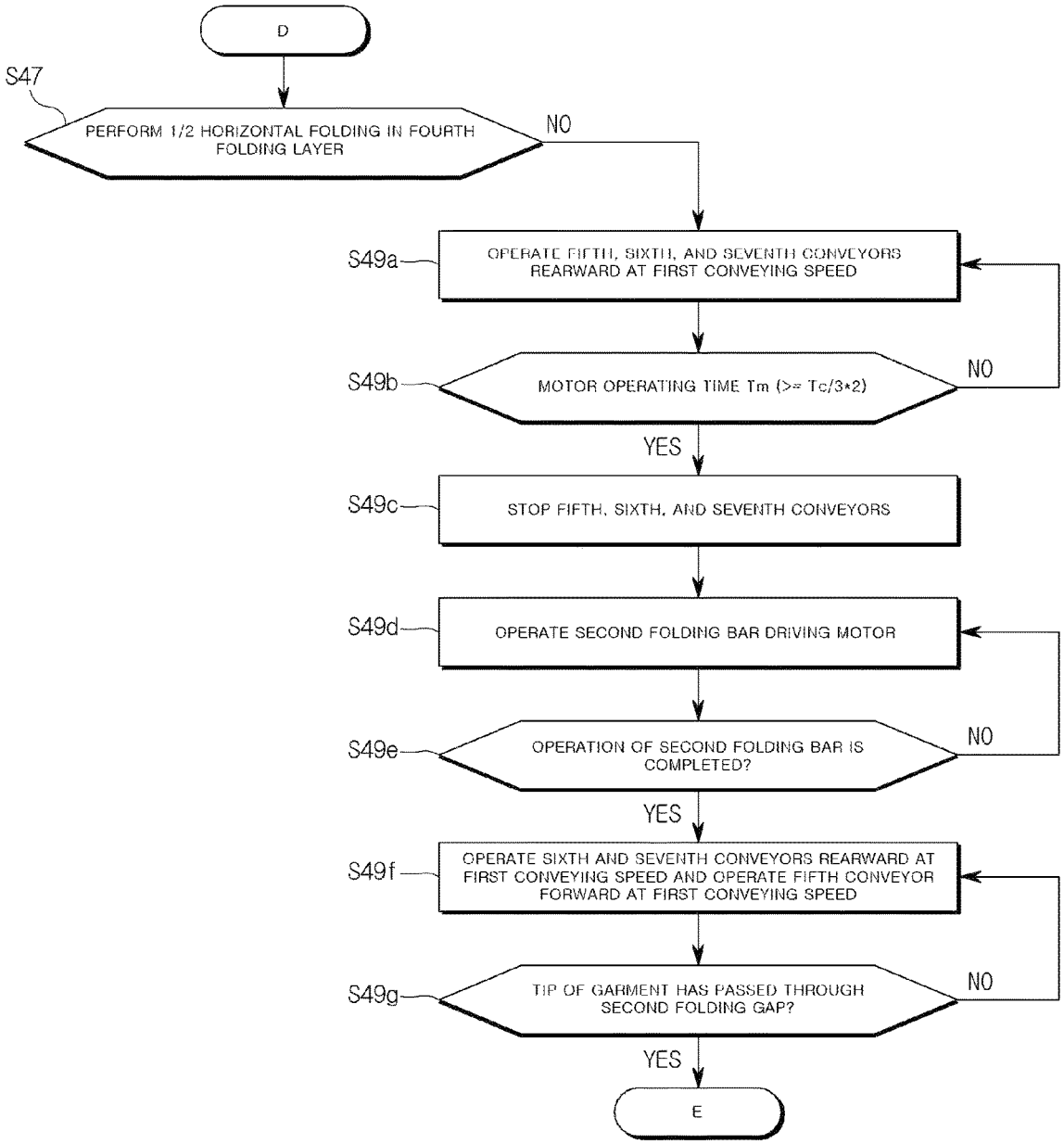
Figure 29:
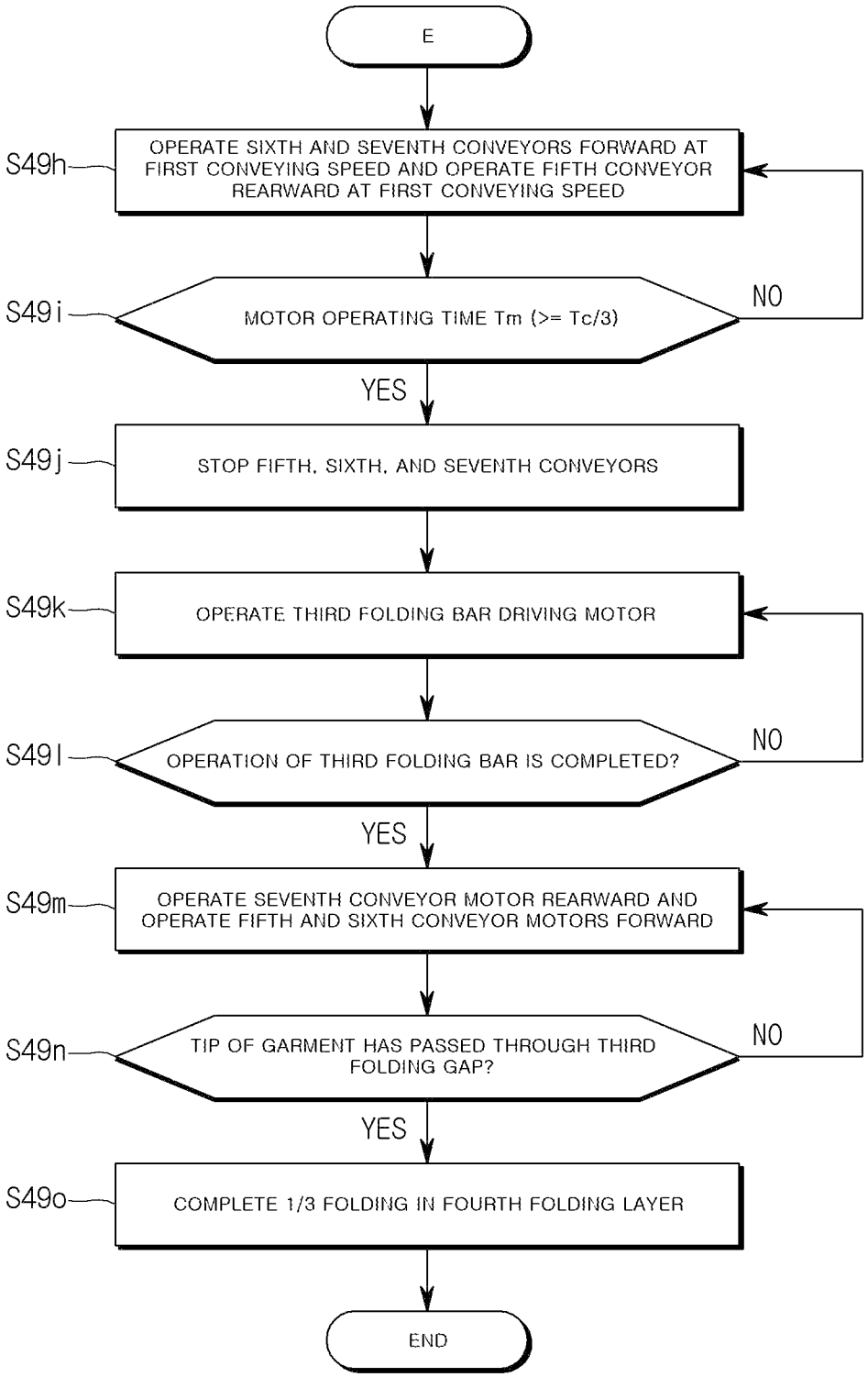

As still another example, the control unit 400 can decrease the conveying speed of the first conveyor 211 for conveying the garment C from the first conveying speed V1 to the second conveying speed V2 and then gradually decrease the conveying speed until the first conveyor 211 stops (FIG. 21F). For example, the control unit 400 can decelerate the first conveyor motor M1 from the first rotational speed W1 to the second rotational speed W2 and then decelerate the first conveyor motor M1 from the second rotational speed W2 to 0 rpm with uniform acceleration.

In some implementations, this configuration can gradually increase a difference in speed between the layers, thereby gradually strongly pulling the garment C. In comparison with a case in which a great speed difference between the layers instantaneously occurs to strongly pull the garment C, it is possible to remove wrinkles while protecting the fabric of the garment C.

In some implementations, the first folding layer conveying step S100 can further include a vertical folding step S130 of stopping the conveying operation of the first folding layer 210 when the garment C is subjected to the vertical folding.

Specifically, in the vertical folding step S130, when the tip of the garment C has passed through the second-conveyor-front-end garment detection sensor SC2, the control unit 400 can determine that the tip of the garment C has reached the front end of the second conveyor 221. In some implementations, in a case in which the garment C is set in advance as an object to be subjected to the vertical folding, the control unit 400 can stop the operation of the first folding layer 210 for conveying the garment.

For example, in the case in which the garment C is set in advance as an object to be subjected to the vertical folding, the control unit 400 can stop the operation of the first conveyor motor M1 when the tip of the garment C reaches the front end of the second conveyor 221 (S131).

In some implementations, when the vertical folding is completely performed on the garment C, the control unit 400 can operate the first conveyor motor M1 again to perform the conveying operation of the first folding layer 210 (S132).

In some implementations, the first folding layer conveying step S100 can further include a third conveying speed conveying step S140.

In the third conveying speed conveying step S140, when the tip of the garment C passes through the second conveyor 221 and enters the third conveyor 231 disposed below the second conveyor 221 and thus a part of the garment C is positioned on the first conveyor 211, the control unit 400 can operate the first conveyor 211 to convey the garment C at a predetermined third conveying speed V3. In some implementations, the third conveying speed V3 may be lower than the second conveying speed V2.

Specifically, in the third conveying speed conveying step S140, when the tip of the garment C has passed through the second-conveyor-front-end garment detection sensor SC2, the control unit 400 can determine that the tip of the garment C has passed through the second conveyor 221 and entered the third conveyor 231. In some implementations, a part of the garment C, which includes the tip of the garment C, can be positioned on the third conveyor 231, another part of the garment C, which includes the rear end of the garment C, can be positioned on the first conveyor 211, and the remaining part of the garment C can be positioned on the second conveyor 221. Further, the control unit 400 can further decrease the conveying speed of the first conveyor 211 for conveying the garment.

In some implementations, when the tip of the garment C passes through the second-conveyor-front-end garment detection sensor SC2 and enters the third conveyor 231, the control unit 400 can rotate the first conveyor motor M1 at the predetermined third rotational speed W3. For example, the control unit 400 can operate the first conveyor motor M1 with a duty ratio of 33%, and the rotational speed of the first conveyor motor M1 may be 80 rpm or more and less than 90 rpm. That is, the third rotational speed W3 may be 80 rpm or more and less than 90 rpm.

That is, when the tip of the garment C passes through the front end of the second conveyor 221, the control unit 400 may decrease the rotational speed of the first conveyor motor M1 from the second rotational speed W2 to the third rotational speed W3. In this case, the third rotational speed W3 is lower than the second rotational speed W2.

In some implementations, the third conveying speed conveying step S140 of the first folding layer conveying step S100 can be performed simultaneously with the second conveying speed conveying step S230 of the second folding layer conveying step S200 which will be described below. In addition, the third conveying speed conveying step S140 of the first folding layer conveying step S100 can be performed simultaneously with the first conveying speed conveying step S310 of the third folding layer conveying step S300 which will be described below.

In some implementations, the first folding layer conveying step S100 can further include a conveyance ending step S150.

In the conveyance ending step S150, when the rear end of the garment C has passed through the first conveyor 211, the control unit 400 can end the operation of conveying the garment C. Specifically, when the rear end of the garment C has passed through the first-conveyor-rear-end garment detection sensor SC1, the control unit 400 can determine that the entire garment C has passed through the first conveyor 211. Further, the control unit 400 can end the operation of the first conveyor motor M1.

In the second folding layer conveying step S200, the control unit 400 can convey the garment C at a predetermined conveying speed when the garment C enters the second folding layer 220, and the control unit 400 can decrease the conveying speed for the garment in the second folding layer 220 when the tip of the garment C passes through the second folding layer 220 and enters the third folding layer 230.

In the first conveying speed conveying step S210 of the second folding layer conveying step S200, the second conveyor 221 provided in the second folding layer 220 may convey the garment C at the predetermined first conveying speed V1.

Specifically, in the first conveying speed conveying step S210, the control unit 400 can rotate the second conveyor motor M21 at the predetermined first rotational speed W1 when the garment C enters the second conveyor 221. For example, when the tip of the garment C has passed through the first-conveyor-rear-end garment detection sensor SC1, the control unit 400 can determine that the tip of the garment C has passed through the first conveyor 211 and entered the second conveyor 221. In some implementations, the control unit 400 can operate the second conveyor motor M21 with a duty ratio of 100%, and the rotational speed of the first conveyor motor M2 may be 110 rpm or more and 130 rpm or less. That is, the first rotational speed W1 may be 110 rpm or more and 130 rpm or less.

Therefore, the second conveyor 221 can convey the garment C from the rear end to the front end of the second conveyor 221 by means of driving power provided by the second conveyor motor M21. For example, the second conveyor 221 can convey the garment C at the first conveying speed V1.

In some implementations, the first conveying speed conveying step S210 of the second folding layer conveying step S200 can be performed simultaneously with the second conveying speed conveying step S120 of the first folding layer conveying step S100.

Therefore, when the garment C is positioned on both the first conveyor 211 and the second conveyor 221, the control unit 400 can set the conveying speeds so that the conveying speed of the second conveyor 221 for conveying the garment C is higher than the conveying speed of the first conveyor 211 for conveying the garment C. For example, the control unit 400 can make the rotational speed of the second conveyor motor M21 higher than the rotational speed of the first conveyor motor M1, thereby implementing a difference in conveying speed for the garment C between the first folding layer 210 and the second folding layer 220. Therefore, the difference in conveying speed between the first folding layer 210 and the second folding layer 220 can pull the garment C, thereby preventing the garment C from being wrinkled and crumpled during the process of conveying the garment C.

In some implementations, the second folding layer conveying step S200 can further include a vertical folding step S220 of stopping the conveying operation of the second folding layer 220 when the garment C is subjected to the vertical folding.

Specifically, in the vertical folding step S220, when the tip of the garment C has passed through the second-conveyor-front-end garment detection sensor SC2, the control unit 400 may determine that the tip of the garment C has reached the front end of the second conveyor 221. In some implementations, in a case in which the garment C is set in advance as an object to be subjected to the vertical folding, the control unit 400 can stop the operation of the second folding layer 220 for conveying the garment.

For example, in the case in which the garment C is set in advance as an object to be subjected to the vertical folding, the control unit 400 can stop the operation of the second conveyor motor M21 when the tip of the garment C reaches the front end of the second conveyor 221 (S221).

In some implementations, when the garment C is pulled between the first folding layer 210 and the second folding layer 220, the vertical folding may not be smoothly performed due to tension of the garment C. Therefore, the control unit 400 may rotate the second conveyor motor M21 in the reverse direction (a direction opposite to the direction in which the second conveyor motor M21 rotates in the first conveying speed conveying step S210) to reduce the tension of the garment C.

Thereafter, the control unit 400 can perform the vertical folding on the garment C. For example, the control unit 400 can operate the vertical folding motor M22 (S222).

In some implementations, when the vertical folding is completely performed on the garment C, the control unit 400 can operate the second conveyor motor M21 again to perform the conveying operation of the second folding layer 220 (S223).

In some implementations, when the garment C is not subjected to the vertical folding or the vertical folding is completely performed on the garment C, the second conveying speed conveying step S230 to be described below may be performed.

In the second conveying speed conveying step S230 of the second folding layer conveying step S200, when the tip of the garment C passes through the second conveyor 221 and enters the third conveyor 231 disposed below the second conveyor 221, the second conveyor 221 can convey the garment C at the predetermined second conveying speed V2 decreased from the first conveying speed V1. In this case, the second conveying speed V2 may be lower than the first conveying speed V1.

Specifically, in the second conveying speed conveying step S230, when the tip of the garment C has passed through the second-conveyor-front-end garment detection sensor SC2, the control unit 400 can determine that the tip of the garment C has passed through the second conveyor 221 and entered the third conveyor 231. In this case, a part of the garment C, which includes the tip of the garment C, can be positioned on the third conveyor 231, and at least a part of the garment C can be positioned on the second conveyor 221. Further, the control unit 400 can decrease the conveying speed of the second conveyor 221 for conveying the garment.

For example, when the tip of the garment C passes through the second-conveyor-front-end garment detection sensor SC2 and enters the third conveyor 231, the control unit 400 can rotate the second conveyor motor M21 at the predetermined second rotational speed W2. By way of further example, the control unit 400 can operate the second conveyor motor M21 with a duty ratio of 50%, and the rotational speed of the second conveyor motor M21 may be 90 rpm or more and 105 rpm or less. That is, the second rotational speed W2 may be 90 rpm or more and 105 rpm or less.

For example, when the tip of the garment C passes through the front end of the second conveyor 221, the control unit 400 can decrease the rotational speed of the second conveyor motor M21 from the first rotational speed W1 to the second rotational speed W2. In this case, the second rotational speed W2 is lower than the first rotational speed W1.

In some implementations, the second conveying speed conveying step S230 of the second folding layer conveying step S200 can be performed simultaneously with the first conveying speed conveying step S310 of the third folding layer conveying step S300.

Therefore, when the garment C is positioned on both the second conveyor 221 and the third conveyor 231, the control unit 400 can set the conveying speeds so that the conveying speed of the third conveyor 231 for conveying the garment C is higher than the conveying speed of the second conveyor 221 for conveying the garment C. That is, the control unit 400 can make the rotational speed of the third conveyor motor M3 higher than the rotational speed of the second conveyor motor M21, thereby implementing a difference in conveying speed for the garment C between the second folding layer 220 and the third folding layer 230. Therefore, the difference in conveying speed between the second folding layer 220 and the third folding layer 230 can pull the garment C, thereby preventing the garment C from being wrinkled and crumpled during the process of conveying the garment C.

In some implementations, the second conveying speed conveying step S230 of the second folding layer conveying step S200 can be performed simultaneously with the third conveying speed conveying step S140 of the first folding layer conveying step S100 as well as the first conveying speed conveying step S310 of the third folding layer conveying step S300.

Therefore, when the garment C is positioned over the first conveyor 211, the second conveyor 221, and the third conveyor 231, the control unit 400 can set the conveying speeds so that the conveying speed of the third conveyor 231 for conveying the garment C is higher than the conveying speed of the second conveyor 221 for conveying the garment C and the conveying speed of the second conveyor 221 for conveying the garment C is higher than the conveying speed of the first conveyor 211 for conveying the garment C. That is, the control unit 400 can make the rotational speed of the third conveyor motor M3 higher than the rotational speed of the second conveyor motor M21 and make the rotational speed of the second conveyor motor M21 higher than the rotational speed of the first conveyor motor M1, thereby implementing a difference in conveying speed for the garment C between the first folding layer 210, the second folding layer 220, and the third folding layer 230.

Therefore, the difference in conveying speed between the first folding layer 210, the second folding layer 220, and the third folding layer 230 may pull the garment C, thereby preventing the garment C from being wrinkled and crumpled during the process of conveying the garment C.

In some implementations, in the second conveying speed conveying step S230, the control unit 400 can decrease the conveying speed of the second conveyor 221 for conveying the garment to a speed lower than the first conveying speed V1 and change the conveying speed in accordance with a pattern inputted in advance.

Specifically, the control unit 400 can repeatedly change the conveying speed of the second conveyor 221. For example, the control unit 400 can control the second conveyor 221 to convey the garment C at the second conveying speed V2 and stop the first conveyor 221 once or more while conveying the garment C at the second conveying speed V2. That is, the control unit 400 can rotate the second conveyor motor M21 at the second rotational speed W2, stop the rotation of the second conveyor motor M21 for a predetermined time, and then rotate the second conveyor motor M21 at the second rotational speed W2. The control unit 400 may repeat this process multiple times.

As another example, the control unit 400 can rotate the second conveyor motor M21 at the second rotational speed W2, operate the second conveyor motor M21 at the predetermined third rotational speed W3 for a predetermined time, and then rotate the second conveyor motor M21 at the second rotational speed W2. The control unit 400 may repeat this process multiple times.

In some implementations, this configuration periodically pulls the garment C. Therefore, the wrinkles and crumples already formed on the garment C can be removed.

Alternatively, the control unit 400 may gradually decrease the conveying speed of the second conveyor 221 for conveying the garment C.

For example, the control unit 400 can gradually decrease the conveying speed of the second conveyor 221 for conveying the garment C from the first conveying speed V1 to the second conveying speed V2. For example, the control unit 400 can decelerate the second conveyor motor M21 with uniform acceleration from the first rotational speed W1 to the second rotational speed W2.

As another example, the control unit 400 can gradually decrease the conveying speed of the second conveyor 221 for conveying the garment C from the first conveying speed V1 until the second conveyor 221 stops. For example, the control unit 400 can decrease the rotational speed of the second conveyor motor M21 from the first rotational speed W1 to 0 rpm with uniform acceleration.

As still another example, the control unit 400 can decrease the conveying speed of the second conveyor 221 for conveying the garment C from the first conveying speed V1 to the second conveying speed V2 and then gradually decrease the conveying speed until the second conveyor 221 stops. For example, the control unit 400 can decelerate the second conveyor motor M21 from the first rotational speed W1 to the second rotational speed W2 and then decelerate the second conveyor motor M21 from the second rotational speed W2 to 0 rpm with uniform acceleration.

In some implementations, this configuration can gradually increase a difference in speed between the layers, thereby gradually strongly pulling the garment C. In comparison with a case in which a great speed difference between the layers instantaneously occurs to strongly pull the garment C, it is possible to remove wrinkles while protecting the fabric of the garment C.

In some implementations, the second folding layer conveying step S200 can further include a conveyance ending step S240.

In the conveyance ending step S240, when the rear end of the garment C has passed through the second conveyor 221, the control unit 400 can end the operation of conveying the garment C. Specifically, when the rear end of the garment C has passed through the second-conveyor-front-end garment detection sensor SC2, the control unit 400 can determine that the entire garment C has passed through the second conveyor 221. Further, the control unit 400 can end the operation of the second conveyor motor M21.

In the third folding layer conveying step S300, the control unit 400 can convey the garment C at a predetermined conveying speed when the garment C enters the third folding layer 230, and the control unit 400 can decrease the conveying speed for the garment in the third folding layer 230 when the tip of the garment C passes through the third folding layer 230 and enters the fourth folding layer 240.

In the first conveying speed conveying step S310 of the third folding layer conveying step S300, the fourth conveyor 232 and the third conveyor 231 provided in the third folding layer 230 can convey the garment C at the predetermined first conveying speed V1.

Specifically, in the first conveying speed conveying step S310, the control unit 400 can rotate the third conveyor motor M31 at the first rotational speed W1 when the garment C enters the third conveyor 231 (S311). For example, when the tip of the garment C has passed through the second-conveyor-front-end garment detection sensor SC2, the control unit 400 can determine that the tip of the garment C has passed through the second conveyor 221 and entered the third conveyor 231. In some implementations, the control unit 400 can operate the third conveyor motor M31 with a duty ratio of 100%, and the rotational speed of the third conveyor motor M31 may be 110 rpm or more and 130 rpm or less. That is, the first rotational speed W1 may be 110 rpm or more and 130 rpm or less.

Therefore, the third conveyor 231 can convey the garment C from the front end to the rear end of the third conveyor 231 by means of the driving power provided by the third conveyor motor M31. In this case, the third conveyor 231 can convey the garment C at the first conveying speed V1.

In some implementations, when the third-conveyor-rear-end garment detection sensor SC3 detects that the garment C has successfully reached the rear end of the third conveyor 231, the next process is determined depending on whether the garment C needs to be subjected to the ½ horizontal folding.

If the garment C is not set in advance as an object to be subjected to the ½ horizontal folding, the control unit 400 immediately can operate the fourth conveyor motor M32 rearward to deliver the garment C to the fourth folding layer 240 via the rear end of the fourth conveyor 232 (S312).

In the first conveying speed conveying step S310, when the garment C passes through the third conveyor 231 and enters the fourth conveyor 232, the control unit 400 can rotate the fourth conveyor motor M32 at the first rotational speed W1 (S313). For example, when the tip of the garment C has passed through the third-conveyor-rear-end garment detection sensor SC31, the control unit 400 can determine that the tip of the garment C has passed through the third conveyor 231 and entered the fourth conveyor 232. In this case, the control unit 400 can operate the fourth conveyor motor M32 with a duty ratio of 100%, and the rotational speed of the fourth conveyor motor M32 may be 110 rpm or more and 130 rpm or less. That is, the first rotational speed W1 may be 110 rpm or more and 130 rpm or less.

Therefore, the fourth conveyor 232 may convey the garment C from the front end to the rear end of the fourth conveyor 232 by means of the driving power provided by the fourth conveyor motor M32. In this case, the fourth conveyor 232 can convey the garment C at the first conveying speed V1. That is, the third conveyor 231 and the fourth conveyor 232 can convey the garment C at the same speed, and the third conveyor motor M31 and the fourth conveyor motor M32 can operate at the same rotational speed.

In some implementations, when the garment C passes through the fourth conveyor 232 and enters the fourth folding layer 240, the second conveying speed conveying step S330 can be performed without performing a horizontal folding step S320 to be described below.

In some implementations, the first conveying speed conveying step S310 of the third folding layer conveying step S300 can be performed simultaneously with the second conveying speed conveying step S230 of the second folding layer conveying step S200.

Therefore, when the garment C is positioned on both the second conveyor 221 and the third conveyor 231, the control unit 400 can set the conveying speeds so that the conveying speed of the third conveyor 231 for conveying the garment C is higher than the conveying speed of the second conveyor 221 for conveying the garment C. That is, the control unit 400 can make the rotational speed of the third conveyor motor M31 higher than the rotational speed of the second conveyor motor M21, thereby implementing a difference in conveying speed for the garment C between the second folding layer 220 and the third folding layer 230. Therefore, the difference in conveying speed between the second folding layer 220 and the third folding layer 230 can pull the garment C, thereby preventing the garment C from being wrinkled and crumpled during the process of conveying the garment C.

In some implementations, the first conveying speed conveying step S310 of the third folding layer conveying step S300 can be performed simultaneously with the third conveying speed conveying step S140 of the first folding layer conveying step S100 as well as the second conveying speed conveying step S230 of the second folding layer conveying step S200.

Therefore, when the garment C is positioned over the first conveyor 211, the second conveyor 221, and the third conveyor 231, the control unit 400 can set the conveying speeds so that the conveying speed of the third conveyor 231 for conveying the garment C is higher than the conveying speed of the second conveyor 221 for conveying the garment C and the conveying speed of the second conveyor 221 for conveying the garment C is higher than the conveying speed of the first conveyor 211 for conveying the garment C. That is, the control unit 400 can make the rotational speed of the third conveyor motor M3 higher than the rotational speed of the second conveyor motor M21 and make the rotational speed of the second conveyor motor M21 higher than the rotational speed of the first conveyor motor M1, thereby implementing a difference in conveying speed for the garment C between the first folding layer 210, the second folding layer 220, and the third folding layer 230.

Therefore, the difference in conveying speed between the first folding layer 210, the second folding layer 220, and the third folding layer 230 can pull the garment C, thereby preventing the garment C from being wrinkled and crumpled during the process of conveying the garment C.

The third folding layer conveying step S300 can include the horizontal folding step S320.

In some implementations, in the case in which the garment C is set in advance as an object to be subjected to ½ horizontal folding, the horizontal folding can be performed in a preset manner. For example, the control unit 400 can control the fourth conveyor motor M32 so that the rotation direction of the fourth conveyor 232 is opposite to the rotation direction of the third conveyor 231 to perform the horizontal folding on the garment C. In some implementations, in order to avoid a repeated description, the detailed description of the horizontal folding in the third folding layer 230 may be replaced with the above-mentioned description. However, in some implementations, the conveying speed of the fourth conveyor 232 for conveying the garment may be higher than the conveying speed of the third conveyor 231 for conveying the garment to prevent the garment C from being wrinkled during the process of performing the horizontal folding.

In the second conveying speed conveying step S330 of the third folding layer conveying step S300, when the tip of the garment C passes through the fourth conveyor 232 and enters the fifth conveyor 241 disposed below the fourth conveyor 232, the third conveyor 23 and the fourth conveyor 232 can convey the garment C at the predetermined second conveying speed V2 decreased from the first conveying speed V1. In this case, the second conveying speed V2 may be lower than the first conveying speed V1.

Specifically, in the second conveying speed conveying step S330, when the tip of the garment C has passed through the fourth-conveyor-rear-end garment detection sensor SC41, the control unit 400 can determine that the tip of the garment C has passed through the fourth conveyor 232 and entered the fifth conveyor 241. In this case, a part of the garment C, which includes the tip of the garment C, can be positioned on the fifth conveyor 251, and at least a part of the garment C can be positioned on the fourth conveyor 232. Further, the control unit 400 can decrease the conveying speeds of the third and fourth conveyors 231 and 232 for conveying the garment.

In some implementations, when the tip of the garment C passes through the fourth-conveyor-rear-end garment detection sensor SC41 and enters the fifth conveyor 241, the control unit 400 can rotate the third conveyor motor M31 and the fourth conveyor motor M32 at the predetermined second rotational speed W2. For example, the control unit 400 can rotate the third conveyor motor M31 and the fourth conveyor motor M32 with a duty ratio of 50%, and the rotational speed of the third and fourth conveyor motors M31 and M32 may be 90 rpm or more and 105 rpm or less. That is, the second rotational speed W2 may be 90 rpm or more and 105 rpm or less.

In some implementations, when the tip of the garment C passes through the rear end of the fourth conveyor 232, the control unit 400 can decrease the rotational speed of the third conveyor motor M31 and the fourth conveyor motor M32 from the first rotational speed W1 to the second rotational speed W2. In this case, the second rotational speed W2 is lower than the first rotational speed W1.

In some implementations, the second conveying speed conveying step S330 of the third folding layer conveying step S300 can be performed simultaneously with the first conveying speed conveying step S410 of the fourth folding layer conveying step S400.

Therefore, when the garment C is positioned at least on both the fourth conveyor 232 and the fifth conveyor 241, the control unit 400 can set the conveying speeds so that the conveying speed of the fifth conveyor 241 for conveying the garment C is higher than the conveying speed of the fourth conveyor 232 for conveying the garment C. For example, the control unit 400 can make the rotational speed of the fifth conveyor motor M41 higher than the rotational speed of the fourth conveyor motor M32, thereby implementing a difference in conveying speed for the garment C between the third folding layer 230 and the fourth folding layer 240. Therefore, the difference in conveying speed between the third folding layer 230 and the fourth folding layer 240 may pull the garment C, thereby preventing the garment C from being wrinkled and crumpled during the process of conveying the garment C.

In some implementations, the third folding layer conveying step S300 can further include a conveyance ending step S340.

In the conveyance ending step S340, when the rear end of the garment C has passed through the third conveyor 231, the control unit 400 can end the operation of conveying the garment C by the third conveyor 231 (S341). Specifically, when the rear end of the garment C has passed through the third-conveyor-rear-end garment detection sensor SC3, the control unit 400 can determine that the entire garment C has passed through the third conveyor 231. Further, the control unit 400 can end the operation of the third conveyor motor M31.

In some implementations, the operation of ending the conveyance of the garment C by the third conveyor 231 can be performed in the horizontal folding step S320 or the second conveying speed conveying step S330.

In addition, in the conveyance ending step S340, when the rear end of the garment C has passed through the fourth conveyor 232, the control unit 400 can end the operation of conveying the garment C by the fourth conveyor 232 (S342). Specifically, when the rear end of the garment C has passed through the fourth-conveyor-rear-end garment detection sensor SC41, the control unit 400 can determine that the entire garment C has passed through the fourth conveyor 232. Further, the control unit 400 can end the operation of the fourth conveyor motor M32.

In the fourth folding layer conveying step S400, when the garment C enters the fourth folding layer 240, the control unit 400 can convey the garment C at a predetermined conveying speed and perform the ⅓ horizontal folding on the garment C.

In some implementations, the process to be performed in the fourth folding layer conveying step S400 is determined depending on whether the ½ horizontal folding has been performed in the third folding layer conveying step S300.

In the case in which the ½ horizontal folding is not performed on the garment C in the third folding layer conveying step S300, the control unit 400 in the first conveying speed conveying step S410 operates the fifth conveyor motor M41 forward to convey the garment C at the first conveying speed V1 from the rear end toward the front end of the fifth conveyor 241.

Specifically, in the first conveying speed conveying step S410, the control unit 400 can rotate the fifth conveyor motor M41 at the first rotational speed W1 when the garment C enters the fifth conveyor 241 (S411). For example, when the tip of the garment C has passed through the fourth-conveyor-rear-end garment detection sensor SC41, the control unit 400 can determine that the tip of the garment C has passed through the fourth conveyor 232 and entered the fifth conveyor 241. In this case, the control unit 400 can operate the fifth conveyor motor M41 with a duty ratio of 100%, and the rotational speed of the fifth conveyor motor M41 may be 110 rpm or more and 130 rpm or less. That is, the first rotational speed W1 may be 110 rpm or more and 130 rpm or less.

Therefore, the fifth conveyor 241 can convey the garment C from the rear end to the front end of the fifth conveyor 241 by means of driving power provided by the fifth conveyor motor M41. In this case, the fifth conveyor 241 can convey the garment C at the first conveying speed V1.

On the contrary, in the case in which the ½ horizontal folding is performed on the garment C in the third folding layer conveying step S300, the control unit 400 in the first conveying speed conveying step S410 of the fourth folding layer conveying step S400 operates the seventh conveyor motor M43 rearward to convey the garment C from the front end toward the rear end of the seventh conveyor 243.

Specifically, in the first conveying speed conveying step S410, the control unit 400 may rotate the seventh conveyor motor M43 at the first rotational speed W1 when the garment C enters the seventh conveyor 243 (S412). For example, when the tip of the garment C has passed through the fourth-conveyor-lower-part garment detection sensor SC42, the control unit 400 can determine that the tip of the garment C has passed through the first folding gap G1 and entered the seventh conveyor 243. In this case, the control unit 400 can operate the seventh conveyor motor M43 with a duty ratio of 100%, and the rotational speed of the seventh conveyor motor M43 may be 110 rpm or more and 130 rpm or less. That is, the first rotational speed W1 may be 110 rpm or more and 130 rpm or less.

Therefore, the seventh conveyor 243 can convey the garment C from the front end to the rear end of the seventh conveyor 243 by means of the driving power provided by the seventh conveyor motor M43. In this case, the seventh conveyor 243 can convey the garment C at the first conveying speed V1.

The fourth folding layer conveying step S400 can include a horizontal folding step S420. In some implementations, in the case in which the garment C is set in advance as an object to be subjected to the horizontal folding, the horizontal folding can be performed in a preset manner.

In some implementations, in order to avoid a repeated description, the detailed description of the horizontal folding in the fourth folding layer 240 may be replaced with the above-mentioned description. However, the garment conveying speed of the sixth conveyor 242 may be lower than the garment conveying speed of the fifth conveyor 241 or the seventh conveyor 243 that rotates in the direction opposite to the direction in which the sixth conveyor 242 rotates in order to prevent the garment C from being wrinkled during the process of performing the horizontal folding.

In some implementations, FIGS. 22 to 29 are flowcharts for schematically explaining a situation in which the garment folding machine removes wrinkles while conveying the garment from the first folding layer to the fourth folding layer.

A process of folding a garment by applying the method of controlling the garment folding machine will be described below with reference to FIGS. 17A, 17B, and 22 to 29.

When the garment C is loaded into the loading unit 100, the loading unit motor ML operates, such that the retraction member 132 and the clip part 131 holding the garment C are retracted to the third stop position (S11).

In this case, when the rear end position detection sensor SL3 detects (S12) that the retraction member 132 and the clip part 131 have reached the third stop position, the loading unit motor ML is stopped (S13), and at the same time, and the current is supplied to the first conveyor motor M1, such that the operation of the first conveyor 211 is initiated (S14). In this case, the first conveyor 211 operates rearward at the first conveying speed V1.

When the garment C is conveyed by the movement of the first conveyor 211, the first-conveyor-rear-end garment detection sensor SC1 can detect whether the tip of the garment C reaches the rear end of the first conveyor 211. For example, when the first-conveyor-rear-end garment detection sensor SC1 detects the tip of the garment C, the control unit 400 can determine that the tip of the garment C passes through the first conveyor 211 (S15).

When the first-conveyor-rear-end garment detection sensor SC1 detects that the tip of the garment C has reached the rear end of the first conveyor 211, the second conveyor motor M21 can operate forward at the same time to deliver the garment C to the second folding layer 220.

In some implementations, the first conveyor 211 can decrease the speed of conveying the garment C from the first conveying speed V1 to the second conveying speed V2, and the second conveyor 221 can operate forward at the first conveying speed V1 (S21).

In the second folding layer 220, the second-conveyor-front-end garment detection sensor SC2 determines whether the tip of the garment C has reached the second conveyor. For example, when the second-conveyor-front-end garment detection sensor SC2 detects the tip of the garment C, the control unit 400 can determine that the tip of the garment C passes through the second conveyor 221 (S22).

In some implementations, when the second-conveyor-front-end garment detection sensor SC2 detects that the garment C has successfully reached the front end of the second conveyor 221, the next process is determined depending on whether the garment C needs to be subjected to the vertical folding (S23).

In the case in which the garment C is set in advance as an object such as an upper garment to be subjected to the vertical folding, the first conveyor motor M1 and the second conveyor motor M21 are stopped immediately (S24) when the tip of the garment C reaches the front end of the second conveyor 221, and the vertical folding assembly 222 operates to perform the vertical folding on the garment C.

For example, the current is supplied to the vertical folding motor M22, and the vertical folding motor M22 operates (S25).

The pair of vertical folding plates 2221 can be moved, by the operation of the vertical folding motor M22, from the standby position toward a center of the garment C by a movement amount corresponding to a vertical folding width set in advance to the garment C to be vertically folded.

When the vertical folding is completely performed on the garment C by the movement of the vertical folding plate 2221, the vertical folding motor M22 can operate in a reverse direction to return the vertical folding plates 2221 to the standby position (S26).

Next, when it is determined that the vertical folding plates 2221 has been returned to the standby position, the second conveyor motor M21 can operate forward to convey the garment C to the third folding layer 230, and at the same time, the third conveyor motor M31 of the third folding layer 230 for receiving the garment C operates rearward (S31).

In some implementations, if the garment C is not set in advance as an object such as an upper garment to be subjected to the vertical folding, the process of vertically folding the garment C is omitted, the second conveyor motor M21 continuously operates forward without being stopped, and the third conveyor motor M31 of the third folding layer 230 for receiving the garment C operates rearward.

In some implementations, the second conveyor 221 can decrease the speed of conveying the garment C from the first conveying speed V1 to the second conveying speed V2, and the third conveyor 231 can operate rearward at the first conveying speed V1.

In some implementations, in a case in which the garment C such as a towel having a long length is folded, a part of the garment C, which includes the rear end of the garment, can be positioned on the first conveyor 211. For example, the first conveyor 211 can decrease the speed of conveying the garment C from the second conveying speed V2 to the third conveying speed V3.

In some implementations, when the first-conveyor-rear-end garment detection sensor SC1 detects that the garment C does not exist any further, the control unit 400 can determine that the rear end of the garment C has passed through the first conveyor 211 (S32). Further, the control unit 400 can stop the operation of the first conveyor 211 (S33).

In the third folding layer 230, the third-conveyor-rear-end garment detection sensor SC3 determines whether the tip of the garment C has reached the third conveyor. For example, when the third-conveyor-rear-end garment detection sensor SC3 detects the tip of the garment C, the control unit 400 can determine that the tip of the garment C passes through the third conveyor 231 (S34).

Meanwhile, when the third-conveyor-rear-end garment detection sensor SC3 detects that the garment C has successfully reached the rear end of the third conveyor 231, the next process is determined depending on whether the garment C needs to be subjected to the ½ horizontal folding (S35).

In the case in which the garment C is not set in advance as an object to be subjected to the ½ horizontal folding, the control unit 400 immediately operates the fourth conveyor motor M32 rearward to deliver the garment C to the fourth folding layer 240 via the rear end of the fourth conveyor 232.

In the case in which the garment C is set in advance as an object to be subjected to the ½ horizontal folding, the fourth conveyor motor M32 is operated rearward immediately when the tip of the garment C reaches the front end of the third conveyor 231 (S36*a*). In this case, the fourth conveyor 232 can operate at the first conveying speed V1. That is, the fourth conveyor 232 may operate at the same conveying speed as the third conveyor 231.

Further, in the fourth folding layer 240, the fourth-conveyor-rear-end garment detection sensor SC41 can determine whether the tip of the garment C has reached the fourth conveyor. For example, when the fourth-conveyor-rear-end garment detection sensor SC41 detects the tip of the garment C, the control unit 400 can determine that the tip of the garment C passes through the fourth conveyor 232 (S36*b*). Further, the control unit 400 can operate the fifth conveyor 241, the sixth conveyor 242, and the seventh conveyor 243 forward (S36*c*).

In some implementations, the fifth conveyor 241, the sixth conveyor 242, and the seventh conveyor 243 can operate forward at the first conveying speed V1, and the third conveyor 231 and the fourth conveyor 232 can decelerate from the first conveying speed V1 to the second conveying speed V2.

Thereafter, when the third-conveyor-rear-end garment detection sensor SC3 detects that the rear end of the garment C has passed through the rear end of the third conveyor 231 (S36*d*), the operations of the third to seventh conveyors 231, 232, 241, 242, and 243 can be stopped (S36*e*), and the garment passage time Tc from a point in time at which the tip of the garment C reaches the rear end of the third conveyor 231 to a point in time at which the rear end of the garment C passes through the rear end of the third conveyor 231 is calculated by the timer 440 (S36*f*).

Next, the control unit 400 can operate the third conveyor 231 and the fourth conveyor 232 forward and operate the fifth conveyor 241, the sixth conveyor 242, and the seventh conveyor 243 rearward to prepare the ½ horizontal folding (S36*g*).

In some implementations, the fifth conveyor 241, the sixth conveyor 242, and the seventh conveyor 243 can decelerate from the first conveying speed V1 to the second conveying speed V2, and the third conveyor 231 and the fourth conveyor 232 may accelerate from the second conveying speed V2 to the first conveying speed V1.

The third conveyor motor M31 and the fourth conveyor motor M32 are operated forward for the time Tc/2 half the calculated garment passage time Tc, such that the ½ portion of the garment C is disposed in the longitudinal direction above the first folding gap G1 defined between the third conveyor 231 and the fourth conveyor 232 (S36*h*).

In this case, the third conveyor motor M31, the fourth conveyor motor M32, the fifth conveyor motor M41, the sixth conveyor motor M42, and the seventh conveyor motor M43 are stopped (S36*i*).

When the preparation of the ½ horizontal folding for the garment C is completed, the first horizontal folding assembly 233 disposed above the third conveyor 231 and the fourth conveyor 232 can be operated. For example, the control unit 400 can operate the first folding bar driving motor M33 (S36*j*).

When the first-folding-bar driving motor M33 operates, the first folding bar 2331 rectilinearly moves downward from an initial position toward the first folding gap G1, pushes the ½ portion of the garment C at least partially into the first folding gap G1, and then returns back to the initial position by the operation of the crank member.

When the first folding bar position sensor SFB1 detects that the operation of the first folding bar 2331 is completed (S36*k*), the third conveyor motor M31 operates rearward and the fourth conveyor motor M32 operates forward so that the garment C may pass through the first folding gap G1 while being subjected to the ½ horizontal folding (S36l).

In some implementations, the fourth-conveyor-lower-part garment detection sensor SC42 determines whether the tip of the garment C has passed through the first folding gap G1 (S36*m*).

In some implementations, the seventh conveyor 243 operates rearward (S36*n*) when the fourth-conveyor-lower-part garment detection sensor SC42 detects that the tip of the garment C has passed through the first folding gap G1.

In some implementations, the seventh conveyor 243 can operate at the first conveying speed V1, and the conveying speeds of the third and fourth conveyors 231 and 232 can decrease from the first conveying speed V1 to the second conveying speed V2.

In some implementations, in the case in which the ½ horizontal folding is not performed in the third folding layer 230, the fourth conveyor motor M32 operates rearward when the tip of the garment C has reached the third conveyor 231 (S37*a*). In some implementations, the fourth conveyor 232 can operate at the first conveying speed V1. For example, the fourth conveyor 232 can operate at the same conveying speed as the third conveyor 231.

Further, in the fourth folding layer 240, the fourth-conveyor-rear-end garment detection sensor SC41 determines whether the tip of the garment C has reached the fourth conveyor. That is, when the fourth-conveyor-rear-end garment detection sensor SC41 detects the tip of the garment C, the control unit 400 can determine that the tip of the garment C passes through the fourth conveyor 232 (S37*b*). Further, the control unit 400 can operate the fifth conveyor 241, the sixth conveyor 242, and the seventh conveyor 243 forward (S41).

In some implementations, the fifth conveyor 241, the sixth conveyor 242, and the seventh conveyor 243 can operate forward at the first conveying speed V1, and the third conveyor 231 and the fourth conveyor 232 can decelerate from the first conveying speed V1 to the second conveying speed V2.

In some implementations, in both a case in which the ½ horizontal folding is performed in the third folding layer 230 and a case in which the ½ horizontal folding is not performed in the third folding layer 230, the ½ horizontal folding may be performed in the same or similar manner as that in the third folding layer 230 or the ⅓ horizontal folding can be performed twice on the garment C delivered to the fourth folding layer 240.

Therefore, the process of performing the ½ horizontal folding and the process of performing the ⅓ horizontal folding twice on the garment C that has not be subjected to the ½ horizontal folding in the third folding layer 230 will be described, and descriptions of other repetitive processes will be omitted.

The garment C, which is conveyed from the rear end of the fourth conveyor 232, is delivered to the fifth conveyor 241 first, and then delivered to the seventh conveyor 243 via the sixth conveyor 242.

The control unit 400 measures the time using the timer 440 (S43) when the third-conveyor-rear-end garment detection sensor SC3 detects that the rear end of the garment C has passed through the third conveyor 231 (S42).

Thereafter, when the seventh-conveyor-rear-end garment detection sensor SC7 detects that the rear end of the garment C has passed through the rear end of the seventh conveyor 243 (S44), the third to seventh conveyors 231, 232, 241, 242, and 243 are stopped (S45). Further, the timer 440 calculates the garment passage time Tc from the point in time at which the tip of the garment C reaches the rear end of the seventh conveyor 243 to the point in time at which the rear end of the garment C passes through the rear end of the seventh conveyor 243 (S46).

When the passage time Tc is calculated, the next process is determined depending on whether the garment C is subjected to the ½ horizontal folding or the ⅓ horizontal folding (S47).

First, when the garment C is subjected to the ½ horizontal folding, the ½ horizontal folding process is performed using the third folding gap G3 provided between the sixth conveyor 242 and the seventh conveyor 243.

For example, the control unit 400 operates the fifth conveyor motor M41, the sixth conveyor motor M42, and the seventh conveyor motor M43 rearward (S48*a*).

In this case, in order to prepare the ½ horizontal folding, the fifth conveyor 241, the sixth conveyor 242, and the seventh conveyor 243 are operated rearward for the time Tc/2 half the calculated garment passage time Tc, such that the ½ portion of the garment C is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped (S48*c*).

When the preparation of the ½ horizontal folding for the garment C is completed, the third horizontal folding assembly 245 disposed above the sixth conveyor 242 and the seventh conveyor 243 is operated (S48*d*).

For example, the third folding bar 2451 rectilinearly moves downward from the initial position toward the third folding gap G3, pushes the ½ portion of the garment C at least partially into the third folding gap G3, and then returns back to the initial position by the operation of the crank member.

When the third folding bar position sensor SFB3 detects that the operation of the third folding bar 2451 is completed (S48*e*), the seventh conveyor motor M43 operates rearward and the fifth conveyor motor M41 and the sixth conveyor motor M42 operate forward so that the garment C may pass through the third folding gap G3 while being subjected to the ½ horizontal folding. The garment C on which the ½ horizontal folding is completely performed is delivered to the unloading layer 310 disposed below the third folding gap G3. In this case, the fifth conveyor 241, the sixth conveyor 242, and the seventh conveyor 243 can operate at the first conveying speed V1.

Next, when the garment C is subjected to the ⅓ horizontal folding, primary ⅓ horizontal folding is performed using the second folding gap G2 provided between the fifth conveyor 241 and the sixth conveyor 242, and secondary ⅓ horizontal folding process can be performed using the third folding gap G3 provided between the sixth conveyor 242 and the seventh conveyor 243.

For example, the control unit 400 operates the fifth conveyor motor M41, the sixth conveyor motor M42, and the seventh conveyor motor M43 rearward (S49*a*).

In this case, in order to prepare the primary ⅓ horizontal folding, the fifth conveyor 241, the sixth conveyor 242, and the seventh conveyor 243 are operated for the time (Tc*⅔) which is ⅔ of the garment passage time Tc (S49*b*), such that a ⅔ portion of the garment C is disposed in the longitudinal direction above the second folding gap G2 provided between the fifth conveyor 241 and the sixth conveyor 242, and the fifth conveyor motor M41, the sixth conveyor motor M42, and the seventh conveyor motor M43 are stopped (S49*c*).

When the preparation of the primary ⅓ horizontal folding for the garment C is completed, a second horizontal folding assembly 244 disposed above the fifth conveyor 241 and the sixth conveyor 242 is operated (S49*d*).

As described above, the second horizontal folding assembly 244 has the same structure and operates in the same manner as the first horizontal folding assembly 233.

For example, the second folding bar 2441 rectilinearly moves downward from the initial position toward the second folding gap G2, pushes the ⅔ portion of the garment C at least partially into the second folding gap G2, and then returns back to the initial position by the operation of the crank member.

When the second folding bar position sensor SFB2 detects that the operation of the second folding bar 2441 is completed (S49*e*), the fifth conveyor motor M41 operates forward and the sixth conveyor motor M42 and the seventh conveyor motor M43 operate rearward so that the garment C is subjected to the primary ⅓ horizontal folding (S49*f*).

In this case, the sixth-conveyor-rear-lower-part garment detection sensor SC61 determines whether the tip of the garment C has passed through the second folding gap G2. In the case in which the garment C does not reach the second folding gap, the fifth conveyor motor M41 operates forward and the sixth conveyor motor M42 and the seventh conveyor motor M43 operate rearward (S49*g*).

In some implementations, when the sixth-conveyor-rear-lower-part garment detection sensor SC61 detects that the tip of the garment C has reached the second folding gap, the fifth conveyor motor M41 operates rearward and the sixth conveyor motor M42 and the seventh conveyor motor M43 operate forward (S49*h*).

In this case, in order to prepare the secondary ⅓ horizontal folding, the fifth conveyor 241 operates rearward and the sixth conveyor 242 and the seventh conveyor 243 operate forward for the time (Tc*⅔) which is ⅓ of the garment passage time Tc (S49*i*).

Further, the ⅓ portion of the garment C, which is made before the primary horizontal folding process, is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped (S49*j*).

When the preparation of the secondary ⅓ horizontal folding for the garment C is completed, the third horizontal folding assembly 245 disposed above the sixth conveyor 242 and the seventh conveyor 243 is operated (S49*k*).

In this case, the sixth-conveyor-front-lower-part garment detection sensor SC62 detects whether the tip of the garment C has passed through the third folding gap G3. When the tip of the garment C has passed through the third folding gap G3, the control unit 400 can operate the unloading unit 300.

What is claimed is:

1. A garment folding machine comprising:

a frame unit defining an external framework of the garment folding machine;

a loading unit configured to receive a garment;

a folding unit configured to convey and fold the received garment; and an unloading unit configured to collect the garment from the folding unit, wherein the folding unit comprises:

a plurality of folding layers that are spaced apart from each other in a vertical direction, and a vertical folding assembly configured to vertically fold the garment conveyed from a first folding layer of the plurality of folding layers, wherein each of the plurality of folding layers comprises:

a conveyor configured to convey the garment, and a conveyor motor configured to provide driving power to the conveyor, and wherein a first conveyor motor is configured to, based on the garment being positioned over two or more adjacent conveyors of the plurality of folding layers, operate at a predetermined first rotational speed that is different from a predetermined second rotational speed of a second conveyor motor disposed above the first conveyor motor.

2. The garment folding machine of claim 1, wherein the predetermined first rotational speed is faster than the predetermined second rotational speed.

3. The garment folding machine of claim 1, wherein the folding unit further comprises:

the first folding layer, and a second folding layer disposed below the first folding layer, wherein the first folding layer comprises:

a first conveyor configured to convey, from a front end to a rear end of the first conveyor, the garment, and the first conveyor motor configured to provide driving power to the first conveyor, wherein the second folding layer comprises:

a second conveyor configured to convey, from a rear end to a front end of the second conveyor, the garment that is conveyed from the first folding layer, and the second conveyor motor configured to provide driving power to the second conveyor, and wherein the second conveyor motor is configured to, based on the garment being positioned on the first conveyor and the second conveyor, operate at a rotational speed different from a rotational speed of the first conveyor motor.

4. The garment folding machine of claim 3, wherein the folding unit further comprises a third folding layer disposed below the second folding layer, wherein the third folding layer comprises:

a third conveyor configured to convey, from a front end to a rear end of the third conveyor, the garment that is conveyed from the second folding layer, and a third conveyor motor configured to provide driving power to the third conveyor, and wherein the first conveyor motor, the second conveyor motor, and the third conveyor motor are configured to, based on the garment being positioned on the first conveyor, the second conveyor, and the third conveyor, operate at different rotational speeds.

5. The garment folding machine of claim 1, wherein the folding unit comprises:

the first folding layer, a second folding layer disposed below the first folding layer, and a third folding layer disposed below the second folding layer, wherein the second folding layer comprises:

a second conveyor configured to convey, from a rear end to a front end of the second conveyor, the garment that is conveyed from the first folding layer, and the second conveyor motor configured to provide driving power to the second conveyor, wherein the third folding layer comprises:

a third conveyor configured to convey, from a front end to a rear end of the third conveyor, the garment that is conveyed from the second folding layer, and a third conveyor motor configured to provide driving power to the third conveyor, and wherein the third conveyor motor is configured to, based on the garment being positioned on the second conveyor and the third conveyor, operate at a rotational speed different from a rotational speed of the second conveyor motor.

6. The garment folding machine of claim 5, wherein the folding unit further comprises a fourth folding layer disposed below the third folding layer, wherein the third folding layer further comprises:

a fourth conveyor that is disposed rearward from the third conveyor and that is configured to convey, from a front end to a rear end of the fourth conveyor, the garment conveyed from the third conveyor, and a fourth conveyor motor configured to provide driving power to the fourth conveyor, wherein the fourth folding layer comprises:

a fifth conveyor that is disposed below the fourth conveyor and that is configured to convey, from a rear end to a front end of the fifth conveyor, the garment conveyed from the fourth conveyor, and a fifth conveyor motor configured to provide driving power to the fifth conveyor, and wherein the fifth conveyor motor is configured to, based on the garment being positioned on the fourth conveyor and the fifth conveyor, operate at a rotational speed different from a rotational speed of the fourth conveyor motor.

7. A garment folding machine comprising:

a frame unit defining an external framework of the garment folding machine;

a loading unit configured to receive a garment;

a folding unit configured to convey and fold the received garment; and an unloading unit configured to collect the garment from the folding unit, wherein the folding unit comprises:

a plurality of folding layers that are spaced apart from each other in a vertical direction, and a vertical folding assembly configured to vertically fold the garment conveyed from a first folding layer of the plurality of folding layers, wherein each of the plurality of folding layers comprises:

a conveyor configured to convey the garment, and a conveyor motor configured to provide driving power to the conveyor, and wherein the conveyor motor is configured to, based on a tip of the garment passing through the conveyor, change a rotational speed.

8. The garment folding machine of claim 7, wherein the folding unit further comprises:

a first folding layer; and a second folding layer disposed below the first folding layer, wherein the first folding layer comprises:

a first conveyor configured to convey, from a front end to a rear end of the first conveyor, the garment, and a first conveyor motor configured to provide driving power to the first conveyor, and wherein the first conveyor motor is configured to, based on the garment entering the first conveyor, rotate at a predetermined first rotational speed, and the first conveyor motor is configured to, based on the tip of the garment passing through the rear end of the first conveyor, rotate at a predetermined second rotational speed different from the predetermined first rotational speed.

9. The garment folding machine of claim 8, wherein the second folding layer comprises a second conveyor configured to convey, from a rear end to a front end of the second conveyor, the garment that is conveyed from the first folding layer, and wherein the first conveyor motor is configured to, based on the tip of the garment passing through the front end of the second conveyor and a rear end of the garment being positioned on the first conveyor, rotate at a predetermined third rotational speed different from the predetermined first rotational speed and the predetermined second rotational speed.

10. The garment folding machine of claim 7, wherein:

the conveyor motor is configured to decrease the rotational speed from a predetermined first rotational speed to a predetermined second rotational speed, and the conveyor motor is configured to (i) rotate at a predetermined third rotational speed and (ii) rotate at the predetermined second rotational speed.

11. The garment folding machine of claim 7, wherein the conveyor is configured to gradually decrease the rotational speed from a predetermined first rotational speed to a predetermined second rotational speed.

12. The garment folding machine of claim 7, wherein the conveyor motor is configured to decrease the rotational speed from a predetermined first rotational speed to a predetermined second rotational speed, and wherein the conveyor motor is configured to gradually decrease the rotational speed from the predetermined second rotational speed to a predetermined third rotational speed.

13. A method of controlling a garment folding machine having a plurality of folding layers configured to perform folding a garment or conveying the garment using at least one conveyor, the method comprising:

a first conveying step of conveying the garment at a predetermined first conveying speed by a first conveyor provided in a first folding layer disposed at an uppermost side among the plurality of folding layers; and a second conveying step of conveying, based on a tip of the garment passing through the first conveyor and entering a second conveyor disposed below the first conveyor, the garment at a predetermined second conveying speed by the first conveyor, wherein, in the second conveying step, the second conveyor is configured to convey the garment at the predetermined first conveying speed, and wherein the predetermined first conveying speed is different from the predetermined second conveying speed.

14. The method of claim 13, further comprising:

a third conveying step of conveying, based on (i) the tip of the garment passing through the second conveyor and entering a third conveyor disposed below the second conveyor and (ii) a part of the garment being positioned on the first conveyor, the garment at a predetermined third conveying speed by the first conveyor, wherein the third conveying speed is different from the predetermined first conveying speed and the predetermined second conveying speed.

15. The method of claim 14, wherein, in the third conveying step, the second conveyor is configured to convey the garment at the predetermined second conveying speed.

16. The method of claim 14, wherein, in the third conveying step, the third conveyor is configured to convey the garment at the predetermined first conveying speed.

17. The method of claim 13, wherein, in the second conveying step, a speed of conveying the garment is changed to a predetermined third conveying speed once or more while the first conveyor conveys the garment at the predetermined second conveying speed, and wherein the predetermined third conveying speed is different from the predetermined second conveying speed.

18. The method of claim 13, further comprising:

a conveyance ending step of halting the first conveyor based on a rear end of the garment passing through the first conveyor.

19. The method of claim 13, wherein, in the second conveying step, the first conveyor is configured to, based on vertical folding performing on the garment, stop.

20. A garment folding machine comprising:

a frame unit defining an external framework of the garment folding machine;

a loading unit configured to receive a garment;

a folding unit configured to convey and fold the received garment; and an unloading unit configured to collect the folded garment from the folding unit, wherein the folding unit comprises:

a first folding layer, and a second folding layer disposed below the first folding layer, wherein the first folding layer comprises:

a first conveyor configured to convey, from a front end to a rear end of the first conveyor, the garment, a first conveyor motor configured to provide driving power to the first conveyor, and a first-conveyor-rear-end garment detection sensor that is disposed at a rear end of the first conveyor and that is configured to detect whether the garment reaches the rear end of the first conveyor, wherein the first conveyor motor is configured to rotate at a predetermined first rotational speed, and wherein the first conveyor motor is configured to, based on the first-conveyor-rear-end garment detection sensor detecting a tip of the garment, rotate at a predetermined second rotational speed different from the predetermined first rotational speed.

21. The garment folding machine of claim 20, wherein the second folding layer comprises:

a second conveyor configured to convey, from a rear end to a front end of the second conveyor, the garment that is conveyed from the first folding layer, and a second conveyor motor configured to provide driving power to the second conveyor, and wherein the second conveyor motor is configured to, based on the first-conveyor-rear-end garment detection sensor detecting the tip of the garment, rotate at the predetermined first rotational speed.

22. The garment folding machine of claim 20, wherein the second folding layer comprises:

a second conveyor configured to convey the garment from a rear end to a front end of the second conveyor, a second conveyor motor configured to provide driving power to the second conveyor, and a second-conveyor-front-end garment detection sensor that is disposed at the front end of the second conveyor and that is configured to detect whether the garment reaches the front end of the second conveyor, and wherein the first conveyor motor is configured to, based on the second-conveyor-front-end garment detection sensor detecting the tip of the garment in a state in which the first-conveyor-rear-end garment detection sensor detects presence of the garment, rotate at a predetermined third rotational speed different from the predetermined second rotational speed.

* * * * *